US010844636B2

(12) United States Patent
Liang et al.

(10) Patent No.: US 10,844,636 B2
(45) Date of Patent: Nov. 24, 2020

(54) COMBINATION FORCED ENTRY RESISTANT SASH LOCK AND TILT LATCH, ALSO FUNCTIONING AS A WINDOW OPENING CONTROL DEVICE

(71) Applicant: Vision Industries Group, Inc., So. Plainfield, NJ (US)

(72) Inventors: Luke Liang, So. Plainfield, NJ (US); Tong Liang, Guangzhou (CN); David Chen, Guangzhou (CN)

(73) Assignee: Vision Industries Group, Inc., Secaucus, NJ (US)

( * ) Notice: Subject to any disclaimer, the term of this patent is extended or adjusted under 35 U.S.C. 154(b) by 469 days.

(21) Appl. No.: 15/722,112

(22) Filed: Oct. 2, 2017

(65) Prior Publication Data

US 2018/0340355 A1 Nov. 29, 2018

Related U.S. Application Data

(60) Provisional application No. 62/509,865, filed on May 23, 2017.

(51) Int. Cl.
*E05B 65/08* (2006.01)
*E05D 15/22* (2006.01)
(Continued)

(52) U.S. Cl.
CPC ..... *E05B 65/087* (2013.01); *E05B 63/0056* (2013.01); *E05B 65/0876* (2013.01);
(Continued)

(58) Field of Classification Search
CPC ..... E05C 2007/007; E05C 3/046; E05C 1/08; E05C 1/16; E05C 3/045; E05C 1/12;
(Continued)

(56) References Cited

U.S. PATENT DOCUMENTS 16,228 A 12/1856 Copeland
30,408 A 10/1860 Judd
(Continued)

FOREIGN PATENT DOCUMENTS

GB 2 286 627 8/1995
GB 2 461 079 12/2009
(Continued)

*Primary Examiner* — Christine M Mills
(74) *Attorney, Agent, or Firm* — Thomas A. O'Rourke; Bodner + O'Rourke, LLP

(57) ABSTRACT

A window fastener includes a forced-entry-resistant sash lock and tilt latch assembly. The sash lock is actuated to engage a keeper to lock the closed sash window. The tilt latch assembly permits sliding of the unlocked window, and prevents tilting until the tilt latch assembly is actuated by the interconnected sash lock. The sash lock and tilt latch assembly cooperate with a stop member secured to a master window frame, to limit opening of the window to a position between the closed position and a full open position, through contact of the latch assembly with a portion of the stop member. The sash lock is configured to actuate the latch assembly into a cocked position, permitting window movement beyond the limited position, and selective contact between the latch assembly and stop member that triggers latch assembly repositioning, causing automatic locking of the sash window when moved into the closed position.

6 Claims, 51 Drawing Sheets

(51) Int. Cl.

| | |
|---|---|
| ***E05B 63/00*** | (2006.01) |
| ***E06B 3/44*** | (2006.01) |
| ***E05C 17/60*** | (2006.01) |
| ***E05C 3/04*** | (2006.01) |
| *E05D 15/58* | (2006.01) |
| *E06B 3/50* | (2006.01) |
| *E05C 7/00* | (2006.01) |

(52) U.S. Cl.

CPC ..... *E05C 3/045* (2013.01); *E05C 17/60* (2013.01); *E05D 15/22* (2013.01); *E06B 3/44* (2013.01); *E05C 2007/007* (2013.01); *E05D 15/58* (2013.01); *E05Y 2201/22* (2013.01); *E06B 3/5054* (2013.01)

(58) Field of Classification Search

CPC ... E05C 9/00; E05C 9/20; E05C 17/60; E05B 65/087; E05B 65/0864; E05B 65/0876; E05B 63/0056; Y10S 292/47; Y10S 292/20; Y10S 292/63; Y10S 292/60; Y10T 292/1039; Y10T 292/104; Y10T 292/1041; Y10T 292/0969; Y10T 292/0977; Y10T 292/0997; E05D 15/22; E05D 15/58; E06B 3/5054; E06B 3/5063; E06B 3/44; E05Y 2201/22

USPC ..... 292/240–242, 163, 175, 169, DIG. 20, 292/DIG. 63, DIG. 47, DIG. 60; 49/449, 49/451

See application file for complete search history.

(56) References Cited

U.S. PATENT DOCUMENTS

| | | | | |
|---|---|---|---|---|
| 36,524 | A | | 9/1862 | Minor |
| 51,222 | A | | 11/1865 | Ridell |
| 108,778 | A | | 11/1870 | Gorman |
| 115,781 | A | | 6/1871 | Steele |
| 126,872 | A | | 5/1872 | Buckman |
| 148,857 | A | | 3/1874 | Smith |
| 163,008 | A | | 5/1875 | Gillespie |
| 166,842 | A | | 8/1875 | Berryman |
| 178,360 | A | | 6/1876 | Cooper |
| 190,074 | A | | 4/1877 | Penfield |
| 192,614 | A | | 7/1877 | Andrews |
| 192,919 | A | | 7/1877 | Hoyt |
| 201,146 | A | | 3/1878 | Adler |
| 215,125 | A | | 5/1879 | Hunter |
| 226,033 | A | | 3/1880 | Burns |
| 230,476 | A | | 7/1880 | Green |
| 234,387 | A | | 11/1880 | Burgess |
| 284,993 | A | | 9/1883 | Abele |
| 314,350 | A | | 3/1885 | Smith |
| 316,285 | A | | 4/1885 | McKeen |
| 331,005 | A | | 11/1885 | Sahr |
| 336,302 | A | | 2/1886 | Dudgeon |
| 346,788 | A | | 8/1886 | Teufel |
| 350,678 | A | | 10/1886 | Hussey |
| 353,287 | A | | 11/1886 | Chumard |
| 368,595 | A | | 8/1887 | King |
| 375,656 | A | | 12/1887 | Shaw |
| 376,252 | A | | 1/1888 | McIntyre |
| 379,910 | A | | 3/1888 | Rosentreter |
| 369,885 | A | | 9/1888 | Shaw |
| 410,728 | A | | 9/1889 | Brown |
| 417,868 | A | | 12/1889 | Janes |
| 423,761 | A | | 3/1890 | Hasenpflug |
| 426,303 | A | | 4/1890 | McGovern |
| 447,068 | A | | 2/1891 | Dixon |
| 452,723 | A | | 5/1891 | Schmalhausen |
| 480,148 | A | | 8/1892 | Theby |
| 493,159 | A | | 3/1893 | Gibson |
| 509,941 | A | | 12/1893 | Perry |
| 512,593 | A | | 1/1894 | Webster |
| 520,754 | A | | 5/1894 | Burmeister |
| 526,118 | A | | 9/1894 | Sharp |
| 528,656 | A | | 11/1894 | Burmeister |
| 530,078 | A | | 12/1894 | Ammerman |
| 534,185 | A | | 2/1895 | Winchester |
| 537,258 | A | | 4/1895 | Wilcox |
| 539,030 | A | | 5/1895 | Bitner |
| 551,181 | A | | 12/1895 | Dillon |
| 551,242 | A | | 12/1895 | Wallace |
| 554,448 | A | | 2/1896 | Keil |
| 564,426 | A | | 7/1896 | Hubbard |
| 572,591 | A | | 12/1896 | Woodard |
| 587,424 | A | | 8/1897 | Bonine |
| 590,225 | A | | 9/1897 | Hill |
| 653,458 | A | | 7/1900 | Paquette |
| 666,596 | A | | 1/1901 | Breen |
| 683,928 | A | | 10/1901 | Geraghty |
| 688,491 | A | | 12/1901 | Sigler |
| 695,736 | A | | 3/1902 | Kendrick |
| 698,742 | A | | 4/1902 | Schamweber |
| 699,696 | A | | 5/1902 | Mellen |
| 708,406 | A | | 9/1902 | Robison |
| 714,343 | A | | 11/1902 | Wellman |
| 718,007 | A | | 1/1903 | Linn |
| 719,981 | A | | 2/1903 | Adams |
| 722,162 | A | | 3/1903 | St. Louis |
| 724,466 | A | | 4/1903 | Hannan |
| 743,716 | A | | 11/1903 | Hadka |
| 744,755 | A | | 11/1903 | Hasenpflug |
| 745,888 | A | * | 12/1903 | McElwee et al. .... E05B 63/044 292/244 |
| 749,469 | A | | 1/1904 | Assorati |
| 756,453 | A | | 4/1904 | Arens |
| 756,559 | A | | 4/1904 | Arens |
| 757,249 | A | | 4/1904 | Barnard |
| 759,642 | A | | 5/1904 | Sparks |
| 764,493 | A | | 7/1904 | Noseworthy |
| 769,386 | A | | 9/1904 | Johnson |
| 769,767 | A | | 9/1904 | Phelps |
| 774,536 | A | | 11/1904 | Saunders |
| 775,602 | A | | 11/1904 | Heamshaw |
| 800,043 | A | | 9/1905 | Witte |
| 804,994 | A | | 11/1905 | Andrews |
| 815,537 | A | | 3/1906 | Kissinger |
| 833,900 | A | | 10/1906 | Sigler |
| 836,313 | A | * | 11/1906 | Fox ..... E05B 63/044 292/244 |
| 837,811 | A | | 12/1906 | Ebbeson |
| 840,727 | A | | 1/1907 | Brister |
| 865,090 | A | | 9/1907 | Eddy |
| 866,073 | A | | 9/1907 | Saunders |
| 878,206 | A | | 2/1908 | Johnson |
| 881,658 | A | | 3/1908 | Bowman |
| 886,108 | A | | 4/1908 | Allen |
| 887,690 | A | | 5/1908 | Pearce |
| 922,894 | A | | 5/1908 | Heid |
| 897,719 | A | | 9/1908 | Daubaignan |
| 900,079 | A | | 10/1908 | Bittorf |
| 910,850 | A | | 1/1909 | Petrie |
| 926,899 | A | | 7/1909 | Roy |
| 928,408 | A | | 7/1909 | Taube |
| 948,628 | A | | 2/1910 | Jefferis |
| 959,150 | A | | 5/1910 | Morris |
| 966,063 | A | | 8/1910 | Toothaker |
| 976,777 | A | | 11/1910 | Brown |
| 980,131 | A | | 12/1910 | Shean |
| 998,642 | A | | 7/1911 | Sheen |
| 1,003,386 | A | | 9/1911 | Welker |
| 1,006,211 | A | | 10/1911 | Hermon |
| 1,020,454 | A | | 3/1912 | Seidenbecker |
| 1,041,803 | A | | 10/1912 | Kilburn |
| 1,051,918 | A | | 2/1913 | Rowley |
| 1,059,999 | A | | 4/1913 | James |
| 1,069,079 | A | | 7/1913 | Voight |
| 1,077,487 | A | | 11/1913 | Miller |
| 1,080,172 | A | | 12/1913 | Rusk |
| 1,100,820 | A | | 6/1914 | Edwards |
| 1,121,228 | A | | 12/1914 | Burkhart |
| 1,122,026 | A | | 12/1914 | O'Rourke |

(56) References Cited

U.S. PATENT DOCUMENTS 1,127,835 A 2/1915 Westlund
1,133,217 A 3/1915 Barton
1,141,437 A 6/1915 Unterlender
1,148,712 A 8/1915 Overland
1,163,086 A 12/1915 Harper
1,173,129 A 2/1916 Tallaferro
1,177,637 A 4/1916 Lane
1,177,838 A 4/1916 Wilkinson
1,207,989 A 12/1916 O'Rourke
1,232,683 A 7/1917 Hollis
1,243,115 A 10/1917 Shur
1,244,745 A 10/1917 Gadke
1,247,182 A 11/1917 Tuekmantel
1,253,810 A 1/1918 Gianninoto
1,261,274 A 4/1918 Newsarn
1,269,467 A 6/1918 Winters
1,270,740 A 6/1918 Keyes
1,272,900 A 7/1918 Berman
1,279,353 A 9/1918 Kelley
1,311,052 A 7/1919 Danforth
1,322,677 A 11/1919 Ditlefsen
1,338,250 A 4/1920 Parkes
1,338,416 A 4/1920 Bellinger
1,339,362 A 5/1920 L'Heureux
1,341,234 A 5/1920 Horton
1,350,698 A 8/1920 Boedtcher
1,387,302 A 8/1921 Page
1,388,272 A 8/1921 Lawrence
1,393,628 A 10/1921 Leichter
1,398,174 A 11/1921 Carlson
1,399,897 A 12/1921 Singer
1,412,154 A 4/1922 Wollesen
1,439,585 A 12/1922 Trost
1,461,467 A 7/1923 Stuart
1,463,866 A 8/1923 Bourbeau
1,470,858 A 10/1923 Maxwell
1,485,382 A 3/1924 Foley
1,490,874 A 4/1924 Webb
1,516,995 A 11/1924 Trigueiro
1,550,532 A 8/1925 French
1,552,690 A 9/1925 Frantz
1,587,037 A 6/1926 Rudolph
1,601,051 A 9/1926 Wilbert
1,605,717 A 11/1926 Gregg
1,619,031 A 3/1927 Ostrosky
1,622,742 A 3/1927 Shipman
1,658,818 A 1/1928 Dillon
1,692,579 A 11/1928 Schrader
1,704,946 A 3/1929 Lindgren
1,712,792 A 5/1929 Hansen
1,715,957 A 6/1929 Stein
1,724,637 A 8/1929 Bergstrom
1,750,715 A 3/1930 Jeffers
1,794,171 A 2/1931 Grutel
1,812,288 A 6/1931 Drapeau
1,819,824 A 8/1931 McAllister
1,864,253 A 6/1932 McIntyre
1,869,274 A 7/1932 Phillips
1,877,177 A 9/1932 Hinderer
1,891,940 A 12/1932 McAllister
1,900,936 A 3/1933 Huttgar
1,901,974 A 3/1933 Macy
1,922,062 A 8/1933 Sullivan
1,940,084 A 12/1933 Grasso
1,960,034 A 5/1934 Stewart
1,964,114 A 6/1934 Gerlach
2,095,057 A 10/1937 Corrado
2,122,661 A 7/1938 Rightmyer
2,126,995 A 8/1938 Kingdon
2,136,408 A 11/1938 Bedell
2,158,260 A 5/1939 Stillman
2,202,561 A 5/1940 Lahiere
2,272,145 A 2/1942 Anderson
2,326,084 A 8/1943 Westrope
2,369,584 A 2/1945 Lundholm
2,452,521 A 10/1948 Johnson
2,480,016 A 8/1949 Granberg
2,480,988 A 9/1949 Walton
2,500,349 A 3/1950 Menns
2,503,370 A 4/1950 Zanona
2,523,559 A 9/1950 Couture
2,527,278 A 10/1950 Schemansky
2,537,736 A 1/1951 Carlson
2,560,274 A 7/1951 Cantelo
2,581,816 A 1/1952 Schlueter
2,590,624 A 3/1952 James
2,599,196 A 6/1952 Peremi
2,605,125 A 7/1952 Emerson
2,612,398 A 9/1952 Miller
2,613,526 A 10/1952 Holmsten
2,621,951 A 12/1952 Ostadal
2,645,515 A 7/1953 Thomas
2,648,967 A 8/1953 Holmsten
2,670,982 A 3/1954 Banham
2,692,789 A 10/1954 Rivard
2,735,707 A 2/1956 Sylvan
2,758,862 A 8/1956 Endter
2,766,492 A 10/1956 Day
2,789,851 A 4/1957 Lickteig
2,818,919 A 1/1958 Sylvan
2,846,258 A 8/1958 Granberg
2,855,772 A 10/1958 Hillgren
2,884,276 A 4/1959 Baptist
2,920,914 A 1/1960 Jenkins
2,941,832 A 6/1960 Grossman
2,967,595 A * 1/1961 Zitomer ..... E06B 3/44
49/450
3,027,188 A 3/1962 Eichstadt
3,135,542 A 6/1964 Wilkenson
3,187,526 A 6/1965 Moler
3,267,613 A 8/1966 McQuiston
3,288,510 A 11/1966 Gough
3,352,586 A 11/1967 Hakanson
3,362,740 A 1/1968 Burns
3,422,575 A 1/1969 Armstrong
3,438,153 A 4/1969 Lemme
3,599,452 A 8/1971 Maruyama
3,600,019 A 8/1971 Toyota
3,642,315 A 2/1972 Alpern
3,645,573 A 2/1972 Strang
3,683,652 A 8/1972 Halopoff
3,706,467 A 12/1972 Martin
3,762,750 A 10/1973 Orr
3,811,718 A 5/1974 Bates
3,907,348 A 9/1975 Bates
3,919,808 A 11/1975 Simmons
3,927,906 A 12/1975 Mieras
3,930,678 A 1/1976 Alexander
4,054,308 A 10/1977 Prohaska
4,059,298 A 11/1977 Van Klompenburg
4,063,766 A 12/1977 Granberg
4,068,871 A 1/1978 Mercer
4,095,827 A 6/1978 Stavenau
4,095,829 A 6/1978 Van Klompenburg
4,102,546 A 7/1978 Costello
4,151,682 A 5/1979 Schmidt
4,165,894 A 8/1979 Wojciechowski
4,223,930 A 9/1980 Costello
4,227,345 A 10/1980 Durham
4,235,465 A 11/1980 Costello
4,253,688 A 3/1981 Hosooka
4,261,602 A 4/1981 Anderson
4,274,666 A 6/1981 Peck
4,293,154 A 10/1981 Cassells
4,303,264 A 12/1981 Uehara
4,305,612 A 12/1981 Hunt
4,392,329 A 7/1983 Suzuki
4,429,910 A 2/1984 Anderson
4,470,277 A 9/1984 Uyeda
4,475,311 A 10/1984 Gibson
4,525,952 A 7/1985 Cunningham
4,580,366 A 4/1986 Hardy
4,587,759 A 5/1986 Gray
4,621,847 A 11/1986 Paulson

(56) References Cited

U.S. PATENT DOCUMENTS 4,624,073 A 11/1986 Randall
4,639,021 A 1/1987 Hope
4,643,005 A 2/1987 Logas
4,736,972 A 4/1988 Mosch
4,801,164 A 1/1989 Mosch
4,813,725 A 3/1989 Mosch
4,824,154 A 4/1989 Simpson
4,826,222 A 5/1989 Davis
4,827,685 A 5/1989 Schmidt
4,893,849 A 1/1990 Schlack
4,922,658 A 5/1990 Coddens
4,923,230 A 5/1990 Simpson
4,949,506 A 8/1990 Durham
4,961,286 A 10/1990 Bezubic
4,991,886 A 2/1991 Nolte
5,042,855 A 8/1991 Bennett
5,072,464 A 12/1991 Draheim
5,076,015 A 12/1991 Manzalini
5,087,087 A 2/1992 Vetter
5,087,088 A 2/1992 Milam
5,090,750 A 2/1992 Lindqvist
5,090,754 A 2/1992 Thompson
5,110,165 A 5/1992 Piltingsrud
5,127,685 A 7/1992 Dallaire
5,139,291 A 8/1992 Schultz
5,143,412 A 9/1992 Lindqvist
5,161,839 A 11/1992 Piltingsrud
5,165,737 A 11/1992 Riegelman
5,183,310 A 2/1993 Shaughnessy
5,219,193 A 6/1993 Piltingsrud
5,244,238 A * 9/1993 Lindqvist ..... E05B 65/0841 292/36
5,248,174 A 9/1993 Matz
5,274,955 A 1/1994 Dallaire
5,341,752 A 8/1994 Hambleton
5,398,447 A 3/1995 Morse
5,437,484 A 8/1995 Yamada
5,448,857 A 9/1995 Stormo
5,452,925 A 9/1995 Huang
5,454,609 A 10/1995 Slocomb
5,536,052 A 7/1996 Maier
5,560,149 A 10/1996 Lafevre
5,575,116 A 11/1996 Carlson
5,582,445 A 12/1996 Olsen
RE35,463 E 2/1997 Vetter
5,636,475 A 6/1997 Nidelkoff
5,688,000 A 11/1997 Dolman
5,715,631 A 2/1998 Kailian
5,741,032 A 4/1998 Chaput
5,778,602 A 7/1998 Johnson
5,791,700 A 8/1998 Biro
5,806,900 A 9/1998 Bratcher
5,839,767 A 11/1998 Piltingsrud
5,901,499 A 5/1999 Delaske
5,901,501 A 5/1999 Fountaine
5,911,763 A 6/1999 Quesada
5,927,768 A 7/1999 Dallmann
5,970,656 A 10/1999 Maier
5,992,907 A 11/1999 Sheldon
6,000,735 A 12/1999 Jourdenais
6,086,121 A 7/2000 Buckland
6,116,665 A 9/2000 Subliskey
6,135,510 A 10/2000 Diginosa
6,139,071 A 10/2000 Hopper
6,142,541 A 11/2000 Rotondi
6,155,615 A 12/2000 Schulz
6,176,041 B1 1/2001 Roberts
6,178,696 B1 1/2001 Liang
6,183,024 B1 2/2001 Schultz
6,209,931 B1 4/2001 Von Stoutenborough
6,217,087 B1 4/2001 Fuller
6,230,443 B1 5/2001 Schultz
6,279,266 B1 8/2001 Searcy
6,349,576 B2 2/2002 Subliskey
6,364,375 B1 4/2002 Szapucki
6,546,671 B2 4/2003 Mitchell
6,565,133 B1 5/2003 Timothy
6,568,723 B2 5/2003 Murphy
6,588,150 B1 7/2003 Wong
6,592,155 B1 7/2003 Lemley
6,607,221 B1 * 8/2003 Elliott ..... E05B 65/0876 292/33
6,631,931 B2 10/2003 Magnusson
6,634,683 B1 10/2003 Brannan
6,817,142 B2 11/2004 Marshik
6,848,728 B2 2/2005 Rotondi
6,871,885 B2 3/2005 Goldenberg
6,871,886 B2 3/2005 Coleman
6,877,784 B2 4/2005 Kelley
6,925,758 B2 8/2005 Pettit
6,957,513 B2 10/2005 Pettit
6,983,963 B2 1/2006 Eslick
7,000,957 B2 2/2006 Lawrence
7,013,603 B2 3/2006 Eenigenburg
7,063,361 B1 6/2006 Lawrence
7,070,211 B2 7/2006 Polowinczak
7,070,215 B2 7/2006 Kelley
7,100,951 B2 9/2006 Jien
7,147,255 B2 12/2006 Goldenberg
7,159,908 B2 1/2007 Liang
7,296,831 B2 11/2007 Generowicz
7,322,619 B2 1/2008 Nolte
7,322,620 B1 1/2008 Lawrence
7,407,199 B2 8/2008 Richardson
7,415,797 B2 * 8/2008 Dotson ..... E05B 65/0876 49/185
7,431,356 B2 10/2008 Liang
7,481,470 B2 1/2009 Eenigenburg
7,510,221 B2 3/2009 Eenigenburg
7,530,611 B2 5/2009 Liang
7,559,588 B2 7/2009 Liang
7,607,262 B2 10/2009 Pettit
7,637,544 B2 12/2009 Liang
7,665,775 B1 2/2010 Miller
7,699,365 B2 4/2010 Liang
7,922,223 B2 4/2011 Lawrence
7,976,077 B2 7/2011 Flory
8,205,919 B2 6/2012 Flory
8,205,920 B2 6/2012 Flory
8,220,846 B2 7/2012 Liang
8,235,430 B2 8/2012 Liang
8,272,164 B2 9/2012 Albrecht
8,336,930 B2 12/2012 Liang
8,360,484 B2 1/2013 Liang
8,414,039 B2 4/2013 Liang
8,511,724 B2 8/2013 Liang
8,550,507 B2 10/2013 Barton
8,567,830 B2 10/2013 Liang
8,657,347 B2 2/2014 Liang
8,726,572 B2 5/2014 Derham
8,789,857 B2 7/2014 Liang
8,789,862 B2 7/2014 Liang
8,833,809 B2 9/2014 Liang
8,844,985 B2 9/2014 Liang
8,870,244 B2 10/2014 Liang
9,103,144 B2 8/2015 Liang
9,140,033 B2 9/2015 Wolf
9,376,834 B2 6/2016 Liang
9,840,860 B2 * 12/2017 Liang ..... E05B 63/0056
2006/0192391 A1 8/2006 Pettit
2006/0244270 A1 11/2006 Rotondi
2007/0205615 A1 9/2007 Eenigenburg
2008/0169658 A1 7/2008 Wolf
2010/0199726 A1 8/2010 Varney
2010/0218425 A1 9/2010 Nolte
2010/0263415 A1 10/2010 Rupsil
2013/0214545 A1 8/2013 Wolf
2013/0283695 A1 10/2013 Hollerman

(56) References Cited

U.S. PATENT DOCUMENTS

| | | | | |
|---|---|---|---|---|
| 2016/0069108 | A1* | 3/2016 | Liang | E05C 9/028<br>292/165 |
| 2016/0076282 | A1 | 3/2016 | Wolf | |

FOREIGN PATENT DOCUMENTS

| | | |
|---|---|---|
| GB | 2 461 107 | 12/2009 |
| GB | 2 461 108 | 12/2009 |

* cited by examiner

COMBINATION FORCED ENTRY RESISTANT SASH LOCK AND TILT LATCH, ALSO FUNCTIONING AS A WINDOW OPENING CONTROL DEVICE

CROSS REFERENCES TO RELATED APPLICATIONS

This application claims priority on U.S. Provisional Application Ser. No. 62/509,865, filed on May 23, 2017, the disclosures of which are incorporated herein by reference.

FIELD OF THE INVENTION

The present invention relates to sash locks and tilt latches for slidable sash windows, and more particularly to an improved sash lock and tilt latch combination that furthermore includes a window vent stop capability, and with the sash lock also configured to be force-entry-resistant.

BACKGROUND OF THE INVENTION

Single hung and double hung sliding sash windows are known in the art, and are often utilized in the construction of homes and other dwellings, and even offices. Sash locks are typically used to secure the lower sash window in a closed position, if the upper sash is not moveable, or may be used to secure both the upper and lower sash windows in a closed position, where both are slidable with respect to a master window frame. A sash lock is typically mounted to the meeting rail of the lower sash window, and includes a rotatable cam that is pivotally mounted to a housing, where the cam may engage a keeper in a locked (extended) position, which keeper may be attached to the upper sash window or to the master window frame. A tilt latch typically includes a housing, and a latch member slidably disposed in the latch housing. The tilt latch may be used to permit one end of the sash window to tilt away from the master window frame, for ease in cleaning the exterior side of the glazing, and may also facilitate sliding of the sash window in the master frame.

The present invention provides improvements to such window hardware in the form of an integrated sash lock and tilt latch fastener for single hung or double hung windows, which may also be used for dual locking capability and as a vent stop, with the sash lock also configured to be force-entry-resistant with respect to a person attempting to manipulate the sash lock from the exterior.

OBJECTS OF THE INVENTION

It is an object of the invention to provide a sash lock to prevent relative sliding movement of one or both sliding sash windows that are slidable within a master window frame.

It is another object of the invention to provide a tilt latch to permit pivoting of a sliding sash window inwardly into the room in which the window is installed.

It is a further object of the invention to provide a combination sash lock and tilt latch that act cooperatively through the use of a single cam.

It is another object of the invention to provide a sash lock and tilt latch that may act cooperatively to furthermore limit the travel of a window to provide a vent opening that is too small to permit egress of a small child therefrom.

It is also an object of the invention to provide a sash lock that may be blindly coupled to a tilt latch device for cooperative interaction and actuation of the latch.

It is another object of the invention to provide a sash lock and tilt latch combination, in which the sash lock is force-entry-resistant.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A window fastener, for use with respect to a frame of a sash window configured to be slidable and tiltable with respect to a master window frame, may include: a sash lock; a tilt latch assembly; and a stop member. The sash lock may include a housing and a cam pivotally mounted to the sash lock housing, being configured to rotate out of the housing to engage a keeper in a locked position, to lock the sash window in a closed window position. The sash lock is further configured for the cam to be rotated into the sash lock housing to occupy an unlocked position that permits the sash window to slide into one or more open window positions. The sash lock is also configured with a spring biased plate member that selectively interacts with the cam, to provide a forced-entry-resistant sash lock arrangement, in which the cam could not be forced to retract by being jimmied from the exterior by a person seeking to gain unauthorized entry through the locked window.

The tilt latch assembly may include a latch housing, a latch member slidably disposed in the latch housing, and a spring to bias the latch member. The tilt latch assembly is configured to prevent the sash window from being tilted until the tilt latch assembly is selectively actuated by the sash lock.

The sash lock and the tilt latch assembly are further configured to cooperate with the stop member, for the tilt latch assembly to restrict opening of the sash window to a limited open window position, by contact of a first portion of the latch member of the tilt latch assembly with a first portion of the stop member. The limited open window position is a position between the closed window position and a full open window position.

The sash lock and the tilt latch assembly are further configured for the sash lock to actuate the tilt latch assembly and be releasably retained in a cocked position, where the spring bias of the latch member is inhibited, which permits the sash window to slide beyond the limited open window position. Selective contact of a second portion of the latch member of the tilt latch assembly with a second portion of the stop member is configured to trigger the tilt latch assembly out of the cocked position where the latch member is again subjected to the spring bias, and may subsequently be repositioned, so that it may engage a third portion of the stop member to automatically lock the sash window, with respect to the tilt latch assembly and the stop member, when the sash window is moved back into the closed window position.

BRIEF DESCRIPTION OF THE DRAWINGS

The description of the various example embodiments is explained in conjunction with appended drawings, in which:

FIG. 114A is a schematic illustration representing the portion of the track of FIG. 114 between point A and point B.

FIG. 114B is a schematic illustration representing the portion of the track of FIG. 114 between point B and point C.

FIG. 114C is a schematic illustration representing the portion of the track of FIG. 114 between point C and point D.

FIG. 114D is a schematic illustration representing the portion of the track of FIG. 114 between point D and point A.

FIG. 114E is a schematic illustration representing the portion of the track of FIG. 114 between point A and point B.

FIG. 114F is the view of FIG. 114, but which only identifies points A, B, and C on the track, to illustrate the first portion of the circuitous motion of the tip portion of the flexible follower member with respect to the contoured track of the latch housing.

FIG. 114G is the view of FIG. 114, but which only identifies points C, D, and A on the track, to illustrate the second portion of the circuitous motion of the tip portion of the flexible follower member with respect to the contoured track of the latch housing.

FIG. 115 is a first perspective view of the dual stepped stop member of FIG. 1, having selectively contoured surfaces formed thereon, which are configured to cooperate with the latch assembly of FIG. 1.

FIG. 116 is a second perspective view of the stepped stop member of FIG. 1.

FIG. 117 is a third perspective view of the stepped stop member of FIG. 1.

FIG. 118 is a rear view of the stepped stop member of FIG. 115.

FIG. 119 is a first side view of the stepped stop of FIG. 115.

Figures 115, 116, 117, 118, 119, 120, 121:
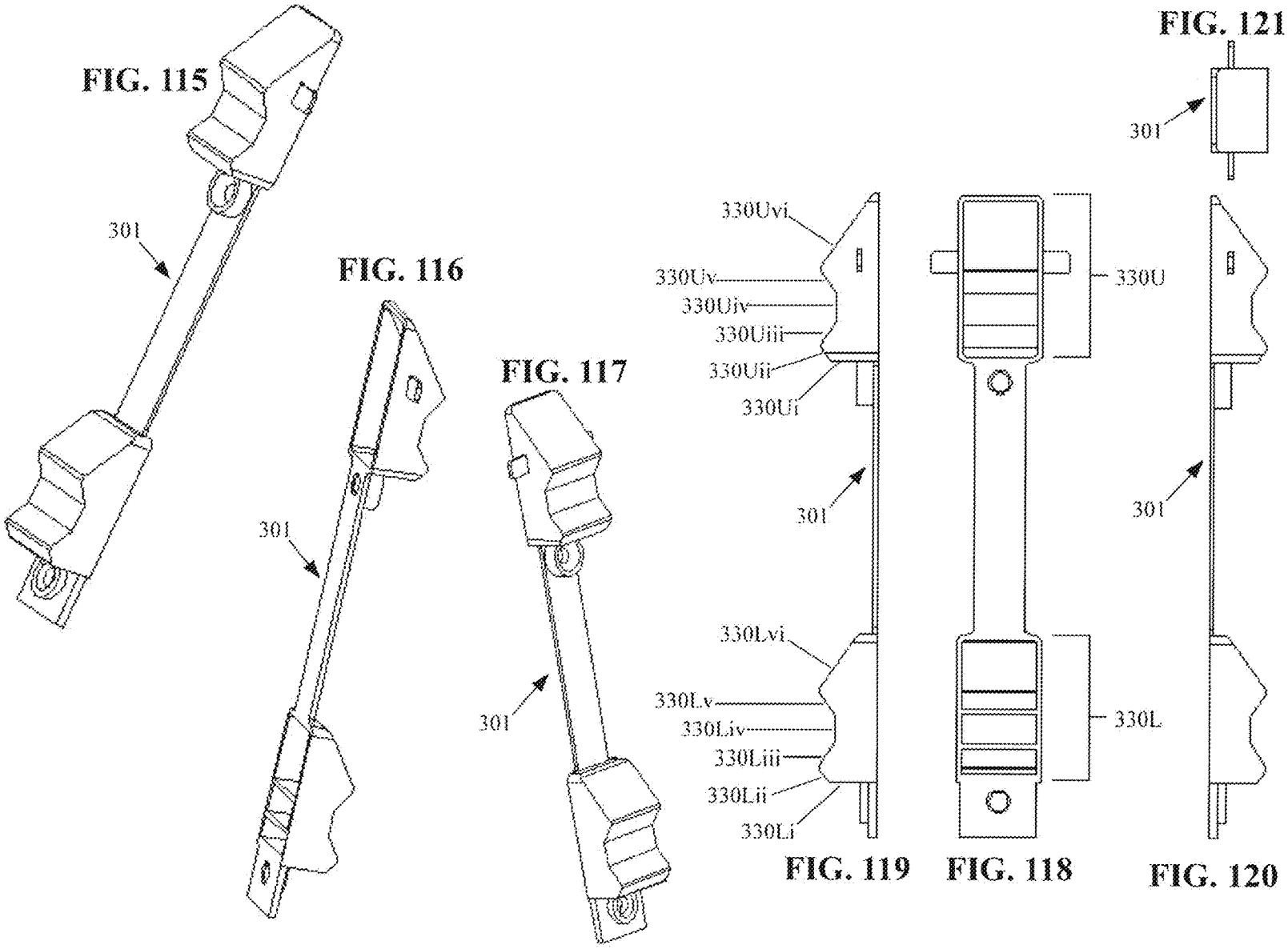

FIG. 120 is a second side view of the stepped stop of FIG. 115.

FIG. 121 is an end view of the stepped stop of FIG. 115.

Figure 1:
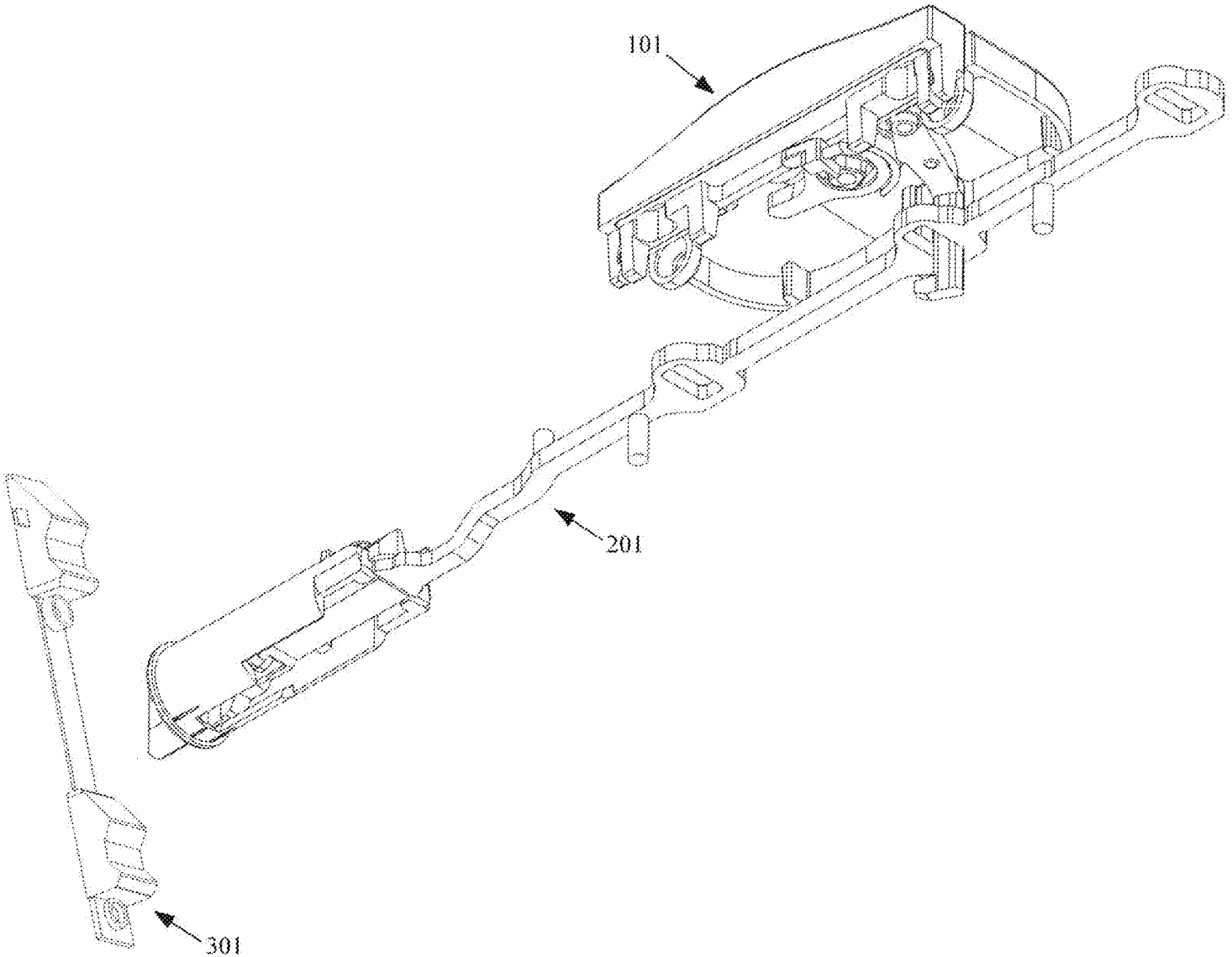
FIG. 1 is a perspective view of a sash fastener for a slidable sash member, and includes a sash lock assembly, a stop member, and a tilt latch assembly (hereinafter referred to as the "latch assembly").
Figure 3:
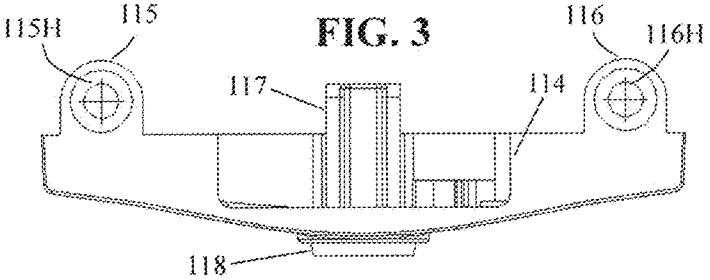
FIG. 3 is a top view of the housing of FIG. 2.
Figure 2:
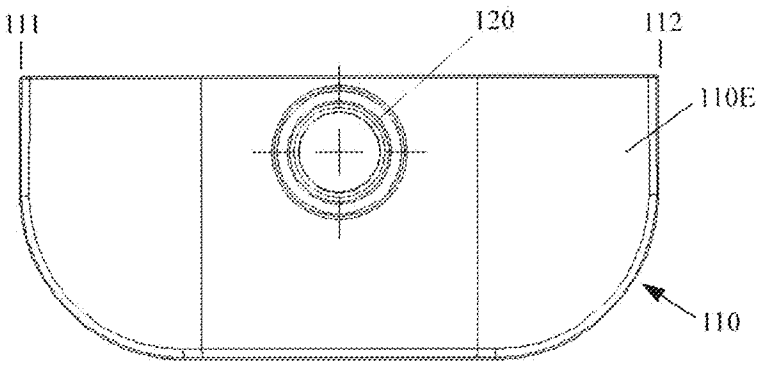
FIG. 2 is a front view of the housing used for the sash lock assembly of FIG. 1.
Figure 4:
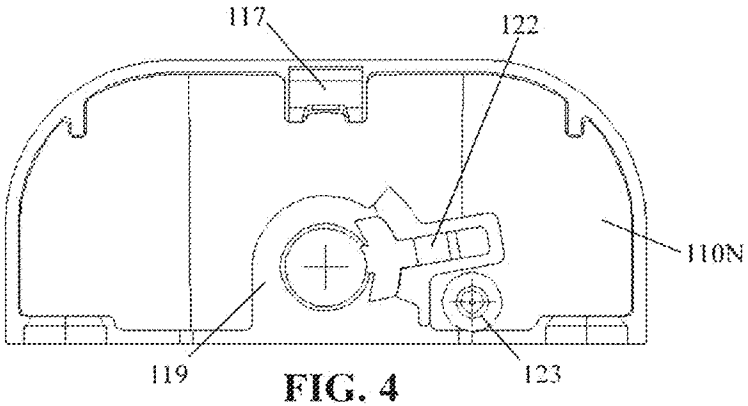
FIG. 4 is a bottom view of the housing of FIG. 2.
Figure 5:
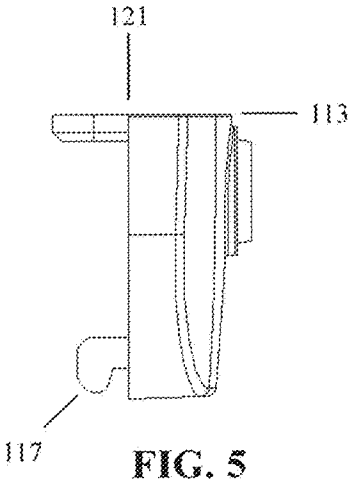
FIG. 5 is an end view of the housing of FIG. 2.
Figure 122:
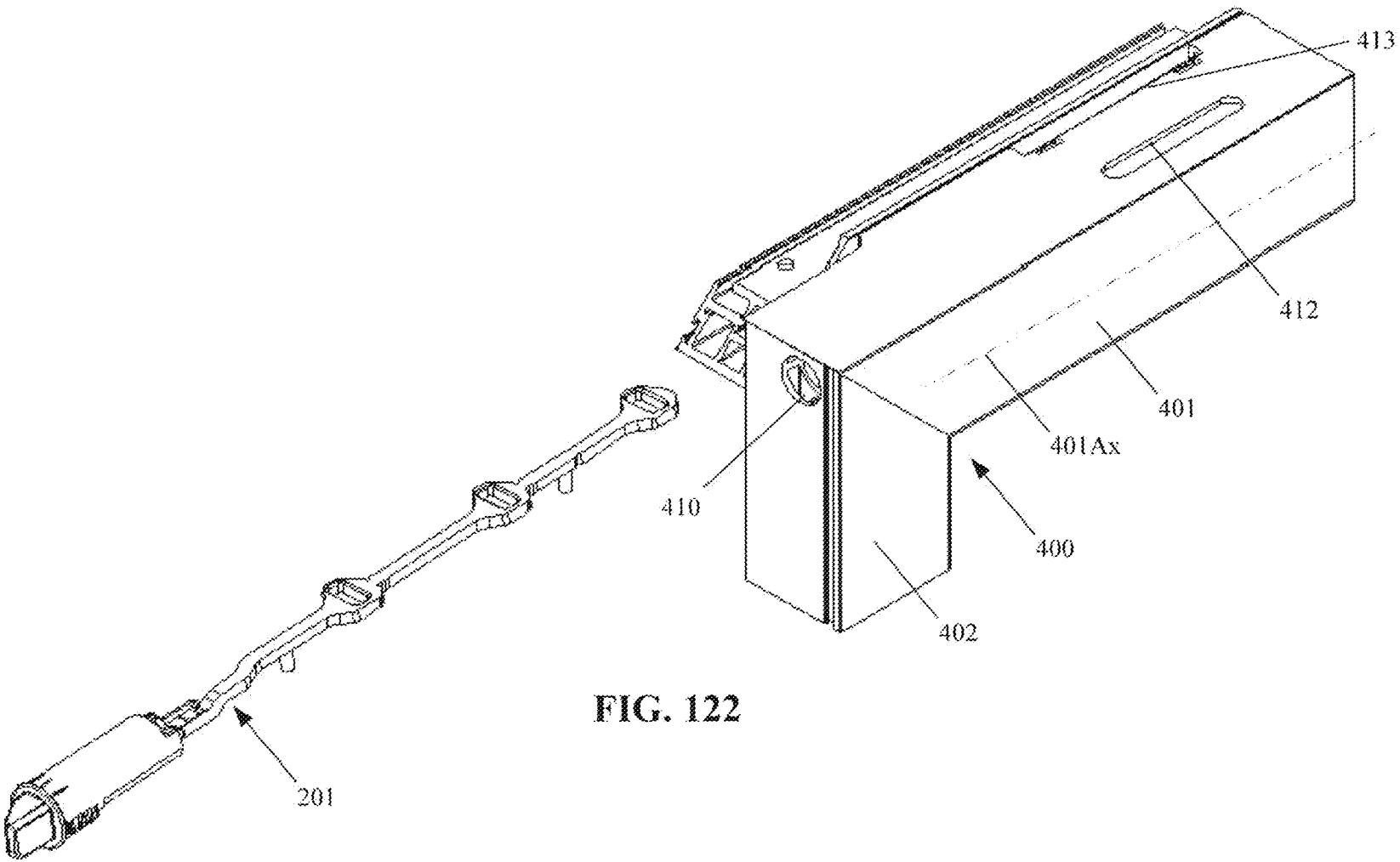

FIG. 122 illustrates the latch assembly of FIG. 1 prior to being installed within the opening in the side of the sash window.

Figure 123:
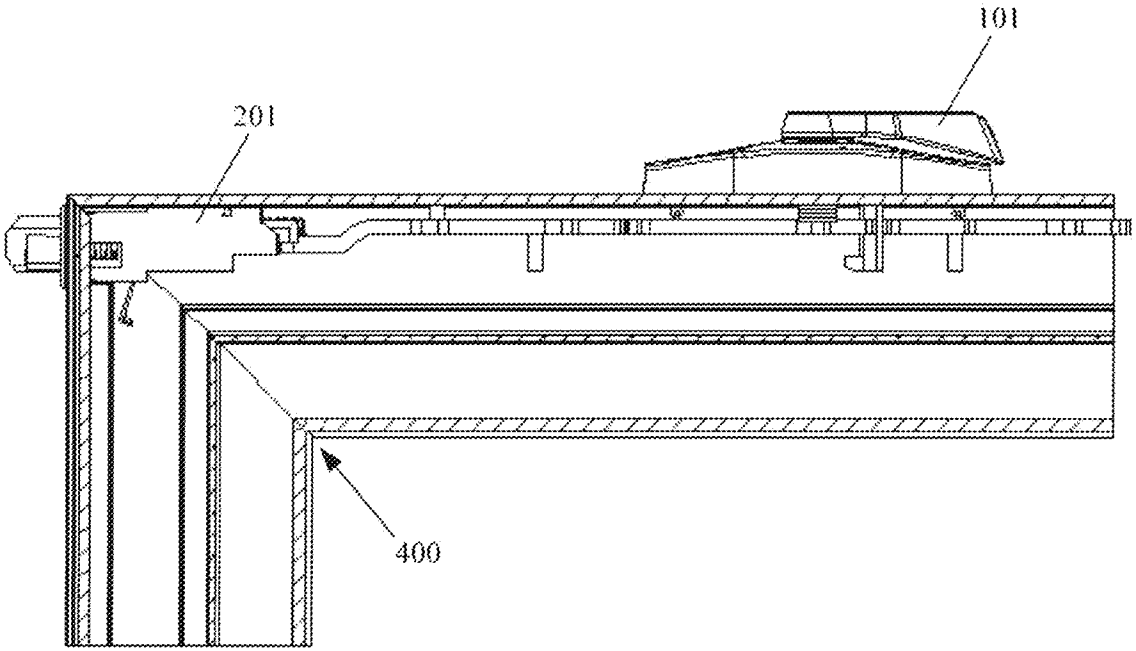

FIG. 123 illustrates the latch assembly of FIG. 1 after being installed within the opening in the side of the sash window, and also illustrates the sash lock of FIG. 1 after being installed onto the meeting rail of the sash window, to be interconnected with the latch assembly.

Figure 124:
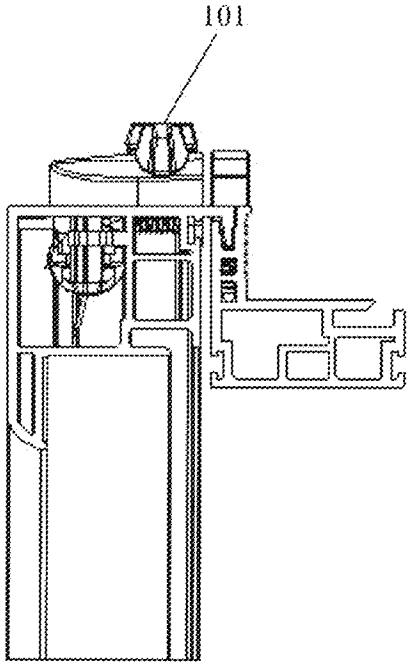

FIG. 124 is a cross-sectional view through the sash window of FIG. 123 and the latch assembly, showing the sash lock interconnected with the latch assembly.

Figure 125:
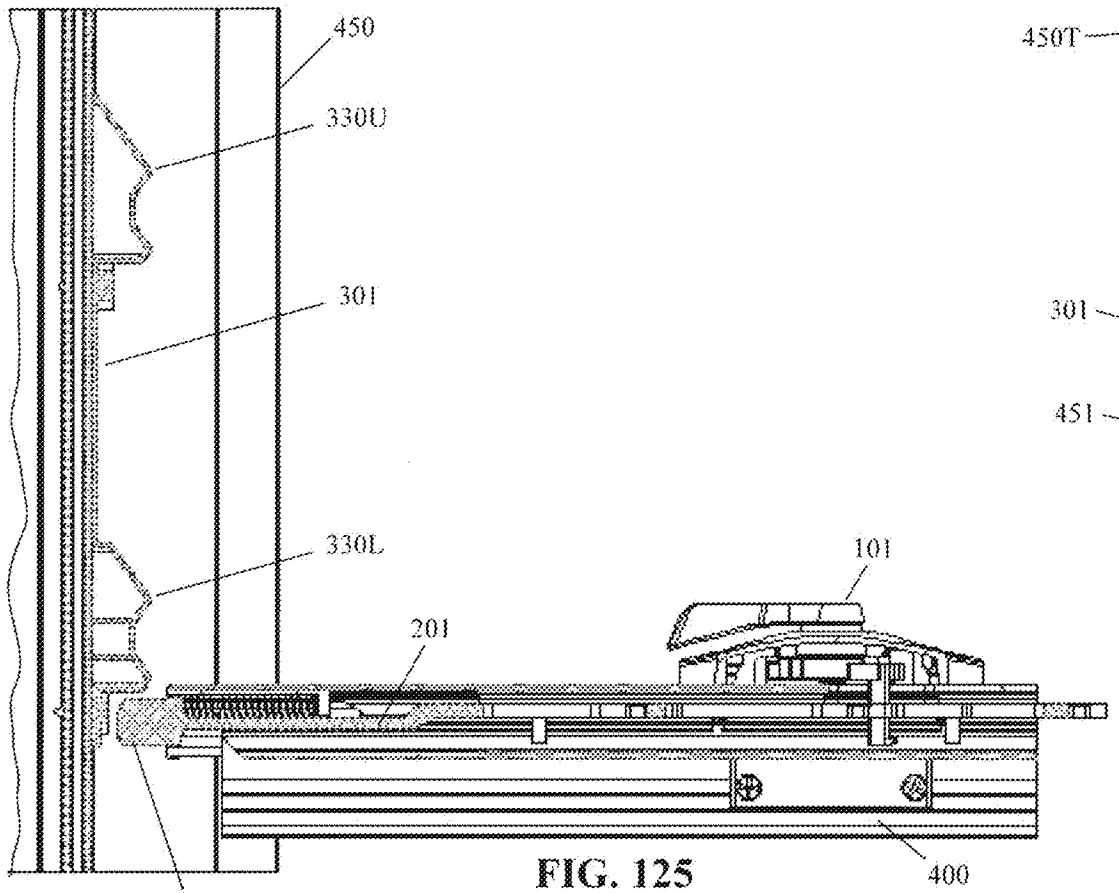

FIG. 125 is a cross-sectional view through the sash window of FIG. 123, the sash lock assembly, and the tilt latch assembly, after being slidably installed in a corresponding master window frame, and through the stepped stop of FIG. 1 after being installed on the master window frame, and the figure also showing the shaft/handle member at zero degrees of rotation for the cam of the sash lock assembly to in the extended locked position, and the latch member to be in the corresponding extended position, to engage a first step of the stop member to redundantly lock the window in the closed window position.

Figure 126:
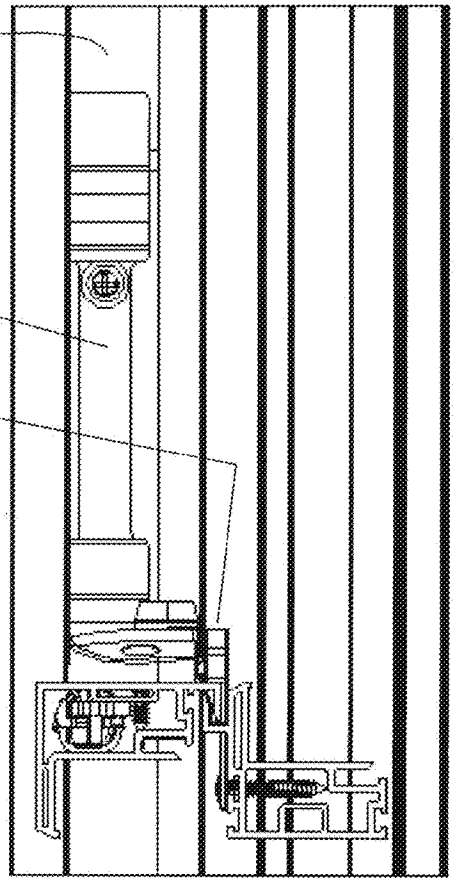

FIG. 126 is a cross-sectional view taken through the arrangement shown in FIG. 125.

Figure 65:
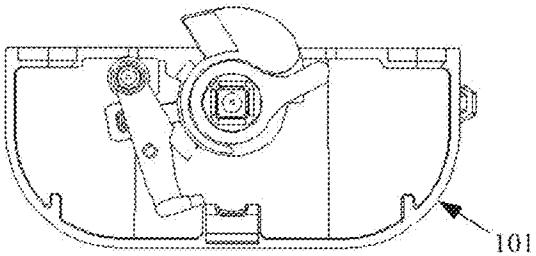
FIG. 65 is a bottom view of the sash lock assembly shown in FIG. 61.
Figure 61:
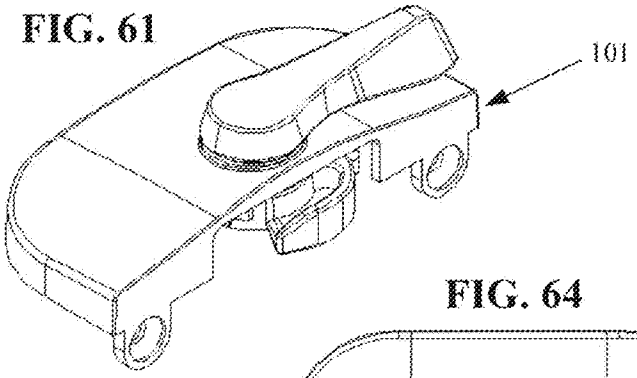
FIG. 61 is a first perspective view of the sash lock assembly of FIG. 1 with the cam shown in an extended position.
Figure 66:
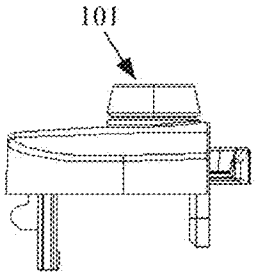
FIG. 66 is a first side view of the sash lock assembly shown in FIG. 61.
Figure 69:
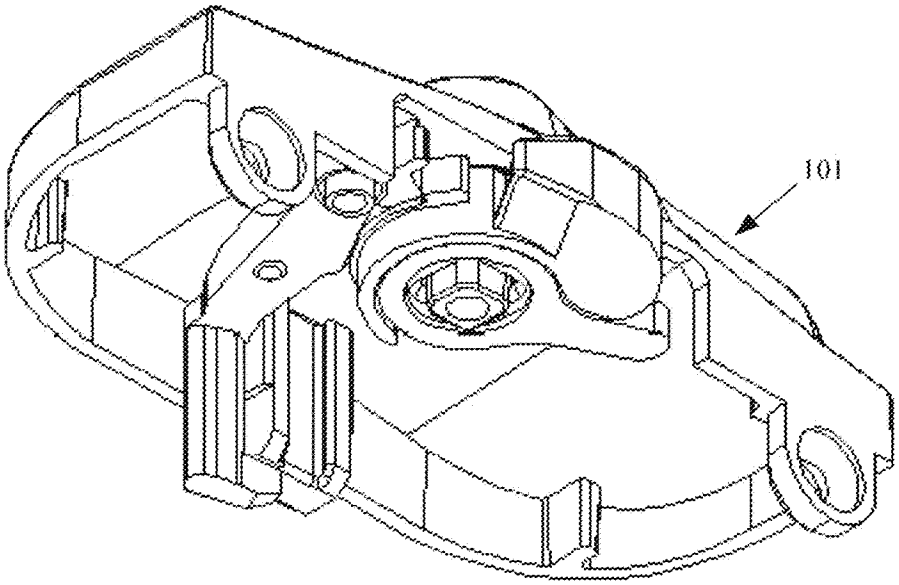
FIG. 69 is a third perspective view of the sash lock assembly as shown in FIG. 61.
Figure 70:
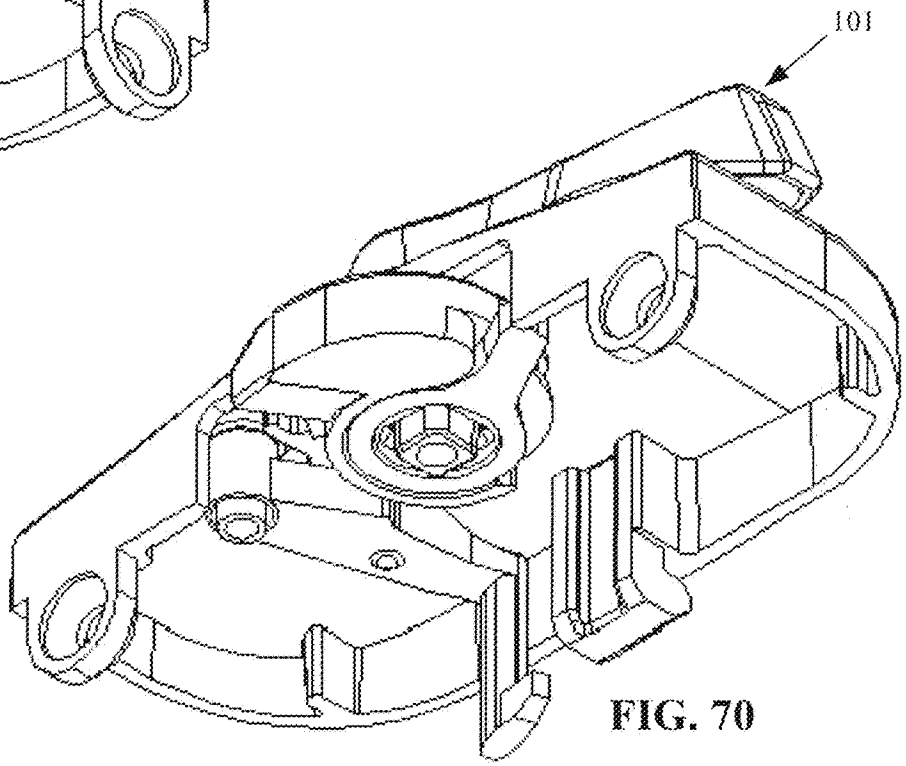
FIG. 70 is a fourth perspective view of the sash lock assembly as shown in FIG. 61.
Figure 71A:
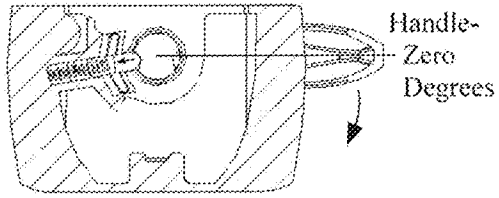
FIG. 71A is a cross-sectional view through the sash lock assembly of FIG. 63, taken at a first depth, being shown with the shaft/handle member at zero degrees of rotation, in order for the cam to be in the extended position, and showing the rounded tip of the plate member contacting a rounded recess in the shaft/handle member.
Figure 127:
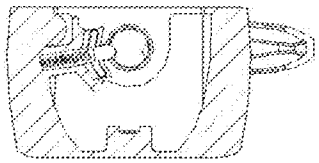

FIG. 127 is the cross-sectional view of FIG. 71A, taken through the sash lock assembly of FIG. 65 at a first depth, being shown with the shaft/handle member at zero degrees of rotation, for the cam to be in the extended position, and showing the rounded tip of the plate member contacting a rounded recess in the shaft/handle member.

Figure 71B:
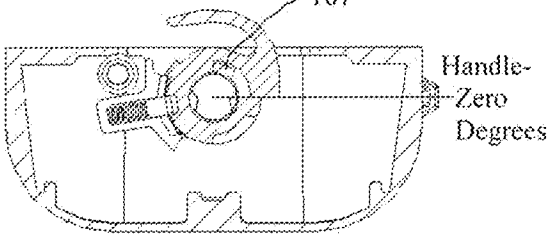
FIG. 71B is a cross-sectional view through the sash lock assembly of FIG. 63, taken at a second depth, being shown with the shaft/handle member at zero degrees of rotation, for the cam to be in the extended position, and showing the plate member engaged with the cam to prevent forced rotation of the cam without rotation of the shaft/handle member, and further showing a protrusion of the driving plate positioned at a first end of an annular recess in the cam, not yet in position to drive the cam.
Figure 128:
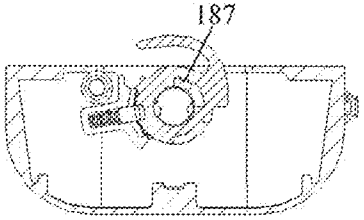

FIG. 128 is the cross-sectional view of FIG. 71B, taken through the sash lock assembly of FIG. 65 at a second depth, being shown with the shaft/handle member at zero degrees of rotation, for the cam to be in the extended position, and showing a protrusion of the plate member engaged with the cam to prevent forced rotation of the cam without rotation of the shaft/handle member, and further showing a protrusion of the driving plate positioned at a first end of an annular recess in the cam.

Figure 71C:
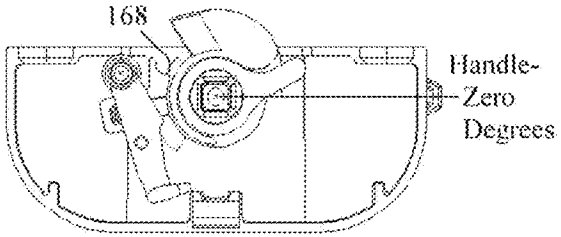
FIG. 71C is a bottom view of the sash lock assembly of FIG. 63, shown with the shaft/handle member at zero degrees of rotation, for the cam to be in the extended position, and showing the overall positioning of the driving plate, when the protrusion of the driving plate is positioned at a first end of the annular recess in the cam, as seen in FIG. 71B.
Figure 129:
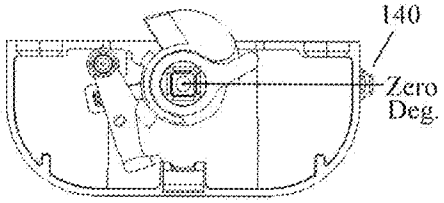

FIG. 129 is the bottom view of the sash lock of FIG. 71C, shown with the shaft/handle member at zero degrees of rotation, for the cam to be in the extended position.

Figure 114:
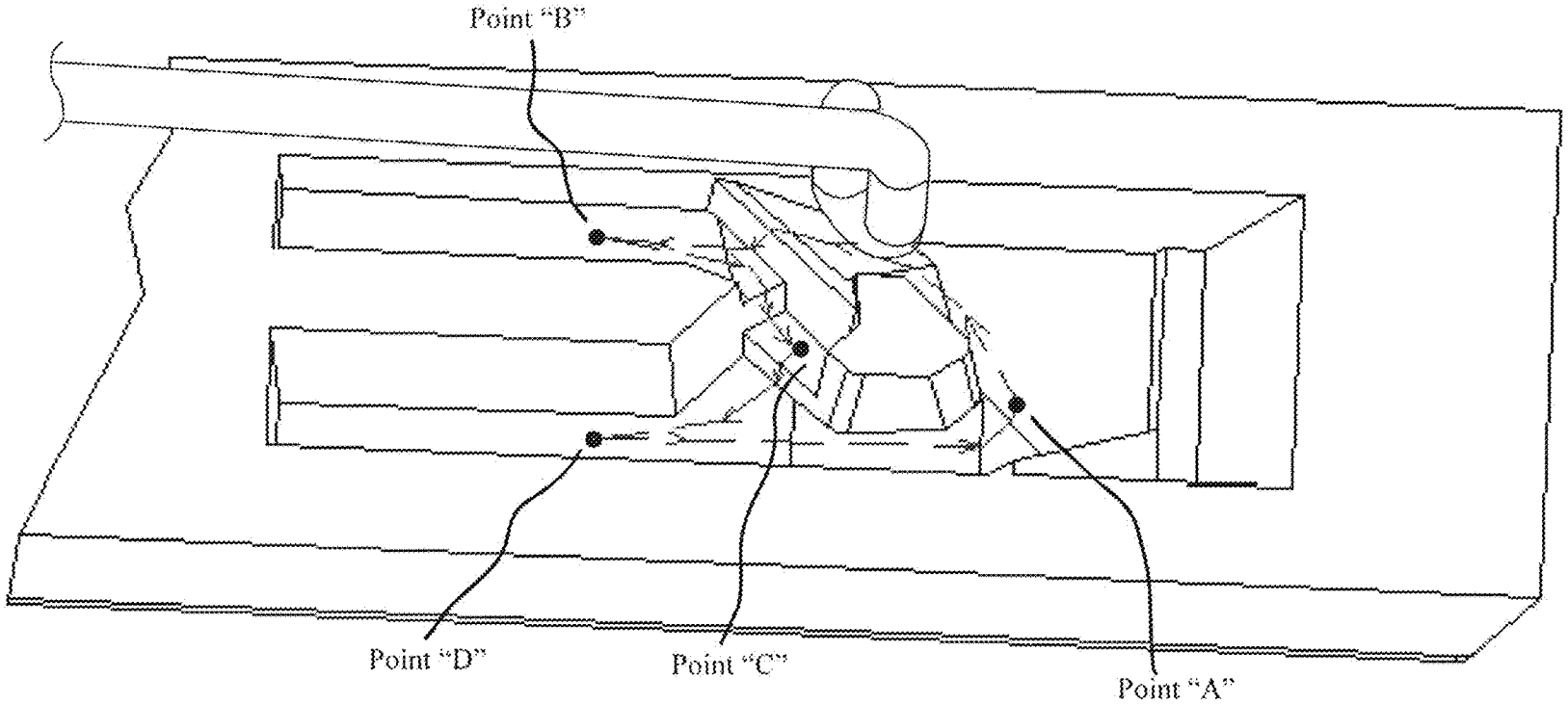
FIG. 114 shows the tip portion of the flexible follower member of FIG. 95 engaged with a portion of the contoured track of the latch housing shown in FIG. 79A, and which identifies several key points on the track.
Figure 114F:
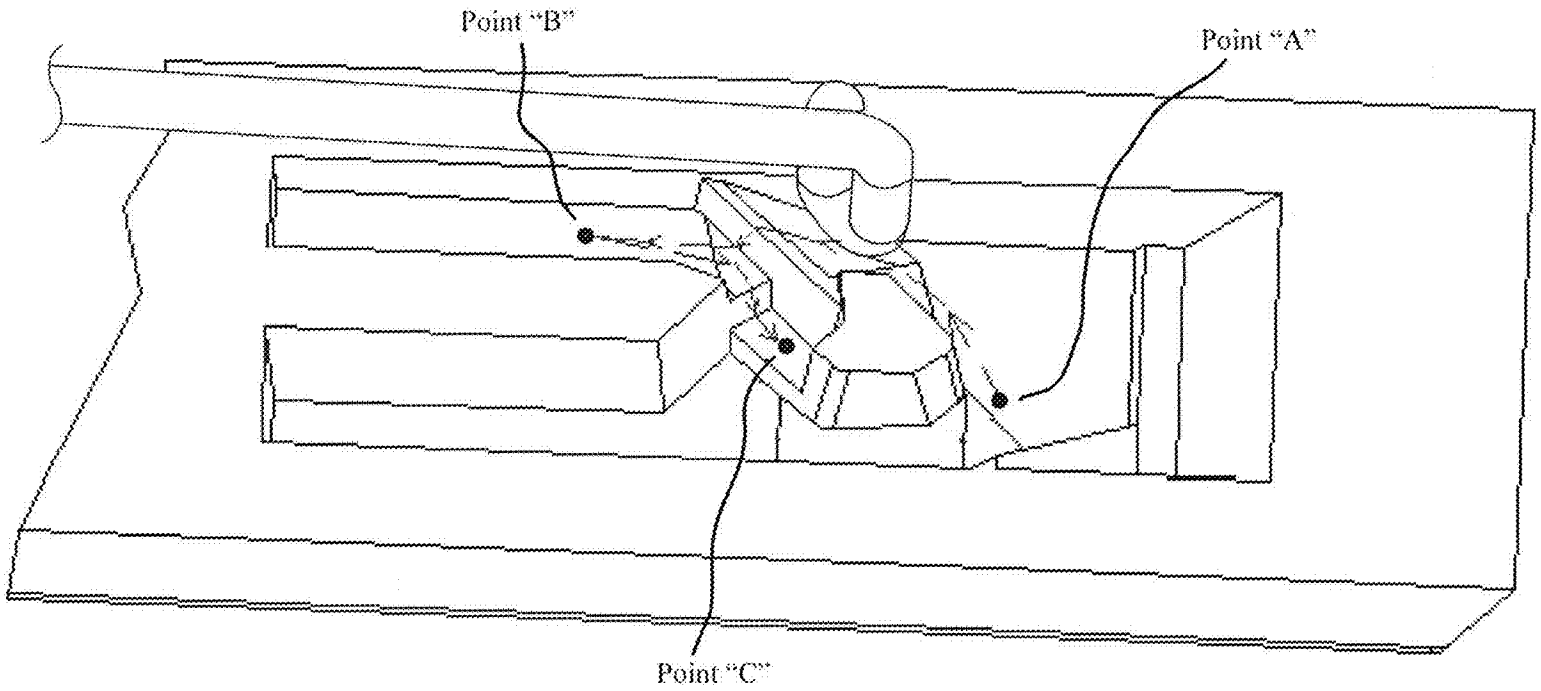
Figure 130:
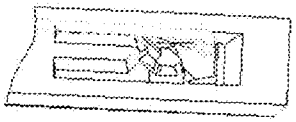

FIG. 130 shows the contoured track of the latch housing portion shown in FIG. 114F, with the flexible follower member positioned at point A, which corresponds to the position of the latch member shown in FIG. 125.

Figure 131:
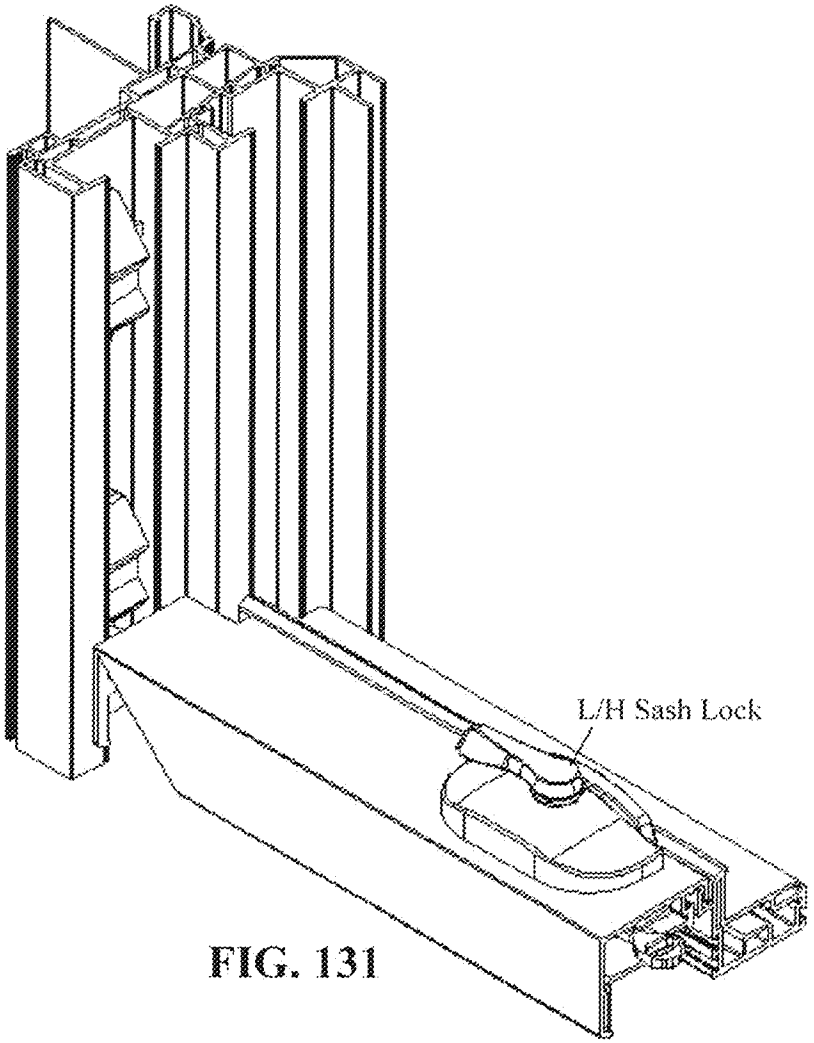

FIG. 131 is a perspective view of the sash window, the corresponding master window frame, the sash lock assembly, the tilt latch assembly, and the stepped stop, as shown in FIG. 125, on the left-hand side of the window.

Figure 132:
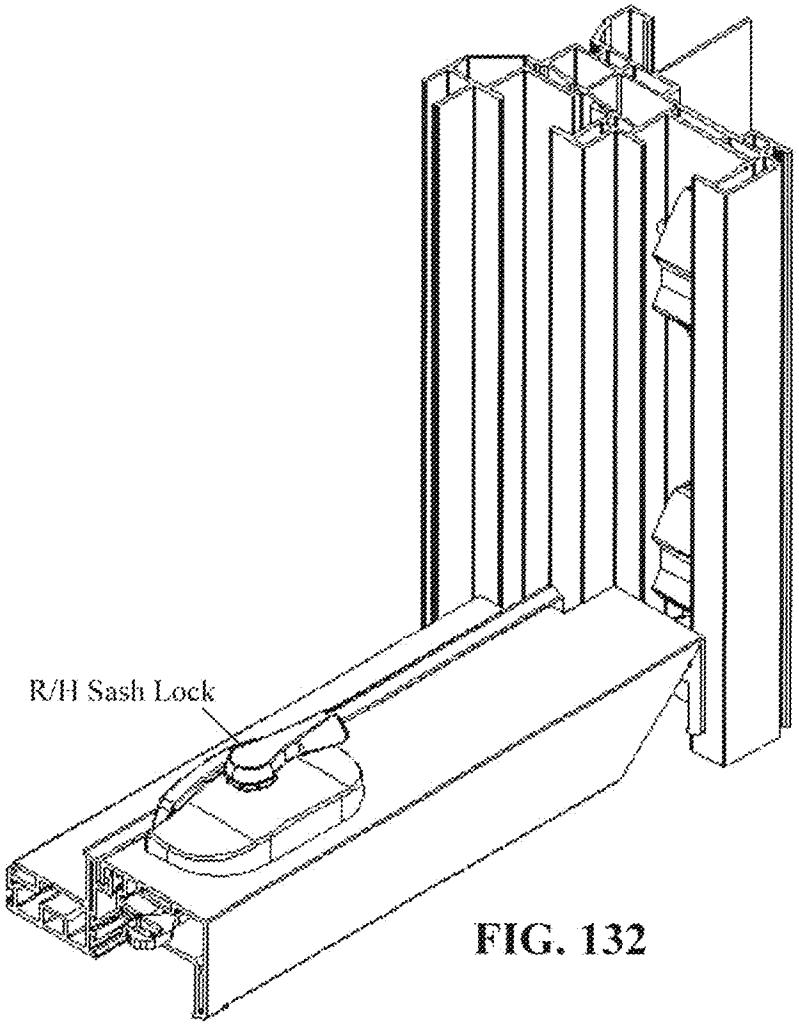

FIG. 132 illustrates a right-hand version of the arrangement shown in FIG. 131.

Figure 133:
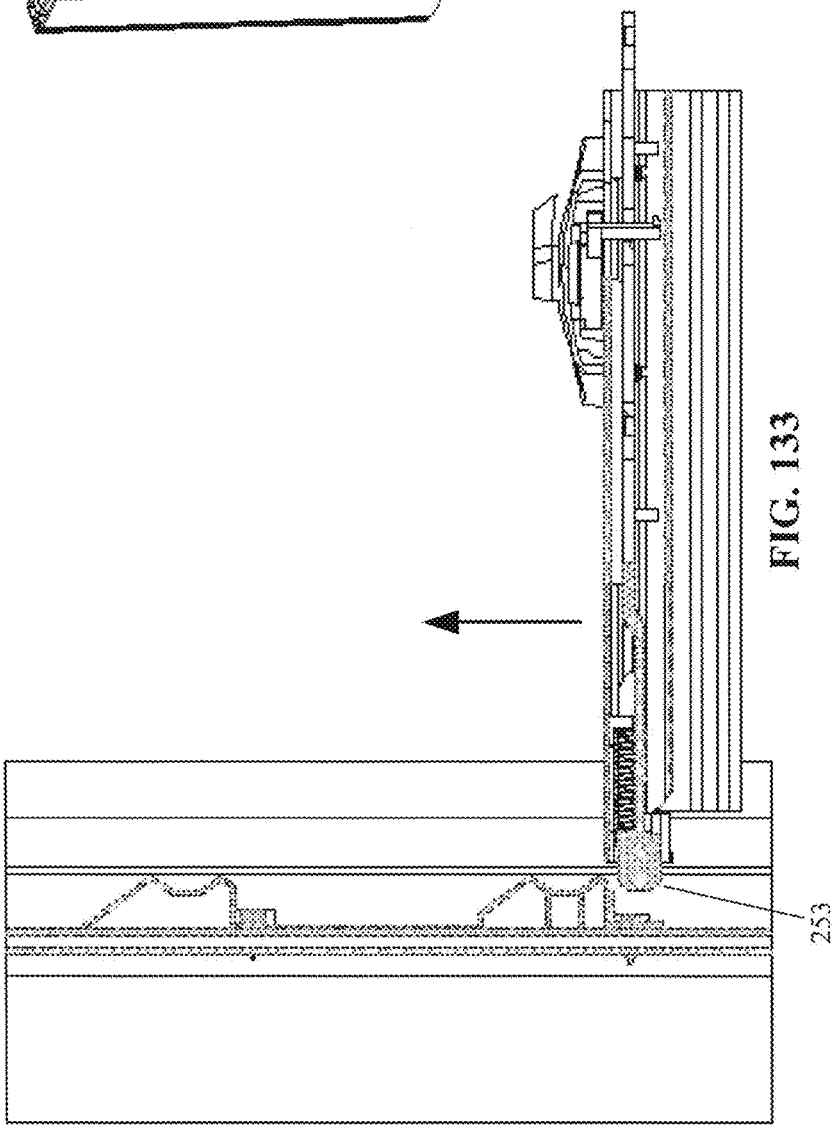

FIG. 133 is the cross-sectional view of FIG. 125, but is shown with the shaft/handle member having been rotated to be at 150 degrees of rotation, for the cam to have been driven by the protrusion of the driving plate to be disengaged from the keeper and be retracted into the sash lock housing, and for the latch member of the latch assembly to be moved into a cocked position.

Figure 134:
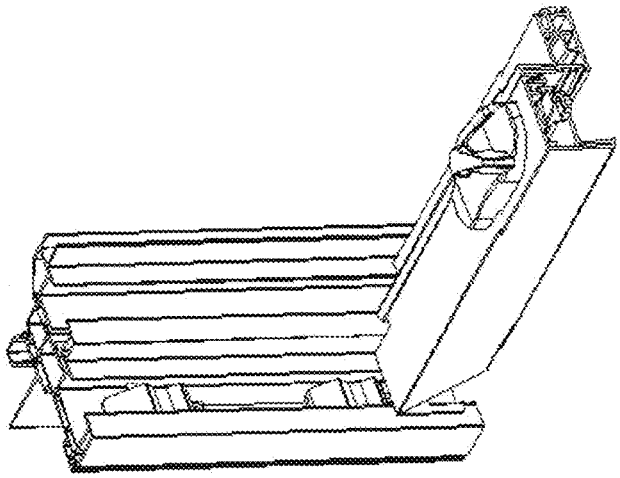

FIG. 134 is the perspective view of the sash window, the corresponding master window frame, the sash lock assembly, the tilt latch assembly, and the stepped stop, as shown in FIG. 133.

Figure 135:
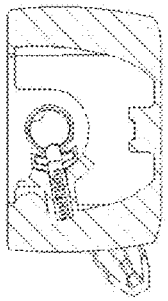

FIG. 135 is the cross-sectional view of FIG. 127, but is shown with the shaft/handle member rotated to be at the 150 degrees of rotation shown in FIG. 133, for the cam to be retracted into the sash lock housing, and for the rounded tip of the plate member to be received within a second rounded recess in the shaft/handle member.

Figure 136:
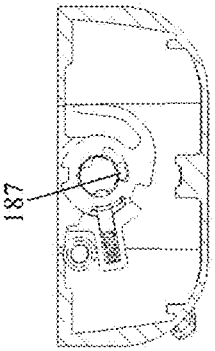

FIG. 136 is the cross-sectional, view of FIG. 128, but is shown with the shaft/handle member rotated to be at the 150 degrees of rotation shown in FIG. 133, for the cam to be retracted into the sash lock housing, and for the protrusion, of the plate member to be received within a larger, second recessed portion of the cam.

Figure 137:
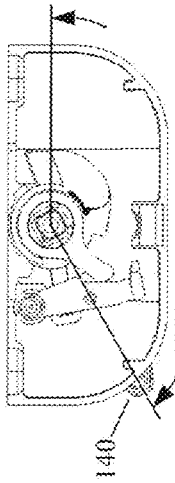

FIG. 137 is the bottom view of FIG. 129, but is shown with the shaft/handle member rotated to be at the 150 degrees of rotation shown in FIG. 133, for the cam to be retracted into the sash lock housing, and for an end of the driving plate to contact and drive the lever member to rotate a small amount, to drive the latch member into the cocked position.

Figure 138:
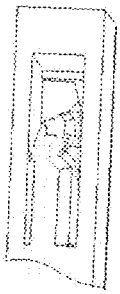

FIG. 138 shows the contoured track of the latch housing portion shown in FIG. 130, but with the flexible follower member positioned at point C, which corresponds to the cocked position of the latch member shown in FIG. 133.

Figure 139:
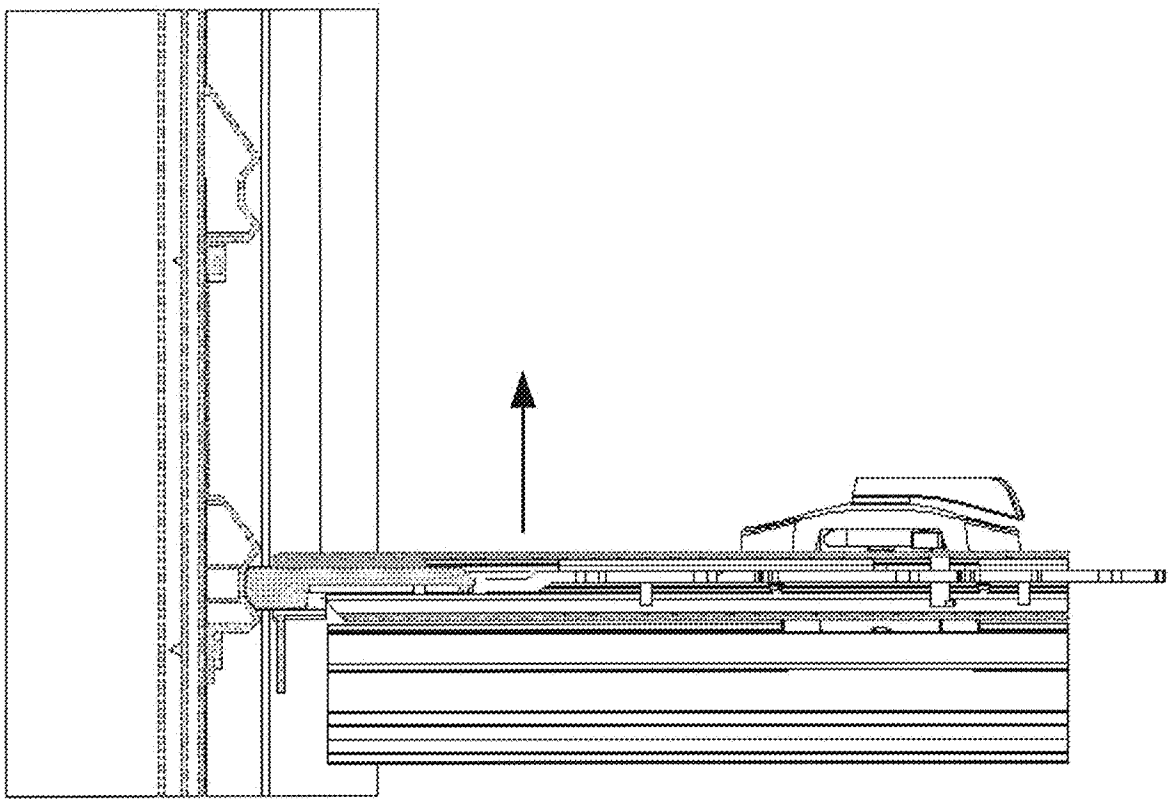

FIG. 139 is the cross-sectional view of FIG. 135, but shows the tongue of the latch member in contact with a central portion of the lower protrusion of the stepped stop member, as the window is being elevated (opened).

Figure 140:
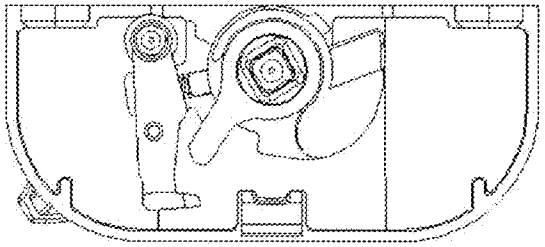

FIG. 140 is the bottom view of FIG. 137, but is shown with the lever arm rotated away from contact with the driving plate, as a result of the lever arm's interconnection with the latch member and the latch member being driven to retract because of its motion over the surfaces of the lower protrusion of the stop member.

Figure 141:
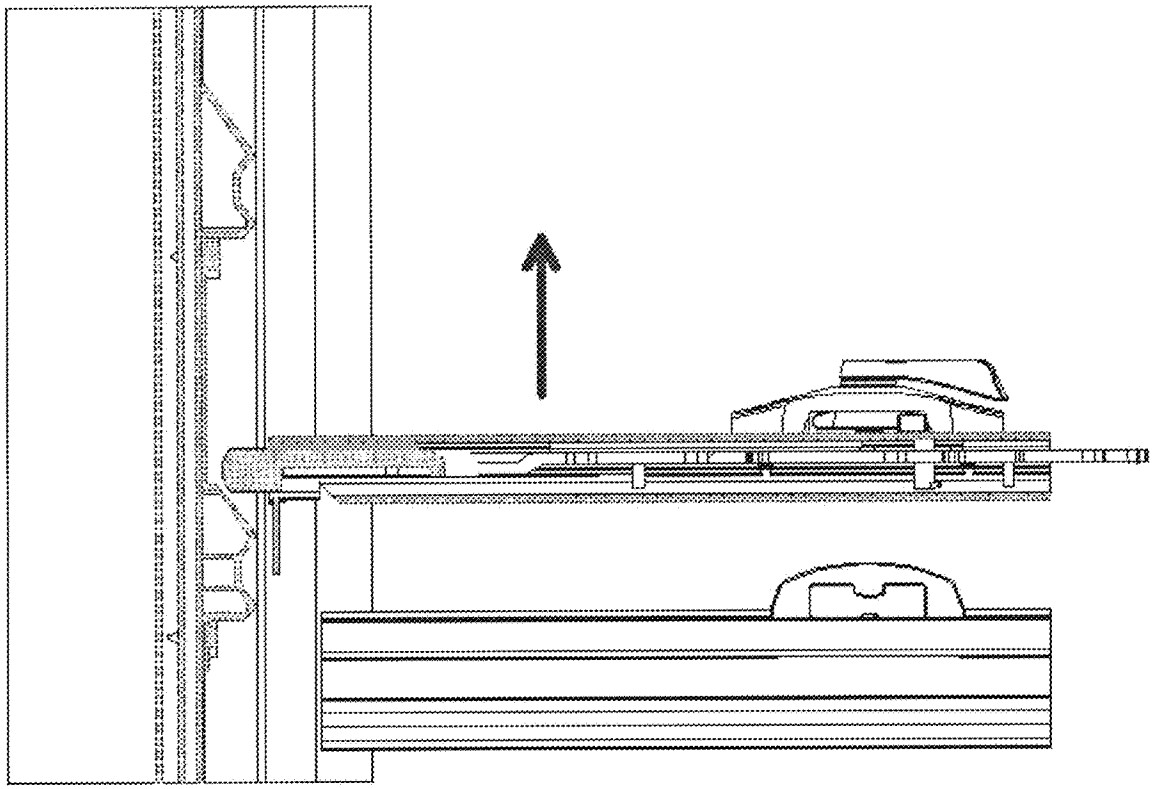

FIG. 141 is the cross-sectional view of FIG. 139, but is shown after the latch member has moved clear of the lower protrusion of the stop member, and has been biased back into its fully extended position, and with the interconnection of the latch member with the lever arm having caused the lever arm to drive the driving plate to counter-rotate the shaft/handle member to be back at 120 degrees of rotation.

Figure 142:
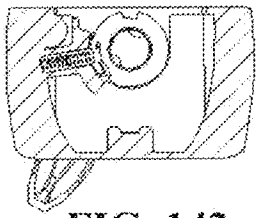

FIG. 142 is the cross-sectional view of FIG. 135, but is shown with the shaft/handle member having counter-rotated to be at the 120 degrees of rotation shown in FIG. 141, and with the protrusion of the plate member still received within the larger, second recessed portion of the cam.

Figure 143:
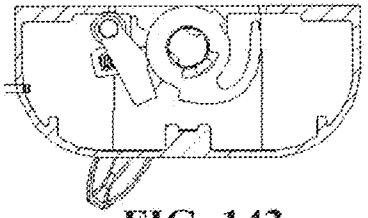

FIG. 143 is the cross-sectional view of FIG. 136, but is shown with the shaft/handle member having counter-rotated to be at the 120 degrees of rotation shown in FIG. 141.

Figure 144:
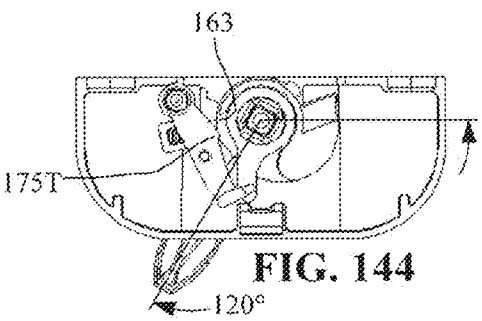

FIG. 144 is the bottom view of FIG. 140, but is shown with the shaft/handle member having counter-rotated to be at the 120 degrees of rotation shown in FIG. 141, with the lever arm again in contact with the driving plate.

Figure 145:
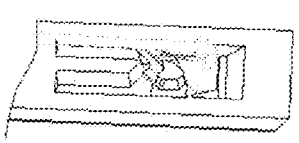

FIG. 145 shows the contoured track of the latch housing portion shown in FIG. 138, but with the flexible follower member again positioned at point A, which corresponds to the fully extended position of the latch member shown in FIG. 141.

Figure 146:
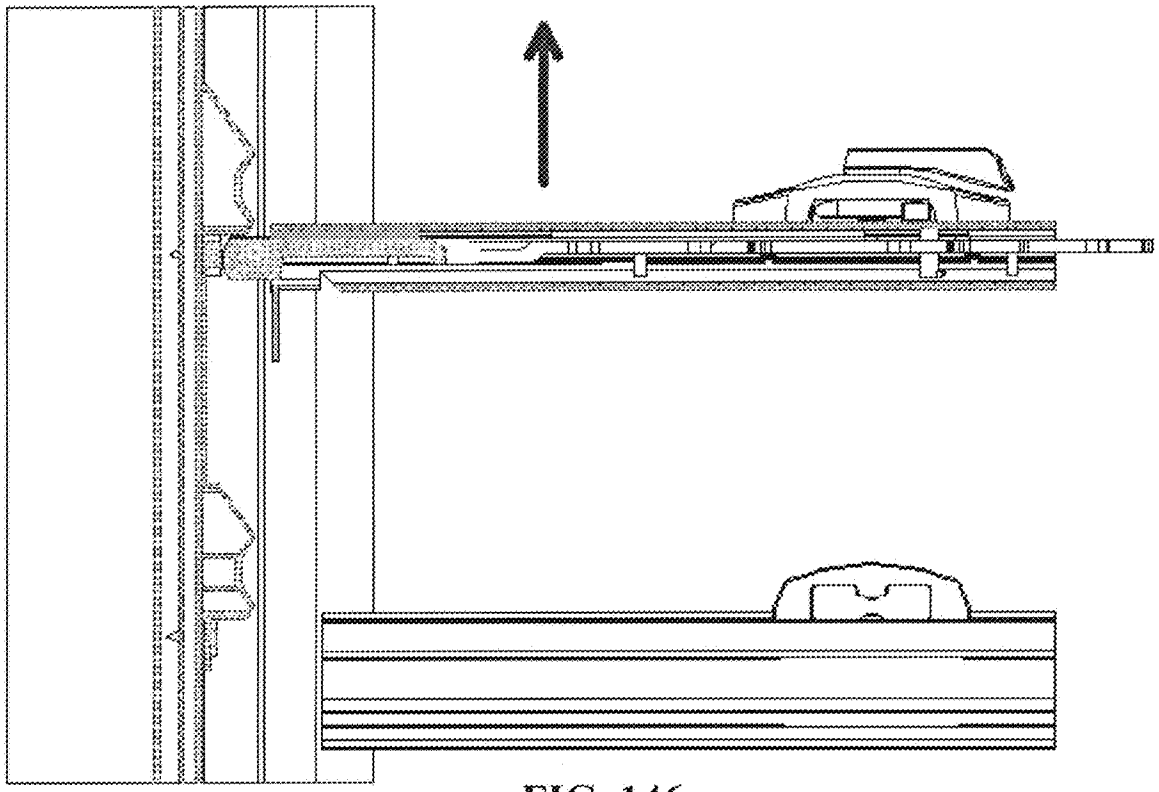

FIG. 146 is the cross-sectional view of FIG. 141, but is shown with further upward opening of the sash window being limited by contact of the top of the tongue of the latch member with the bottom surface of the second protrusion of the stepped stop member.

Figure 147:
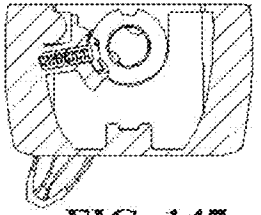

FIG. 147 is the same as FIG. 142.

Figure 148:
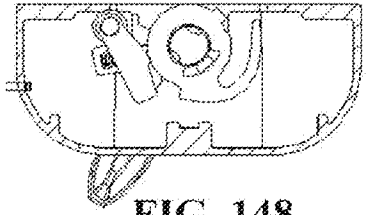

FIG. 148 is the same as FIG. 143.

Figure 149:
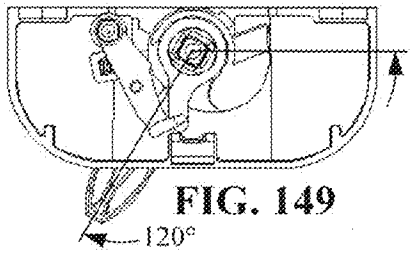

FIG. 149 is the same as FIG. 144.

Figure 150:
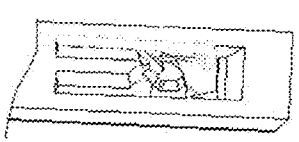

FIG. 150 is the same as FIG. 145.

Figure 151:
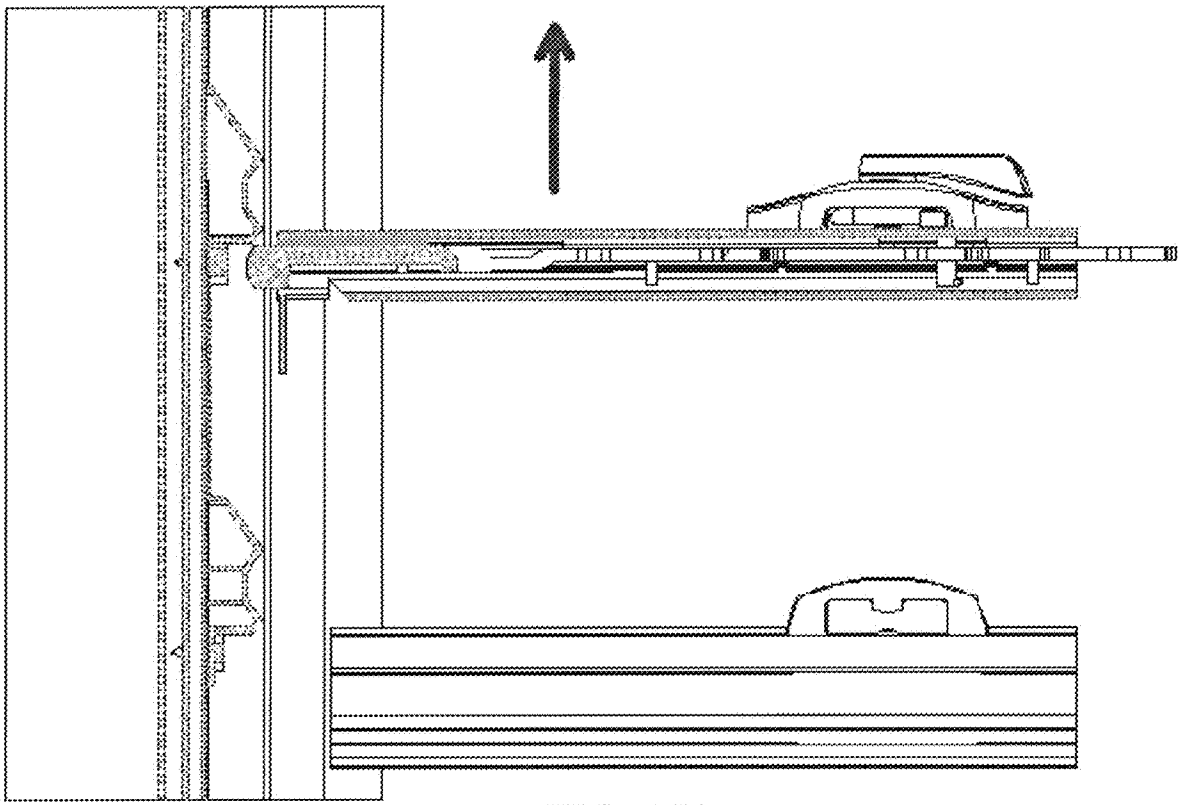

FIG. 151 is the cross-sectional view of FIG. 146, being shown with the shaft/handle member having been rotated to again be at 150 degrees of rotation, for the latch member of the latch assembly to be moved into the cocked position, the same as for FIG. 133, but being cocked with respect to the upper protrusion of the stop member.

Figure 152:
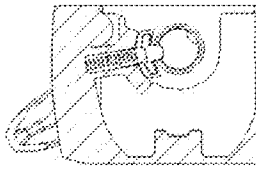

FIG. 152 is the same as FIG. 135.

Figure 153:
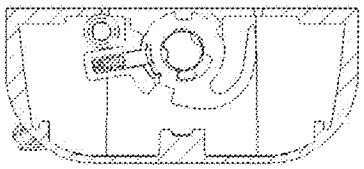

FIG. 153 is the same as FIG. 136.

Figure 154:
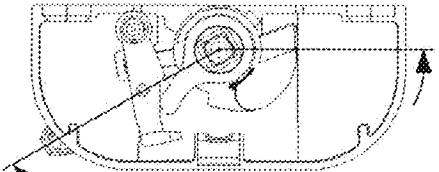

FIG. 154 is the same as FIG. 137.

Figure 155:
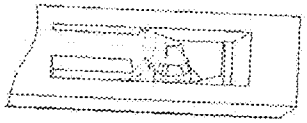

FIG. 155 is the same as FIG. 138.

Figure 156:
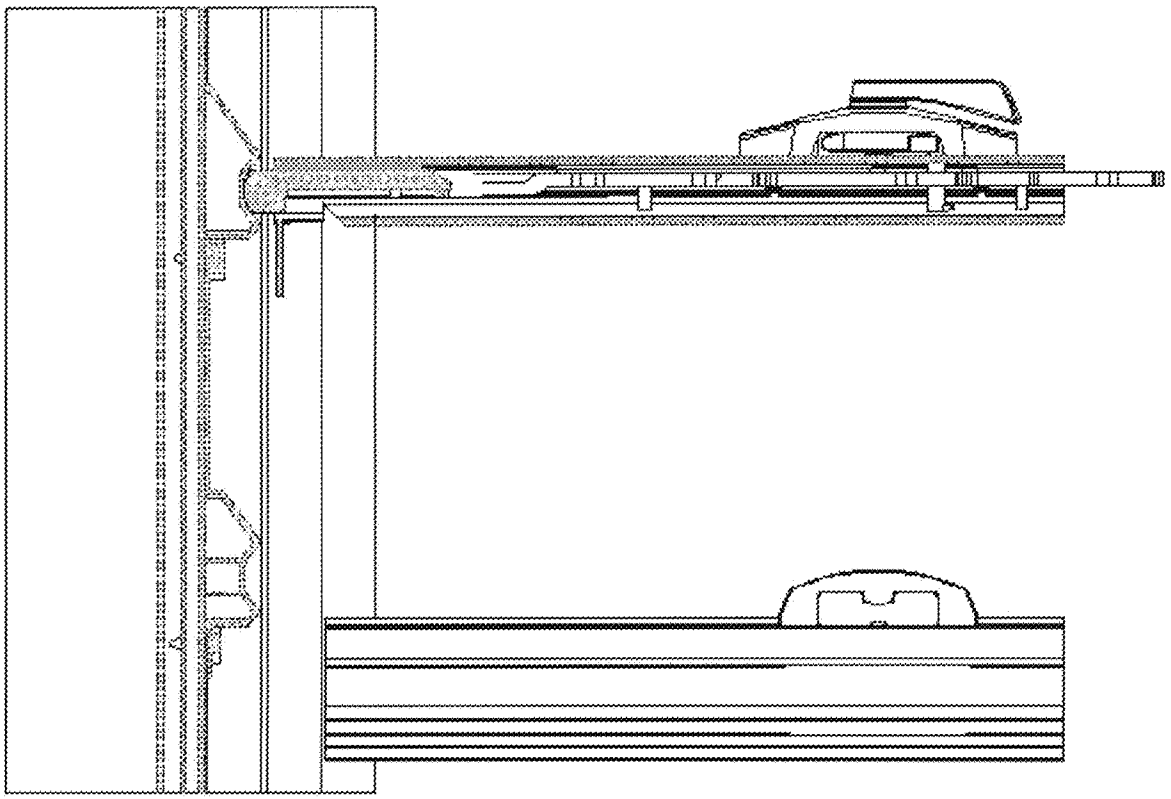

FIG. 156 is the cross-sectional view of FIG. 151, but is shown after the window is elevated beyond the limited open window position, being similar to FIG. 139, but showing the tongue of the latch member in contact with a central portion of the upper protrusion of the stop member.

Figure 157:
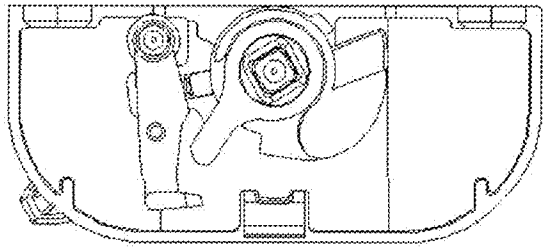

FIG. 157 is the same as FIG. 140.

Figure 158:
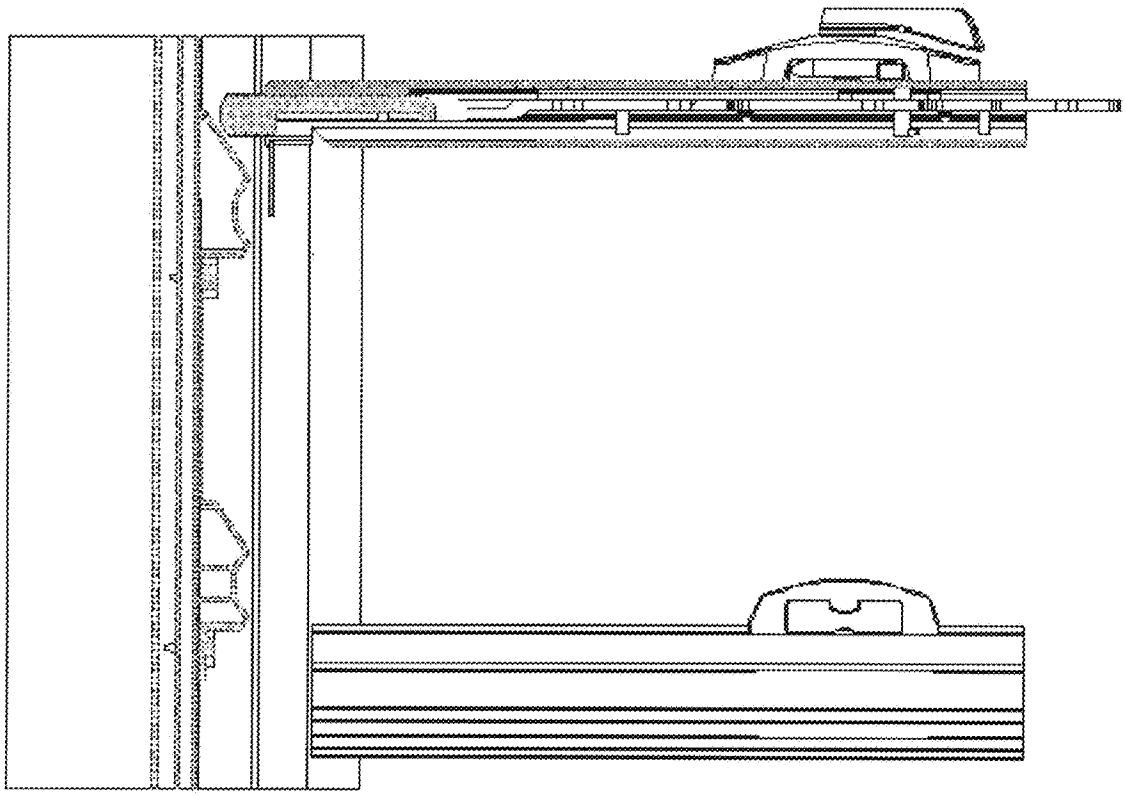

FIG. 158 is the cross-sectional view of FIG. 156, but is shown after the latch member has moved clear of the upper protrusion of the stop member, and has been biased back into its fully extended position, similar to its action with respect to the lower stop member shown in FIG. 141, and is also shown with the interconnection of the latch member with the lever arm having caused the lever arm to drive the driving plate to counter-rotate the shaft/handle member to be back at 120 degrees of rotation.

Figure 159:
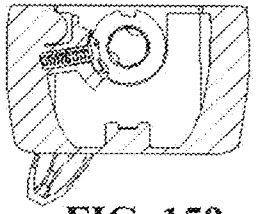

FIG. 159 is the same as FIG. 142.

Figure 160:
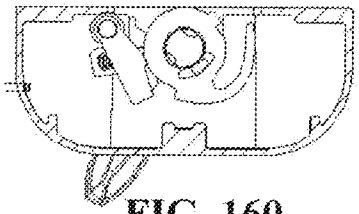

FIG. 160 is the same as FIG. 143.

Figure 161:
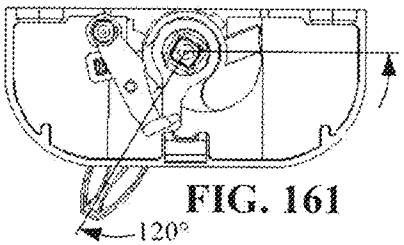

FIG. 161 is the same as FIG. 144.

Figure 162:
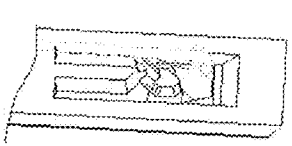

FIG. 162 is the same as FIG. 145.

Figure 163:
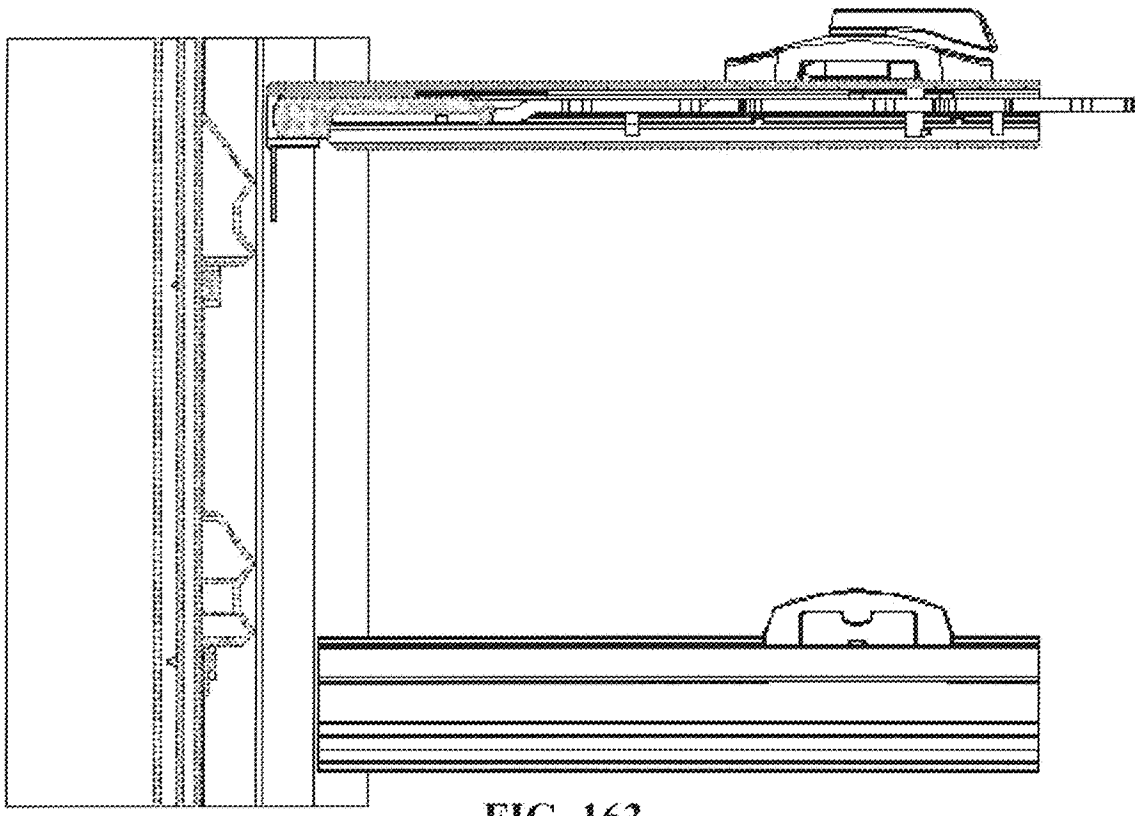

FIG. 163 is the cross-sectional view of FIG. 158, being shown with the shaft/handle member having been rotated to be at 180 degrees of rotation, for the latch member of the latch assembly to be retraced into the latch housing sufficiently to be clear of the master window frame, to permit tilting of the sash window with respect to the master window frame.

Figure 164:
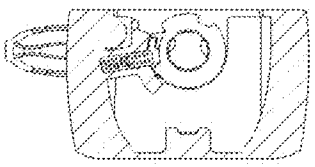

FIG. 164 is the cross-sectional view of FIG. 159, but is shown with the shaft/handle member rotated to be at the 180 degrees of rotation shown in FIG. 163.

Figure 165:
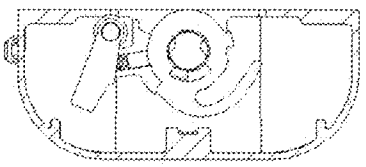

FIG. 165 is the cross-sectional view of FIG. 160, but is shown with the shaft/handle member rotated to be at the 180 degrees of rotation shown in FIG. 163.

Figure 166:
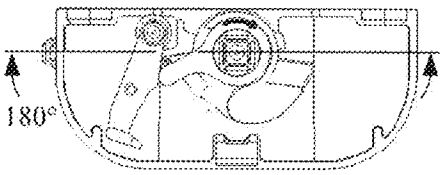

FIG. 166 is the bottom view of FIG. 161, but is shown with the shaft/handle member rotated to be at the 180 degrees of rotation shown in FIG. 163, and showing the driving plate having driven the lever arm to cause the retraction of the latch member of the latch assembly.

Figure 167:
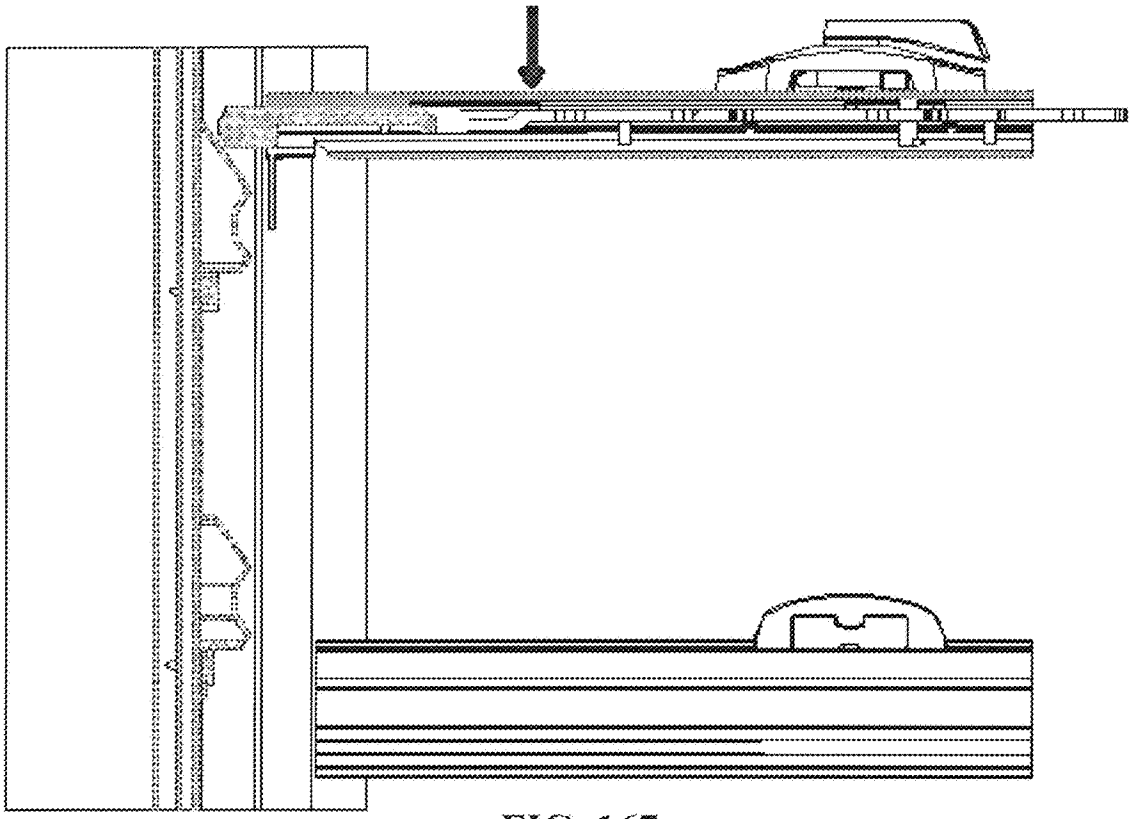

FIG. 167 is the section view of FIG. 163, but is shown after the shaft/handle member has been released, for the latch member to be biased back into the fully extended position also shown FIG. 158, and also shows a downward pointing arrow to indicate initial closing of the sash window.

Figure 168:
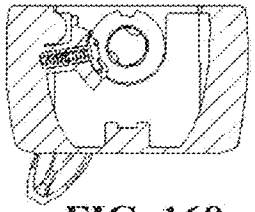

FIG. 168 is the same as FIG. 159.

Figure 169:
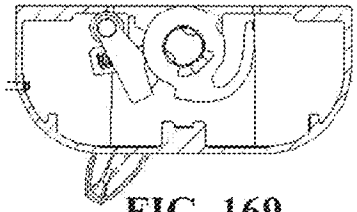

FIG. 169 is the same as FIG. 160.

Figure 170:
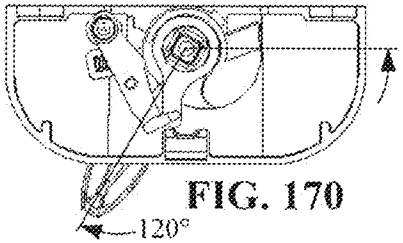

FIG. 170 is the same as FIG. 161.

Figure 171:
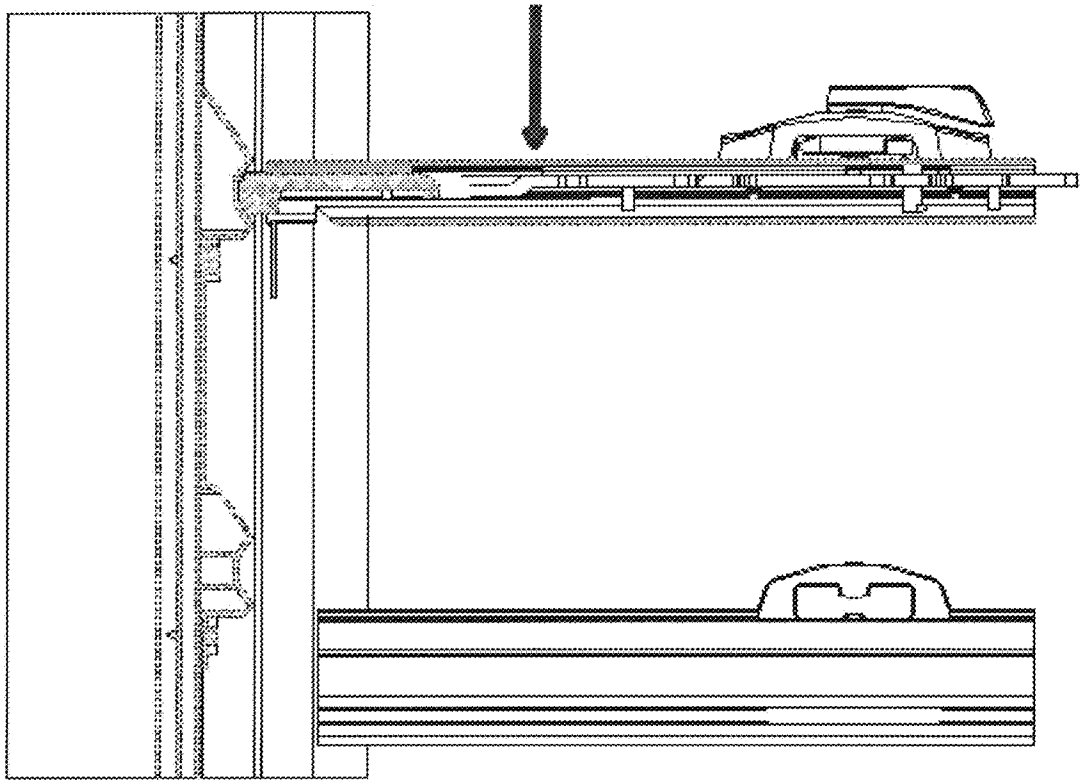

FIG. 171 is the cross-sectional view of FIG. 167, but is shown after the window has been lowered for the tongue of the latch member to be driven to retract due to contact with the upper protrusion of the stop member, being shown in contact with a central portion of the upper protrusion, similar to the contact shown with the lower protrusion in FIG. 156.

Figure 172:
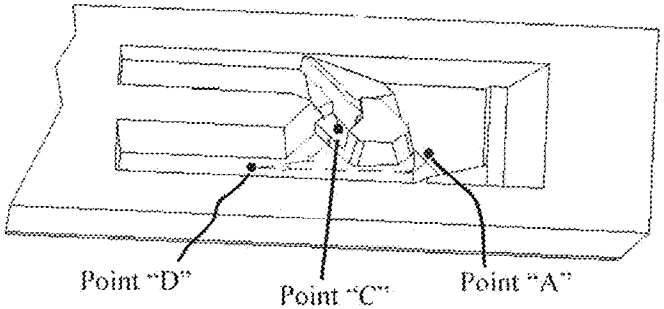

FIG. 172 shows the contoured track of the latch housing portion shown in FIG. 162, but with the flexible follower member again positioned at point C, which corresponds to the latch member position shown in FIG. 171.

Figure 173:
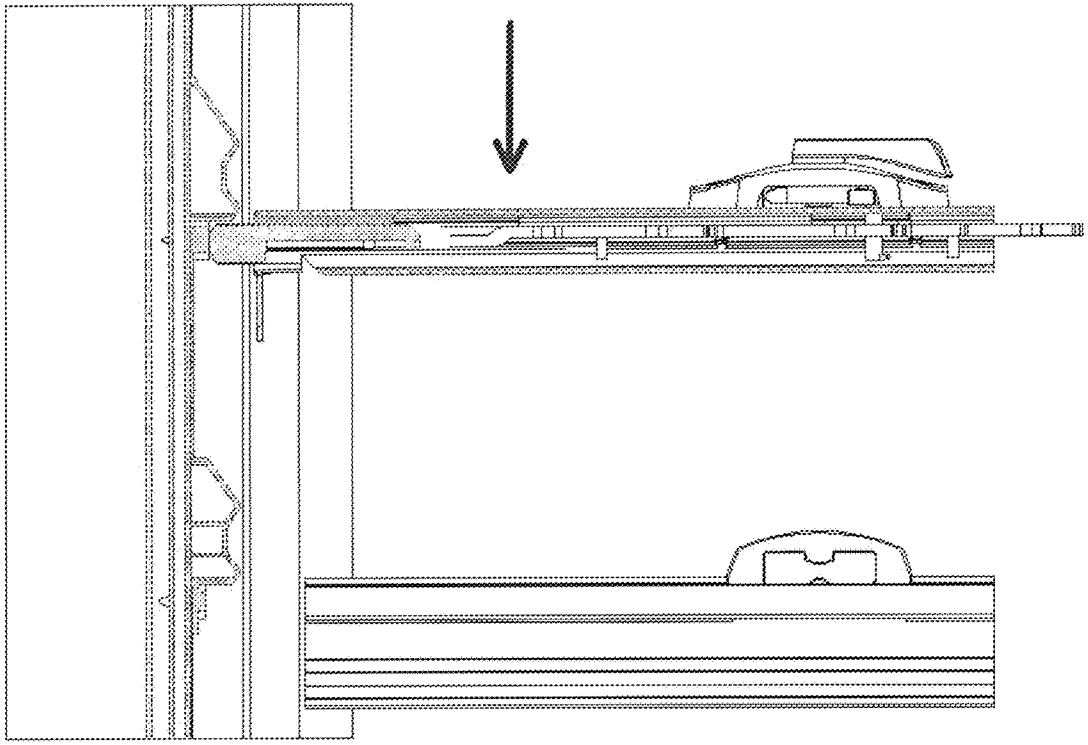
Figure 174:
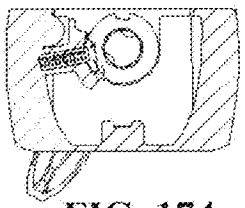

FIG. 173 is the cross-sectional view of FIG. 171, but is shown after the window has been lowered even further, for the tongue of the latch member of the latch assembly to have moved below the bottom surface of the upper protrusion of the stop member, to again be biased back into the fully extended position, and to again limit upward opening of the sash window, and where the interconnection of the latch member with the lever arm has caused the lever arm to drive the driving plate to counter-rotate the shaft/handle member to be back at 120 degrees of rotation FIG. 174 is the same as FIG. 168.

Figure 175:
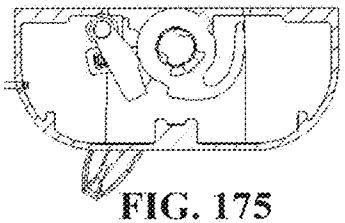

FIG. 175 is the same as FIG. 169.

Figure 176:
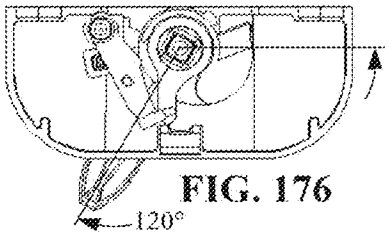

FIG. 176 is the same as FIG. 170.

Figure 177:
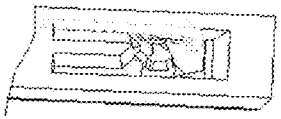

FIG. 177 is the same as FIG. 162, showing the contoured track of the latch housing with the flexible follower member again positioned at point A, which corresponds to the fully extended position of the latch member shown in FIG. 173.

Figure 178:
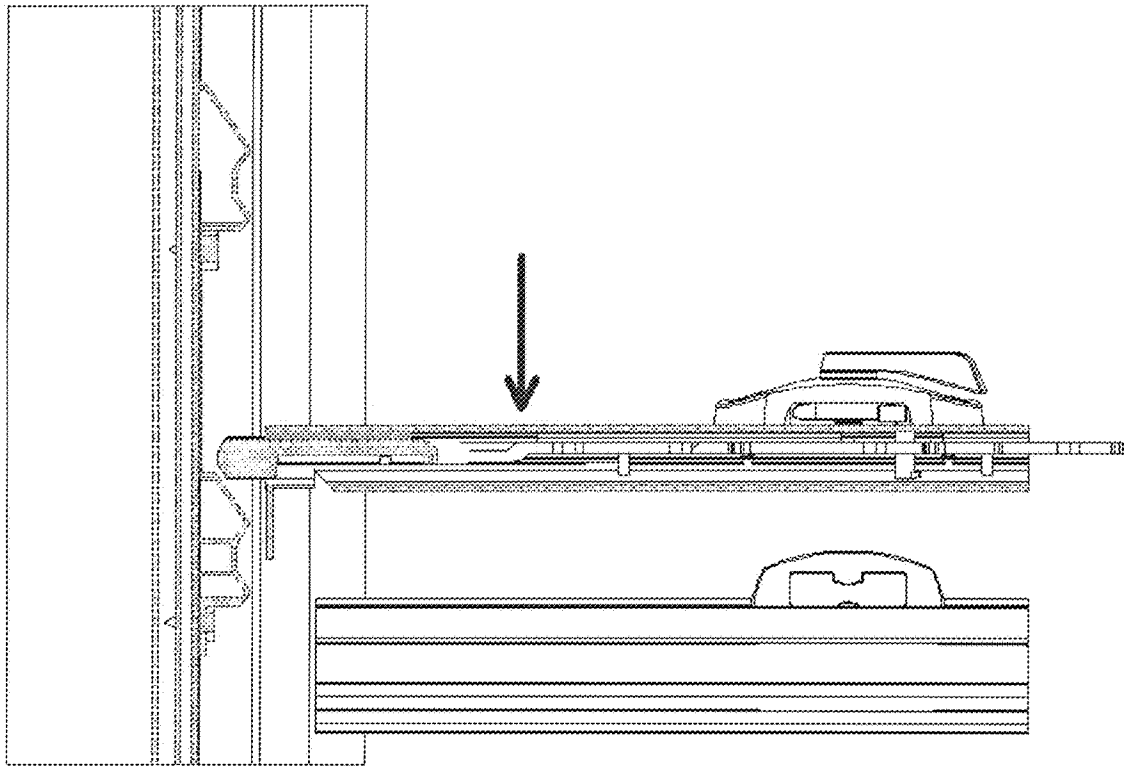

FIG. 178 is the cross-sectional view of FIG. 173, but is shown alter the window has been lowered even further, being just prior to contact of the bottom of the tongue of the latch member with the top surface of the lower protrusion of the stop member.

Figure 179:
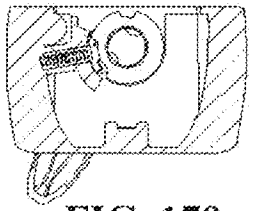

FIG. 179 is the same as FIG. 174.

Figure 180:
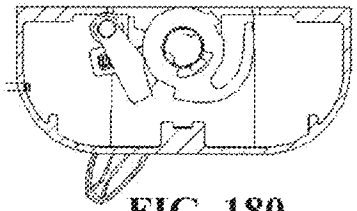

FIG. 180 is the same as FIG. 175.

Figure 181:
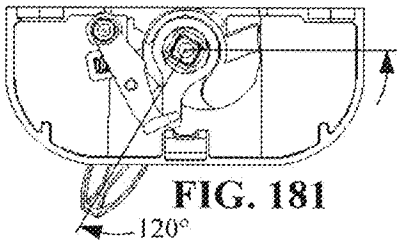

FIG. 181 is the same as FIG. 176.

Figure 182:
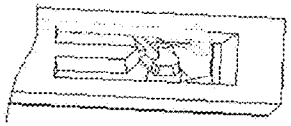

FIG. 182 is the same as FIG. 177.

Figure 183:
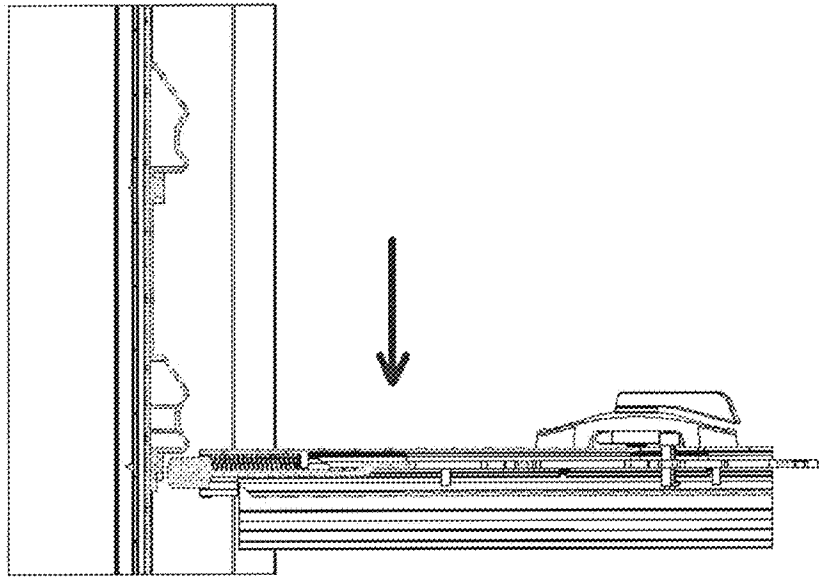

FIG. 183 is the cross-sectional view of FIG. 178, but is shown after its downward movement has closed the sash window and positioned the tongue of the latch member below the lower protrusion of the stop member, where it is again biased to be fully extended, to automatically lock the window with respect to the stop member, but where the shaft/handle member remains at 120 degrees of rotation, with the cam still retracted within the sash lock housing.

Figure 184:
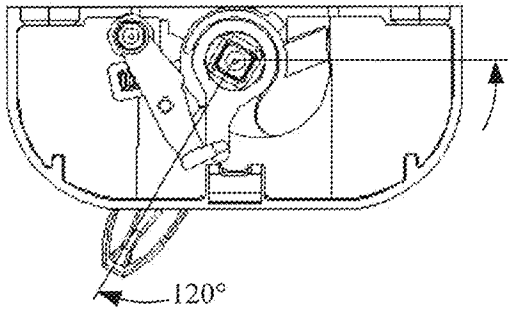

FIG. 184 is the same as FIG. 181.

Figure 185:
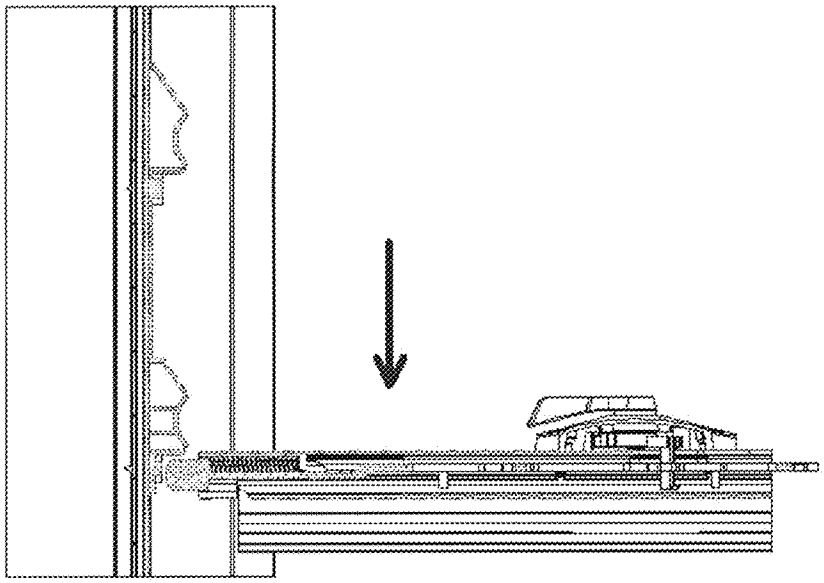

FIG. 185 is the cross-sectional view of FIG. 183, but is shown after the shaft/handle member has been rotated back to the zero degree position, to lock the cam with respect to the keep, to redundantly lock the sash window in the closed window position.

Figure 186:
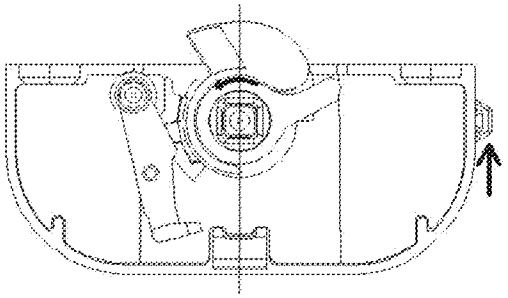

FIG. 186 is the same as FIG. 184, but showing the shaft/handle member rotated to be at the zero degrees of rotation, shown in FIG. 185, with the cam in the extended lock position.

Figures 187A, 187B, 187C, 188A, 188B, 188C, 189A, 189B, 189C, 190A, 190B, 190C, 191A, 191B, 191C, 192A, 192B, 192C, 193A, 193B, 193C, 194A, 194B, 194C:
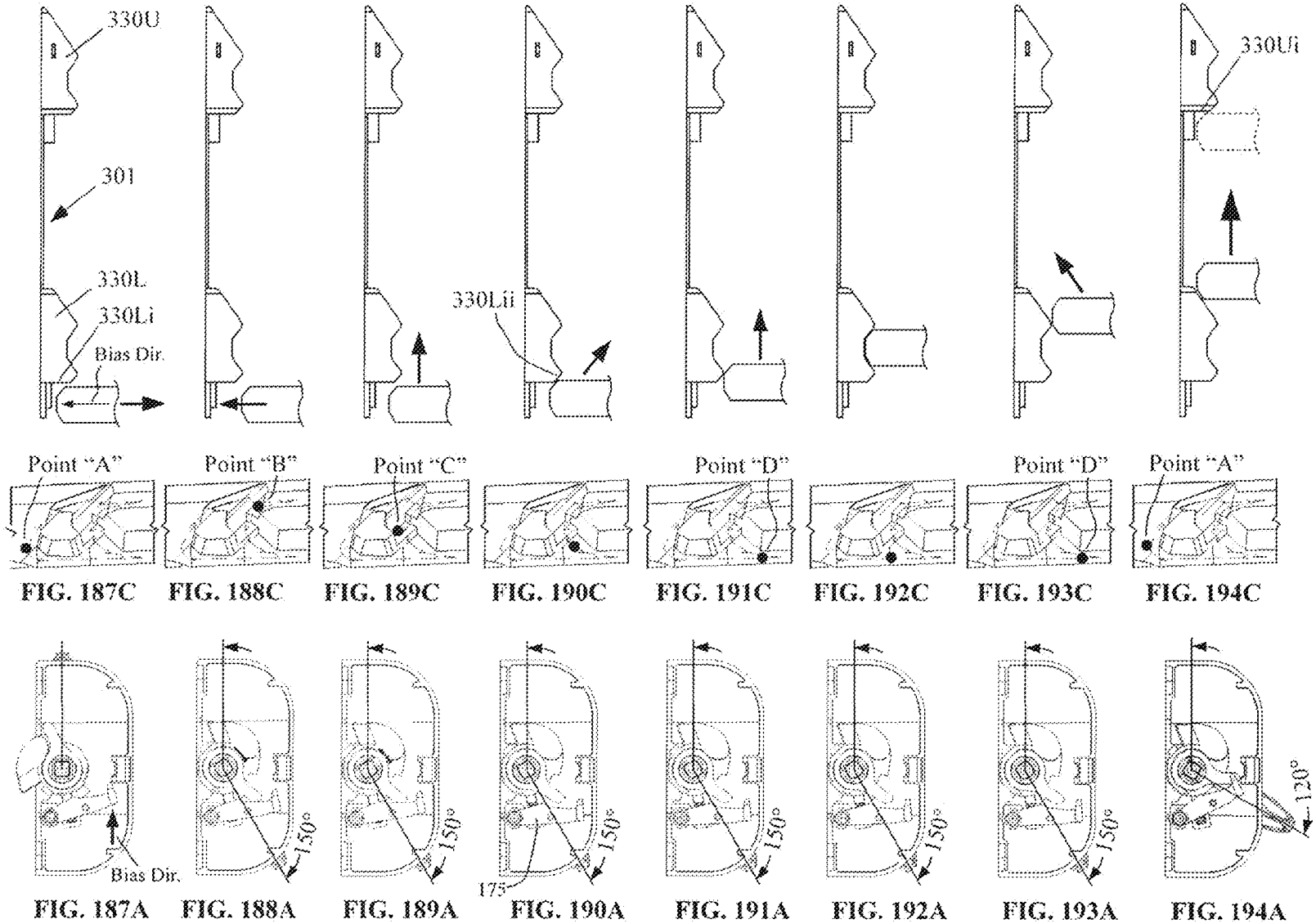

FIG. 187A is the bottom view of the sash lock assembly, as shown in FIG. 71C, and which shows the cam and the shaft/handle member in the zero degree (locked) position, and the lever arm biased into its rest, position by the latch member of the latch assembly.

FIG. 187B is a side view showing the tongue portion of the latch member of the latch assembly in the extended position that corresponds to the shaft/handle member position of FIG. 187A, with the tongue portion located below the bottom stop surface of the lower protrusion of the stepped stop member, to redundantly lock the sash window when in the closed window position of FIG. 125.

FIG. 187C shows contact of the tip of the flexible follower member with the contoured track of the latch housing, which contact position corresponds to the latch member position of FIG. 187B.

FIG. 188A is the bottom view of FIG. 187A, but is shown with the shaft/handle member having been rotated roughly 150 degrees, to drive the cam to retract into the sash lock housing, and to drive the lever arm and correspondingly cause the latch member to move toward a retracted position.

FIG. 188B is the side view of FIG. 187B, showing the tongue portion of the latch member of the latch assembly having been retracted part-way towards its fully retracted position, to correspond with the shaft/handle member position of FIG. 188A.

FIG. 188C shows contact of the tip of the flexible follower member of the latch assembly with the contoured track of the latch housing, which contact position corresponds to the latch member position of FIG. 221B.

FIG. 189A is the bottom view of FIG. 188A, showing the shaft/handle member at roughly 150 degrees, of rotation to remain in an unlock position, with the lever arm positioned for the latch member to occupy a cocked (trigger) position.

FIG. 189B is the side view of FIG. 188B, showing the tongue portion of the latch member of the latch, assembly having extended slightly to occupy the cocked (trigger) position, with respect to the lower protrusion of the stop member, which position corresponds with the shaft/handle member position of FIG. 189A, with the upper curved/angled surface of the tongue portion being located adjacent to the angled surface of the lower protrusion of the stepped stop member.

FIG. 189C shows engagement of the tip of the flexible follower member of the latch assembly within a nested portion of the contoured track of the latch housing, which contact position corresponds to the latch member position of FIG. 189B.

FIG. 190A is the bottom view of FIG. 189A, showing the shaft/handle member at roughly 150 degrees of rotation to remain in an unlock position, but showing the lever arm having been rotated slightly away from contact with the driving plate, as a result of movement imparted to the tongue of the latch member through its contact with the angled surface of the lower protrusion of the stepped stop member, as the sash window has begun to be slid open.

FIG. 190B is the side view of FIG. 189B, showing the tongue portion of the latch member of the latch assembly retracting as a result of the upper curved/angled surface of the tongue portion contacting and following the angled/curved surface of the lower protrusion, of the stepped stop member.

FIG. 190C shows contact of the tip of the flexible follower member with the contoured track of the latch housing of the latch assembly, just after being triggered to exit the nested portion of the track, which exit position corresponds to the latch member position of FIG. 190B.

FIG. 191A is the bottom view of FIG. 190A, showing the shaft/handle member at roughly 150 degrees of rotation to remain in an unlock position, but showing the lever arm having been rotated further away from contact with the driving plate, as a result of additional movement imparted, to the tongue of the latch member through its continued contact with the angled stop surface of the lower protrusion of the stepped stop member, as the sash window is opened further.

FIG. 191B is the side view of FIG. 190B, showing the tongue portion of the latch member of the latch assembly having been driven to retract to its furthest-most retracted position as a result of its contact with the most distal location of the angled surface of the lower protrusion of the stepped stop member.

FIG. 191C shows contact of the tip of the flexible follower member of the latch assembly with the contoured track of the latch housing, which contact position corresponds to the latch member position of FIG. 191B.

FIG. 192A is the bottom view of FIG. 191A, showing the shaft/handle member at roughly 150 degrees of rotation to remain in an unlock position, but showing the lever arm having counter-rotated slightly back towards its contact position with the driving plate, as a result the tongue portion of the latch member extending into contact with a recessed surface of the lower protrusion of the stepped stop member, as the sash window continues to be opened further.

FIG. 192B is the side view of FIG. 191B, showing the tongue portion of the latch member of the latch assembly having extended into contact with the recessed surface of the lower protrusion of the stepped stop member.

FIG. 192C shows contact of the tip of the flexible follower member of the latch assembly with the contoured track of the latch housing, which contact position corresponds to the latch member position of FIG. 192B.

FIG. 193A is the bottom view of FIG. 225A, showing the shaft/handle member at roughly 150 degrees of rotation to remain in an unlock position, but showing the lever arm having again been rotated further away from contact with the driving plate, as a result of additional movement imparted to the tongue of the latch member through, its contact with an upper portion of the recessed surface of the lower protrusion of the stepped stop member, as the sash window is opened further.

FIG. 193B is the side view of FIG. 192B, showing the tongue portion of the latch member of the latch assembly having again been driven to retract to its farthest-most retraction position as a result of its contact with the upper portion of the recessed surface of the lower protrusion of the stepped stop member.

FIG. 193C shows contact of the tip of the flexible follower member of the latch assembly with the contoured track of the latch housing, which contact position corresponds to the latch member position of FIG. 193B.

FIG. 194A is the bottom view of FIG. 193A, but is shown alter the shaft/handle member has been driven by the driving plate to only be rotated a total of roughly 120 degrees, as a result of the lever arm having again been driven by the latch member, which results from the latch member being biased into its fully extended position once the sash window is opened sufficiently for the tongue portion of the latch member to be clear of (i.e., be above) the lower protrusion of the stepped stop member.

FIG. 194B is the side view of FIG. 193B, showing the tongue portion of the latch member of the latch assembly having been biased into its fully extended position after the window is opened sufficiently for the tongue portion of the latch member to be clear of (i.e., be above) the lower protrusion of the stepped stop member.

FIG. 194C shows contact of the tip of the flexible follower member of the latch assembly with the contoured track of the latch housing, which contact position corresponds to the latch member position of FIG. 194B, and which shows that the tip has finished one complete circuit around the track, which has steps and surfaces that are configured to selectively direct the tip unidirectionally around the track.

Figures 195A, 195B, 195C, 196A, 196B, 196C, 197A, 197B, 197C, 198A, 198B, 198C, 199A, 199B, 199C, 200A, 200B, 200C, 201A, 201B, 201C:
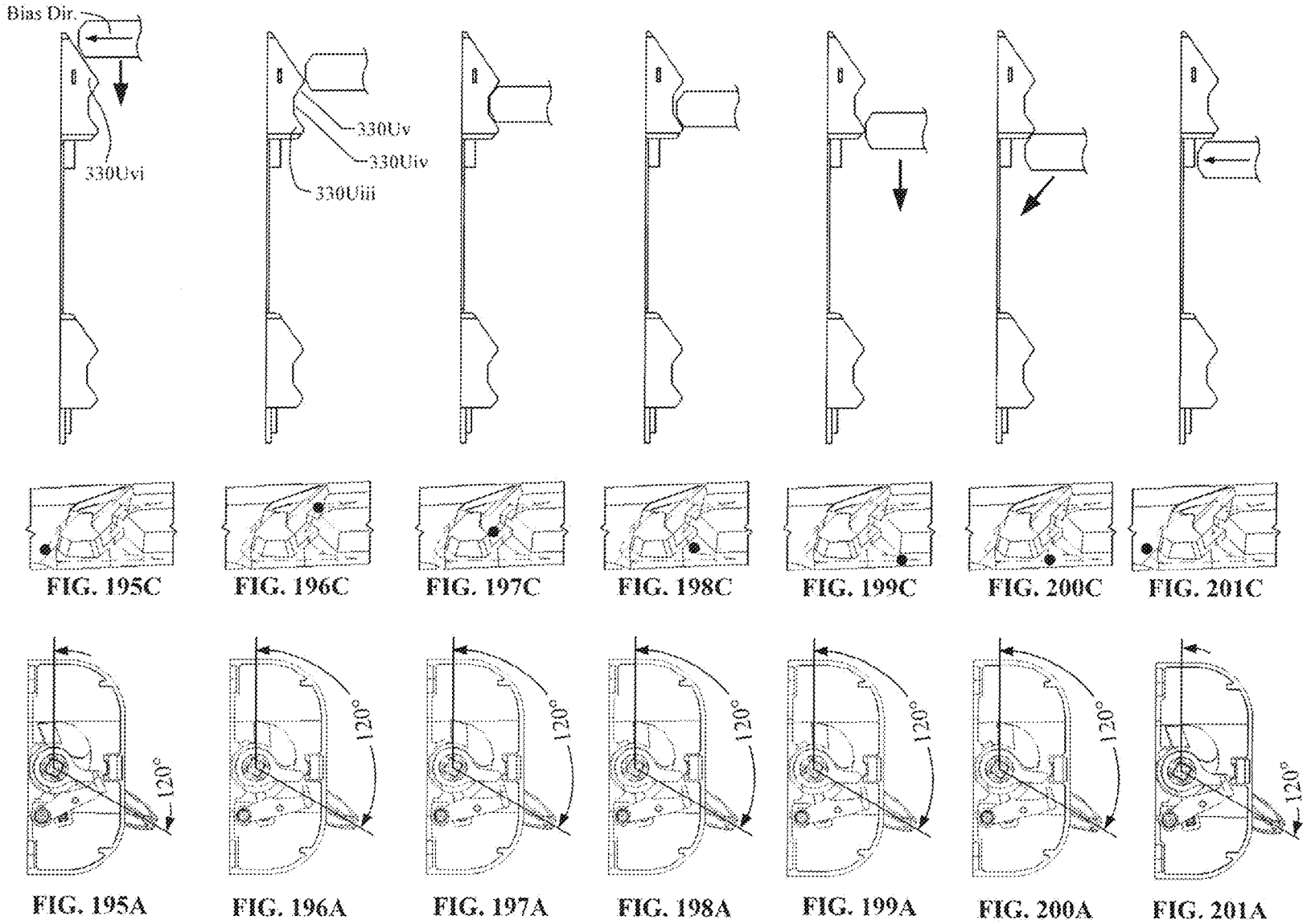

FIG. 195A is the bottom view of FIG. 194A, with the shaft/handle member shown to be rotated a total of roughly 120 degrees from its lock position, but corresponding to the latch member being biased into its fully extended position with the sash window opened sufficiently for the tongue portion of the latch member to be clear of (i.e., be above) the upper protrusion of the stepped stop member.

FIG. 195B is the side view of FIG. 194B, but shown with the latch member in the fully extended position, with the tongue portion positioned above the upper protrusion of the stepped stop member, and with a downward arrow to indicate the start of the window being slid downward towards its closed position, which will cause engagement between the lower curved/angled surface of the tongue portion with the angled/curved top stop surface of the upper protrusion of the stepped stop member.

FIG. 195C is the same as FIG. 194C, showing contact of the tip of the flexible follower member of the latch assembly with the contoured track of the latch housing, but which contact corresponds to the latch member position of FIG. 195B.

FIG. 196A is the bottom view of FIG. 195A, with the shaft/handle member still shown to be rotated a total of roughly 120 degrees from its lock position, but showing the lever arm having again been rotated away from contact with the driving plate, as a result of movement imparted to the tongue of the latch member to cause it to retract, through its contact with the angled/curved top surface of the upper protrusion of the stepped stop member, as the sash window is further moved downward towards its closed position.

FIG. 196B is the side view of FIG. 195B, showing the tongue portion of the latch member of the latch assembly having again been driven to retract to its furthest-most retraction position as a result of its contact with the upper portion of the upper protrusion of the stepped stop member.

FIG. 196C is the same as FIG. 195G, showing contact of the tip of the flexible follower member of the latch assembly with the contoured track of the latch housing, but which contact corresponds to the latch member position of FIG. 196B.

FIG. 197A is the bottom view of FIG. 196A, with the shaft/handle member still shown to be rotated a total of roughly 120 degrees from its lock position, but showing the lever arm having counter-rotated slightly back towards its contact position with the driving plate, as a result the tongue portion of the latch member extending into contact with a recessed surface of the upper protrusion of the stepped stop member, as the sash window continues to be moved towards its closed position.

FIG. 197B is the side view of FIG. 196B, showing the tongue portion of the latch member of the latch assembly having extended into contact with the central portion of the recessed surface of the upper protrusion of the stepped stop member.

FIG. 197C is the same as FIG. 196C, showing contact of the tip of the flexible follower member of the latch assembly with the contoured track of the latch housing, with engagement of the tip of the flexible follower member of the latch assembly again within the nested portion of the contoured track of the latch housing, and which contact corresponds to the latch member position of FIG. 197B.

FIG. 198A is the bottom view of FIG. 197A, with the shaft/handle member still shown to be rotated a total of roughly 120 degrees from its lock position, but showing the lever arm having rotated a small amount further away from its contact position with the driving plate, as a result the tongue portion of the latch member moving along a ramp of the recessed surface of the upper protrusion of the stepped stop member, as the sash window continues to be moved towards its closed position.

FIG. 198B is the side view of FIG. 197B, showing the tongue portion of the latch member just beginning to move along a ramp of the recessed surface of the upper protrusion of the stepped stop member to be further retracted, as the sash window continues to be moved towards its closed position.

FIG. 198C is the same as FIG. 197C, showing contact of the tip of the flexible follower member with the contoured track of the latch housing of the latch assembly, just after having been triggered to exit the nested portion of the track, which exit position corresponds to the latch member position of FIG. 198B.

FIG. 199A is the bottom view of FIG. 198A, with the shaft/handle member still shown to be rotated a total of roughly 120 degrees from its lock position, but showing the lever arm having rotated further away from its contact position with the driving plate, as a result the tongue portion of the latch member moving to the furthest-most portion of the ramp of the recessed surface of the upper protrusion of the stepped stop member, as the sash window continues to be moved towards its closed position.

FIG. 199B is the side view of FIG. 198B, showing the tongue portion of the latch member of the latch assembly having been driven to retract to its furthest-most retracted position, as a result of its contact with the most distal location of the ramp of the bottom ramp of the upper protrusion of the stepped stop member.

FIG. 199C is the same as FIG. 198C, showing contact of the tip of the flexible follower member of the latch assembly with the contoured track of the latch housing, which contact position corresponds to the latch member position of FIG. 199B.

FIG. 200A is the bottom view of FIG. 199A, with the shaft/handle member still shown to be rotated a total of roughly 120 degrees from its lock position, but showing the lever arm having rotated closer to its contact position with the driving plate, as a result the lower curved/angled surface of the tongue portion following the angled/curved bottom surface of the upper protrusion of the stepped stop member, as the sash window continues to be moved, towards its closed position.

FIG. 200B is the side view of FIG. 199B, showing the tongue portion of the latch member of the latch assembly extending as a result of the lower curved/angled surface of the tongue portion following the angled/curved bottom surface of the upper protrusion of the stepped stop member.

FIG. 200C is the same as FIG. 199C, showing contact of the tip of the flexible follower member of the latch assembly with the contoured track of the latch housing, which contact position corresponds to the latch member position of FIG. 200B.

FIG. 201A is the bottom view of FIG. 200A, with the shaft/handle member still shown to be rotated a total of roughly 120 degrees from its lock position, but showing the lever arm having rotated to again be in contact with the driving plate, as a result the upper curved/angled surface of the tongue portion moving clear of the bottom surface of the upper protrusion of the stepped stop member for the latch member to be biased into its fully extended position, as the sash window is moved further toward its closed position.

FIG. 201B is the side view of FIG. 200B, showing the tongue portion of the latch member of the latch assembly biased into in its fully extended position, as a result the upper curved/angled surface of the tongue portion moving clear of the bottom surface of the upper protrusion of the stepped stop member for the latch member to be biased into its fully extended position, and be positioned below the bottom stop surface of the upper protrusion of the stepped stop member, which may again serve as a vent stop.

FIG. 201C is the same as FIG. 200C, showing contact of the tip of the flexible follower member of the latch assembly with the contoured track of the latch housing, which contact position corresponds to the latch member position of FIG. 201B.

DETAILED DESCRIPTION OF THE INVENTION

As used throughout this specification, the word "may" is used in a permissive sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C", "one or more of A, B, and C" and "A, B, and/or C" mean all of the following possible combinations: A alone; or B alone; or C alone; or A and B together; or A and C together; or B and C together; or A, B and C together.

Also, all references (e.g., patents, published patent applications, and non-patent literature) that are cited within this document are incorporated herein in their entirety by reference.

Furthermore, the described features, advantages, and characteristics of any particular embodiment disclosed herein, may be combined in any suitable manner with any of the other embodiments disclosed herein.

It is further noted that any use herein of relative terms such as "top," "bottom," "Upper," "lower," "vertical," and "horizontal" are merely intended to be descriptive for the reader, based on the depiction of those features within the figures for one particular position of the fastener, and such terms are not intended to limit the orientation with which the present invention may be utilized.

A window fastener, for use with respect to a frame of a sash window configured to be slidable and tiltable with respect to a master window frame, may include: a sash lock 101; and a tilt latch assembly 201; and a stop member 301, as shown in FIG. 1. The sash lock may be configured to be forced-entry-resistant.

The forced-entry-resistant sash lock 101 may broadly include a housing 110, a shaft/handle member 140, a plate member 150, a cam 160, a lever arm 170, a driving plate 180, and a spring 190, which may be a compression spring.

Figure 6:
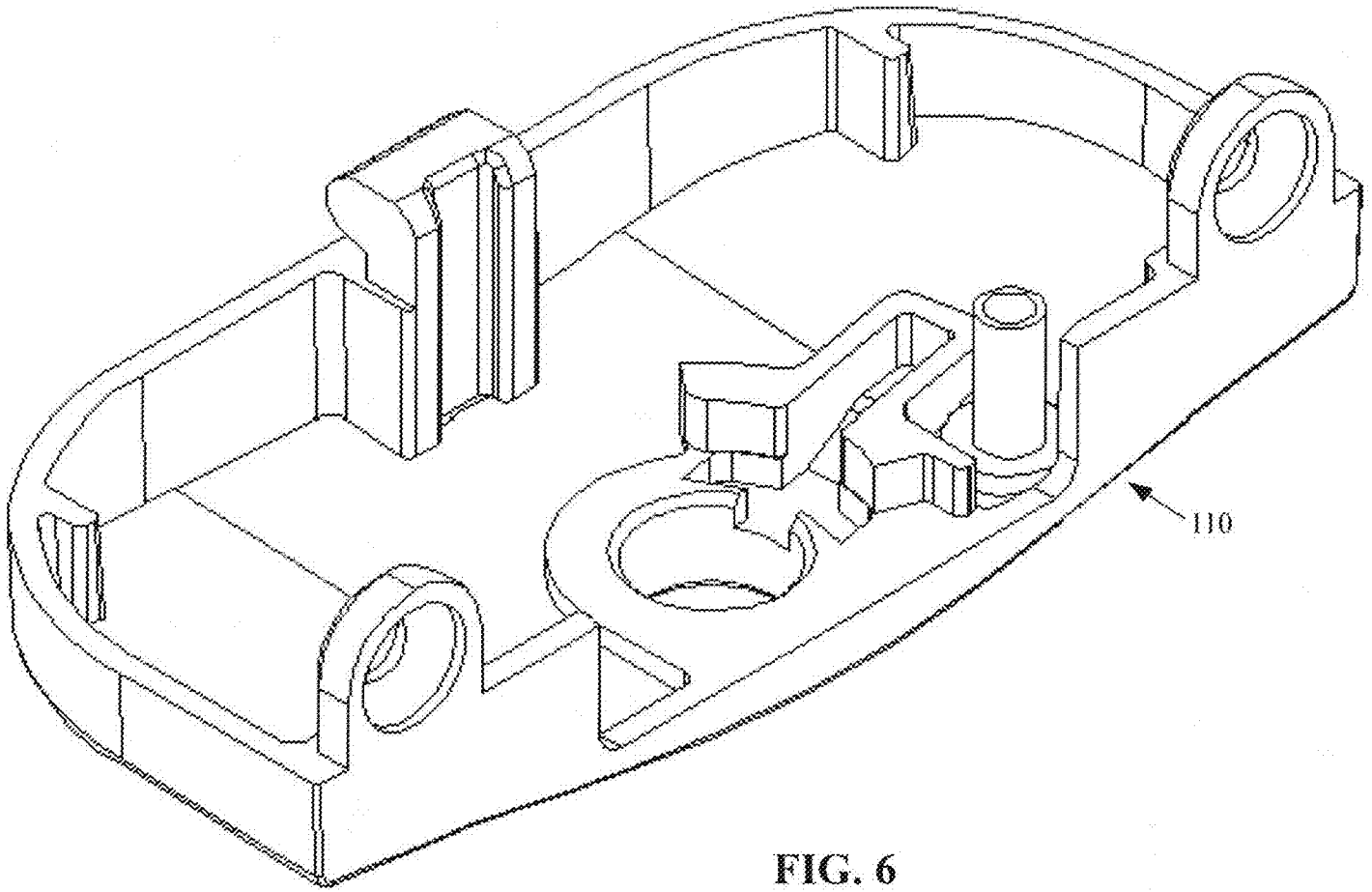
FIG. 6 is a first perspective view of the housing of FIG. 2.
Figure 7:
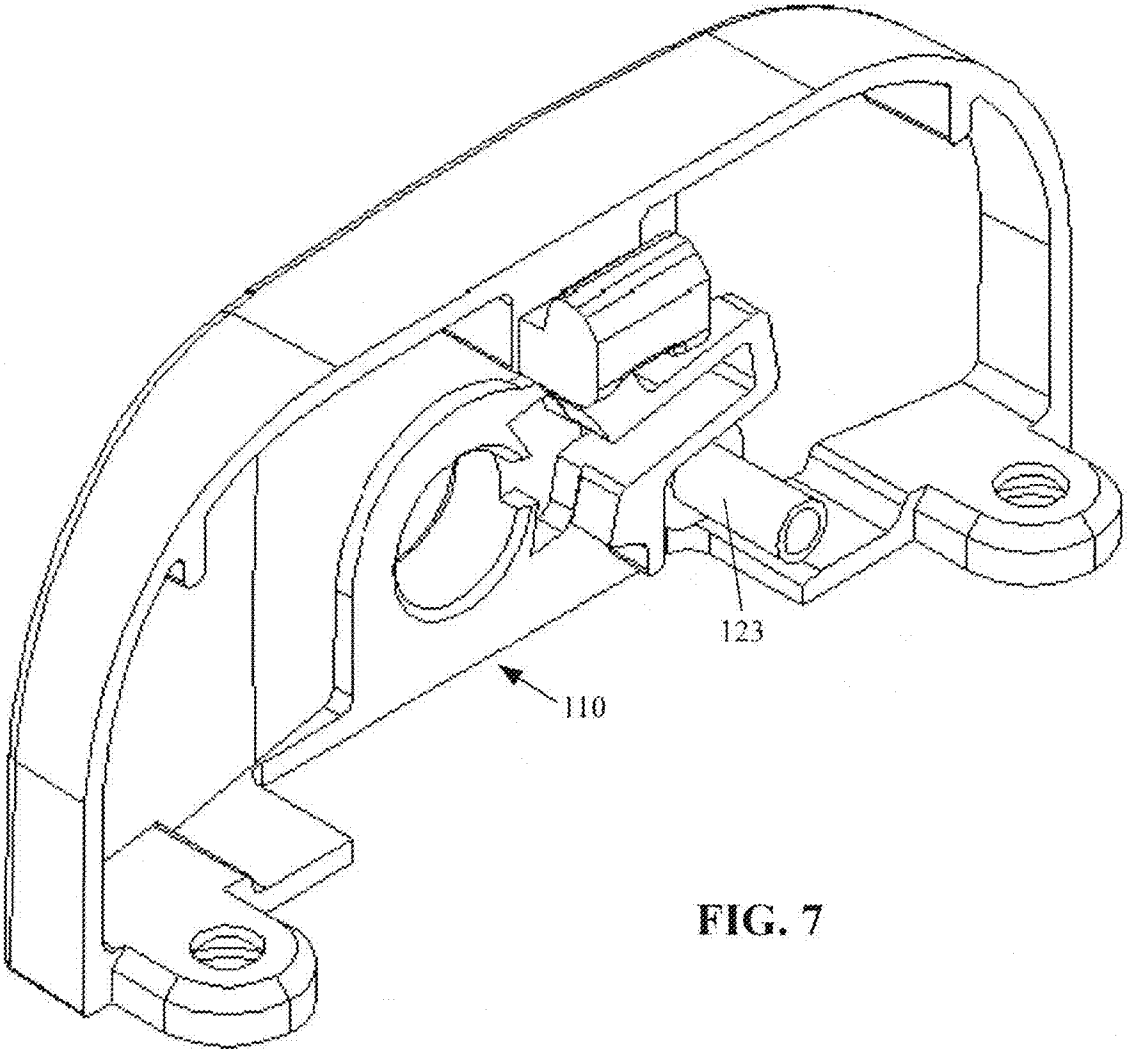
FIG. 7 is a second perspective view of the housing of FIG. 2.

Perspective views of the sash lock housing 110 are shown in FIGS. 6-7, while corresponding orthogonal views are shown in FIGS. 2-5. The housing 110 is not limited to the shape illustrated within those figures and could take on many different suitable shapes, including a rectangular shape, an irregular shape, etc. However, the housing 110 may desirably be formed of at least one wall that may be shaped to form an exterior surface 110E, and an interior surface 110N that defines a cavity, and which wall may terminate in a generally flat bottom 121 that may be configured to rest upon the top of the meeting rail. The housing wall may span from a first end 111 to second end 112. The bottom 121 may be open as shown, or the wall may extend over only a portion of the bottom of the housing. The housing wall may also be shaped to form a generally flat surface 113, which may have an opening 114 that may interconnect with the cavity of the housing. The wall of housing 118 may extend beyond the bottom 121 to form a first protrusion 115 and a second protrusion 116, each of which may have a respective mounting hole 115H/116H formed therein for receiving a fastener for securing the sash lock 101 to the meeting rail of the sliding sash window. A leg 117 may extend from an opposite side of the housing 110, which may be received within an opening in the meeting rail, to be used in combination with the mounting holes 105H/106H for securing the sash, lock 101 to the meeting rail.

Extending away from the interior surface HON of the housing 110 may be a cylindrical protrusion 123 that may be used for pivotal mounting of the lever arm 170 to the housing 110.

The housing 111 may have a boss 118 extending upwardly from the outer surface 110E, which boss may be cylindrical, and may also have a boss (or thickened area) 119 extending downwardly from the interior surface 110N, into the housing cavity. The housing 110 may have a hole 120 through the boss 118 and boss 119, which may be used for pivotal mounting of the shaft/handle member 140 to the housing. A shaped recess 122 may be formed in the interior of the housing wall in the area 119 of the wall, a portion of which may be elongated, and which shaped recess may be formed to receive at least a portion of the plate member 150 therein.

Figure 8:
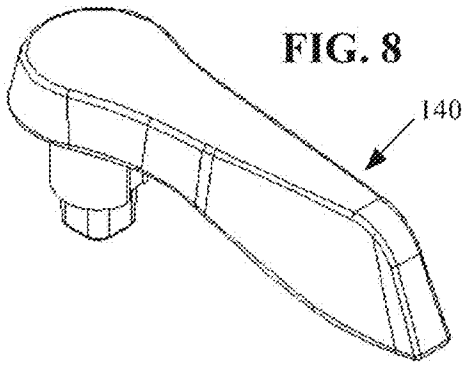
FIG. 8 is a first perspective view of the shaft/handle member of the sash lock assembly of FIG. 1.
Figure 9:
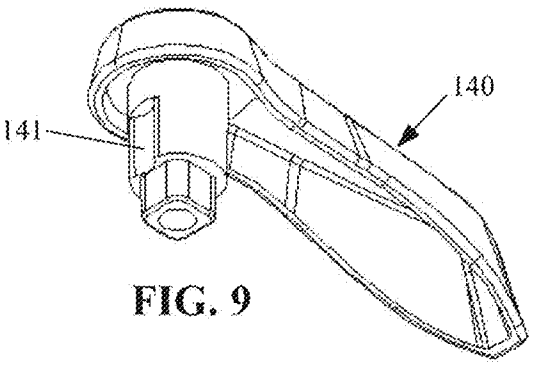
FIG. 9 is a second perspective view of the shaft/handle member of the sash lock assembly of FIG. 1.
Figure 10:
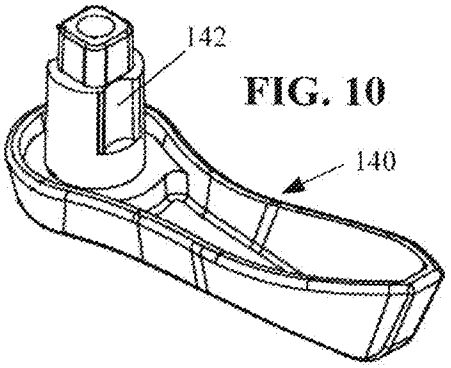
FIG. 10 is a third perspective view of the shaft/handle member of the sash lock assembly of FIG. 1.
Figure 12:
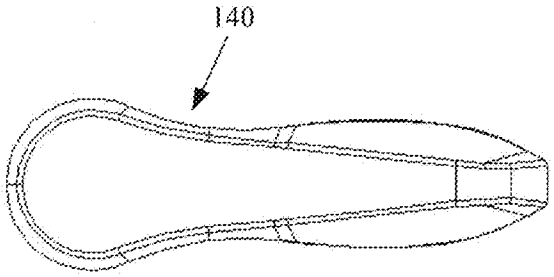
FIG. 12 is a top view of the shaft/handle member of FIG. 11.
Figure 11:
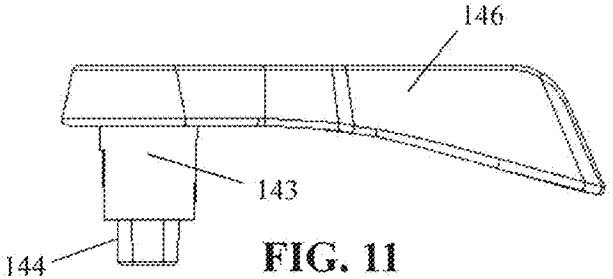
FIG. 11 is a side view of the shaft/handle member of FIG. 8.
Figure 14:
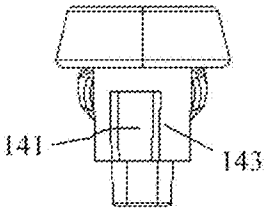
FIG. 14 is an end view of the shaft/handle member of FIG. 11.
Figure 13:
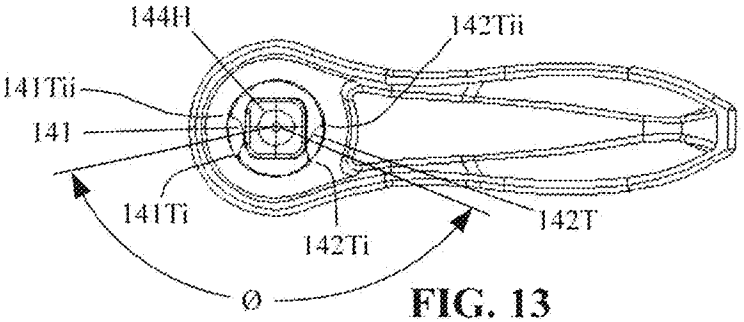
FIG. 13 is a bottom view of the shaft/handle member of FIG. 11.

Perspective views of the shaft/handle member 140 are shown in FIGS. 8-10, while corresponding orthogonal views are shown in FIGS. 11-14. As seen in FIGS. 8-14, the shaft/handle member 140 may have a cylindrical shaft 143, one end of which may have a rectangular-shaped protrusion 144 with a hole 144H formed therein, which may receive a rivet or other fastener, for mounting of the lever arm 170 thereto. The rectangular-shaped protrusion 144 may have each of its four corners be radiused. The other end of the shaft 143 may have a knob or other enlarged circular cross-sectional shape to permit that end of the shaft to be easily grasped by the user. In one embodiment, the other end of the shaft 143 may have a graspable handle portion 146 that may extend generally orthogonally with respect to the axis of shaft 143. The shaft 143 may be configured to be pivotally received within the hole 120 in the boss 118 of the housing 110. The shaft 143 may have a first curved recess 141 that may be formed to extend substantially parallel to the axis of the cylindrical shaft. The recess 141 may be formed of a portion of a cylindrical surface, or may be formed by another curved surface (e.g., elliptical). The curved recess 141 may transition to the cylindrical surface of the shaft 143 using a first curved, transition surface 141Ti and a second transition surface 141Tii (FIG. 13). A second curved recess 142 may be similarly formed, and may similarly transition to the cylindrical surface of the shaft 143 using a first curved transition surface 142Ti and a second transition surface 142Tii. The first recess 141 and the second recess 142 may be clocked on the shaft 143, as shown in FIG. 13, to be particularly oriented for latching and unlatching of the cam 160 to make the sash lock 101 forced-entry-resistant. In one embodiment, the first recess 141 and the second recess 142 may be clocked to be roughly 150 degrees apart from each other (i.e., $\Theta$=150°). Note that in another embodiment, a different angular clocking angle $\Theta$ may be used. The first recess 141 may also be clocked on the shaft 143 so that the handle 160 may be oriented as shown in FIG. 71B (i.e., the zero degree handle position), when the cam 160 is in the locked (extended) cam position.

Figure 15:
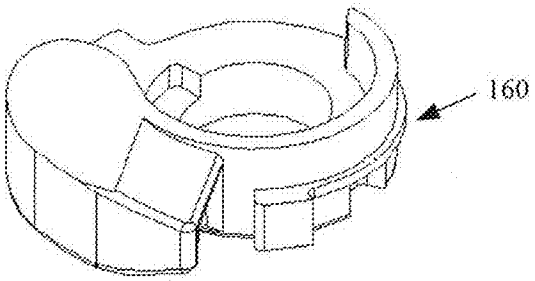
FIG. 15 is a first perspective view of a cam used in the sash lock assembly shown in FIG. 1.
Figure 16:
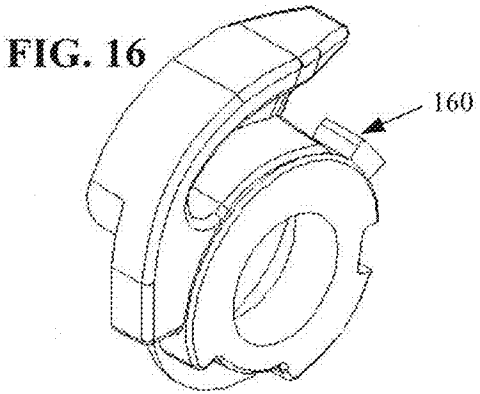
FIG. 16 is a second perspective view of the cam used in the sash lock assembly shown in FIG. 1.
Figure 17:
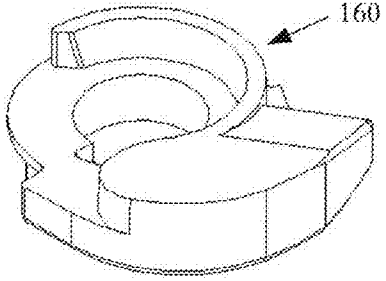
FIG. 17 is a third perspective view of the cam used in the sash lock assembly shown in FIG. 1.
Figure 19:
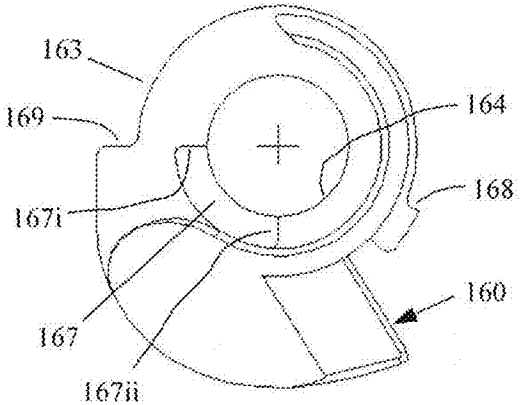
FIG. 19 is a top view of the cam of FIG. 15.
Figure 18:
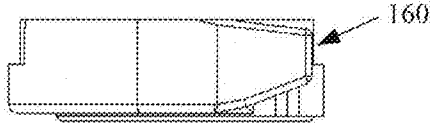
FIG. 18 is a side view, of the cam of FIG. 15.
Figure 20:
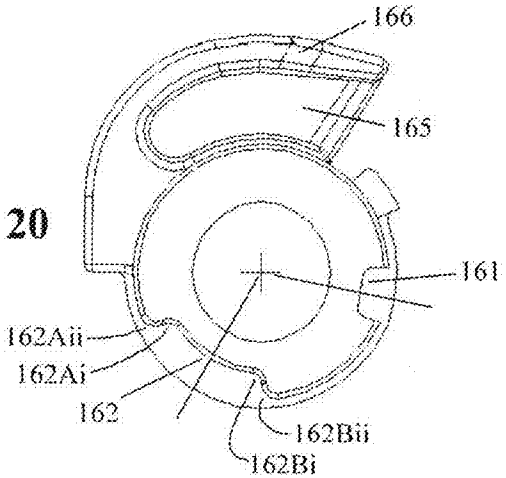
FIG. 20 is a bottom view of the cam of FIG. 15.
Figure 21:
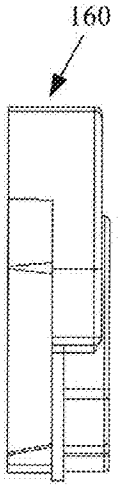
FIG. 21 is an end view of the cam of FIG. 15.
Figure 25:
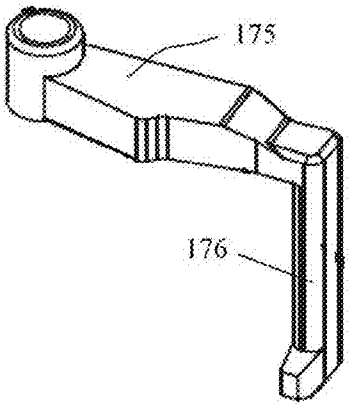
FIG. 25 is a fourth perspective view of the lever arm used in the sash lock assembly of FIG. 1.
Figure 23:
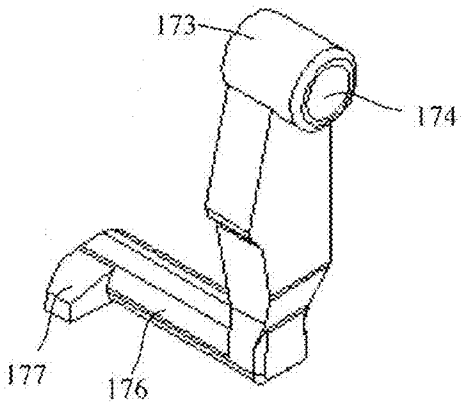
FIG. 23 is a second perspective view of the lever arm used in the sash lock assembly of FIG. 1.
Figure 24:
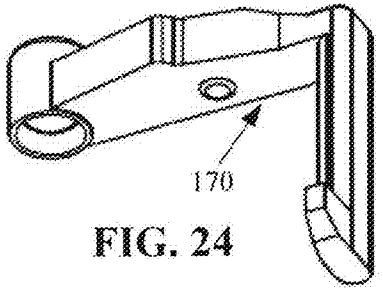
FIG. 24 is a third perspective view of the lever arm used in the sash lock assembly of FIG. 1.
Figure 22:
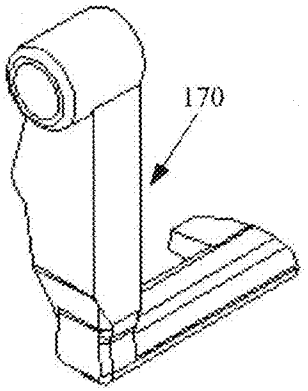
FIG. 22 is a first perspective view of the lever arm used in the sash lock assembly of FIG. 1.

Perspective views of the locking cam 160 are shown in FIGS. 15-17, while corresponding orthogonal views are shown in FIGS. 18-21. The locking cam 160, as seen in FIGS. 15-21, may have a cylindrical hub 163, with a hole 164 formed therein that is sized to permit the cam to thereby be pivotally mounted upon the shaft/handle member 140. Extending laterally away from the hub 163 may be a wall 165, and extending laterally away from the wall 165 may be a curved cam wall 166, which may be used to engage a key of the corresponding keeper, and to draw the sliding sash window in closer proximity to the master window frame (or to the other sash window for a double-hung arrangement) during locking of the window. The hub 163 of the cam 160 may have a first shaped opening 161, and a second shaped opening 162 formed at first and second respective radial positions on the hub. The first shaped opening 161 may be formed, thereon relative to the wall 166 to be clocked so that it may be properly engaged, as discussed hereinafter, when the cam 160 is in the locked (extended) cam position (e.g., FIG. 71B). The second shaped opening 162 may be clocked relative to the first shaped opening 161 so that it may permit some relative movement of the cam, as discussed hereinafter, when the cam 160 is in the unlocked (retracted) cam position—see FIG. 73 and FIG. 75. It should be noted that whereas the first opening 161 of cam 150 has straight walls 161A and 161B that may directly engage the sides of the protrusion 154 of the plate member 150 to inhibit cam movement (i.e., latch the cam) when received therein, the second opening 162 may have a first side formed with an internal radius 162Ai and a tangentially radiused external corner 162Aii, and a second side formed with an internal radius 162Bi and a tangentially radiused external corner 162Bii. Thus, while the protrusion 154 of the plate member 150 in combination with the first opening 161 may act as a latch, its co-action with the second opening 162 may act as a detent, similar to the combination of the first curved recess 141 and the second recess 142 of the shaft/handle member 140 receiving the curved surface 152C of the plate member 150. Both of these detent arrangements may give a tactile indication to the user grasping the handle, as to when it reaches the zero degree (locked) and 150 degree (unlocked/cocked) positions.

A recess 167, which may be annular, may be formed in the hub 163, having a first end 167*i*, and a second end 167*ii*. The ends 167*i* and 167*ii* of the recess 167 may be particularly spaced apart radially, and may provide an engagement surface by which the cam 160 may be selectively driven to co-rotate by a protrusion of the driving plate 180 (e.g., after 50 degrees of handle rotation from the locked, zero degree position—see FIG. 71B and FIG. 72—which may contribute to guarding against a forced entry).

Figure 75:
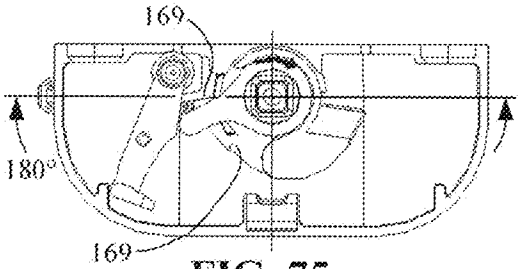
FIG. 75 is the bottom view of FIG. 74, but is shown with the shaft/handle member further rotated to be at 180 degrees of rotation, for the driving plate to have been driven by the cam to further drive the lever arm, to position the latch in a retracted position, to permit tilting of the sash window.

A protruding feature (e.g., protrusion 168) may be formed on the hub 163 of the cam 166 to engage a corresponding feature on the housing 110 to serve as a stop, to limit outward pivotal travel of the cam 160 at the locked (extended) cam position (FIG. 71C). Another protruding feature (e.g., protrusion 169) may be formed on the hub 163 to engage a corresponding feature on the housing 110 to serve as another stop, which may limit pivotal travel of the cam 160 into the housing cavity to be at an extreme retracted cam position (FIG. 75).

Figure 28:
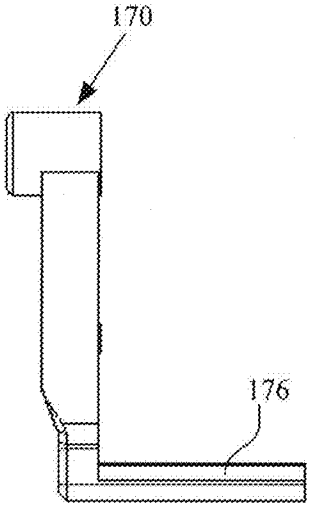
FIG. 28 is a second side view of the lever arm of FIG. 26.
Figure 26:
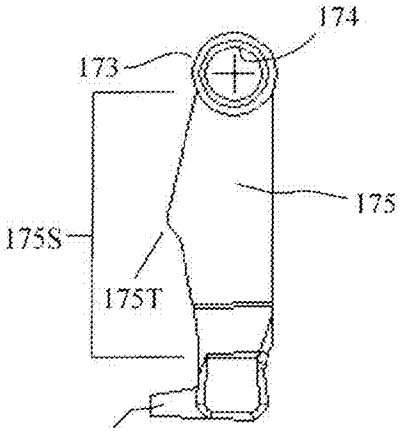
FIG. 26 is a top view of the lever arm of FIG. 22.
Figure 27:
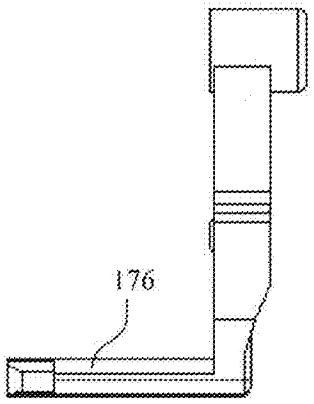
FIG. 27 is a first side view of the lever arm of FIG. 26.
Figure 29:
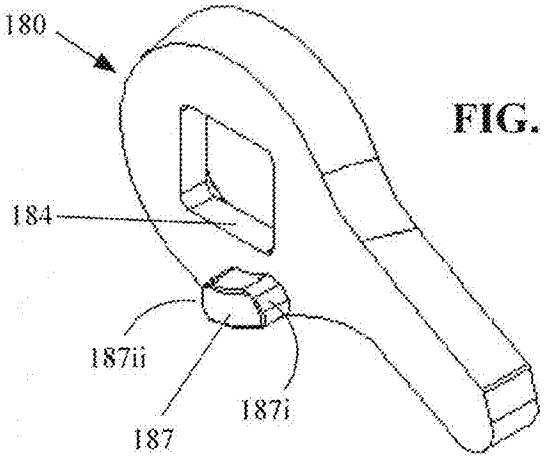
FIG. 29 is a first perspective view of the driving plate used for the sash lock assembly of FIG. 1.
Figure 32:
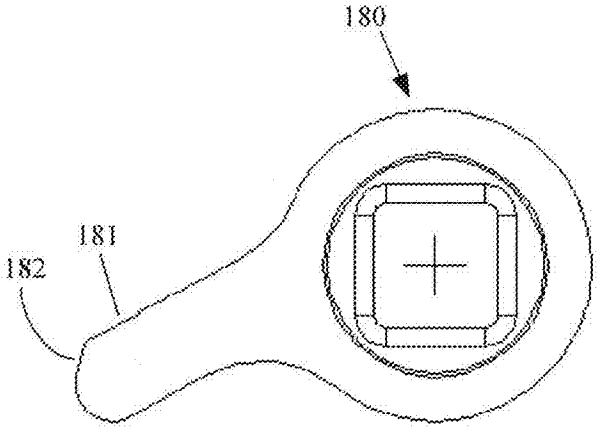
FIG. 32 is a bottom view of the driving plate of FIG. 30.
Figure 33:
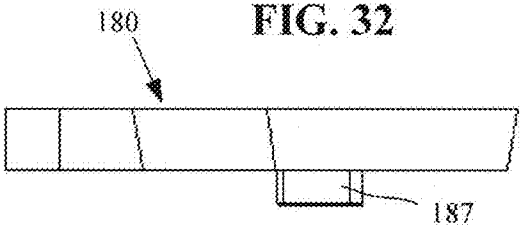
FIG. 33 is an end view of the driving plate of FIG. 30.
Figure 30:
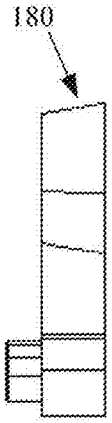
FIG. 30 is a front view of the driving plate used of FIG. 29.
Figure 31:
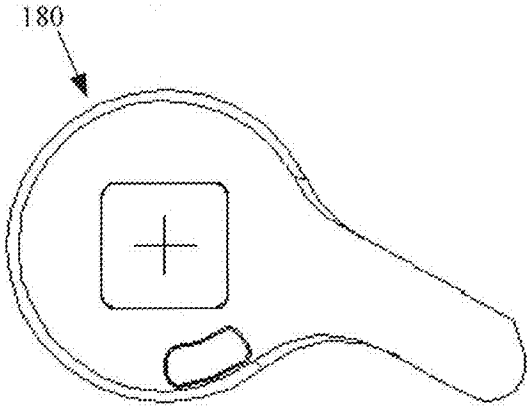
FIG. 31 is a top view of the driving plate used of FIG. 30.
Figure 38:
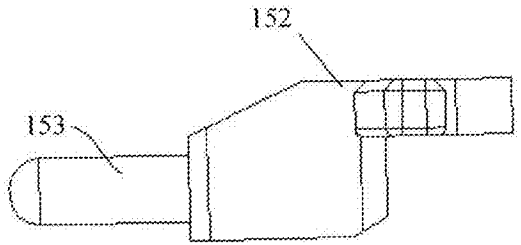
FIG. 38 is a top view of the plate member of FIG. 37.
Figure 37:
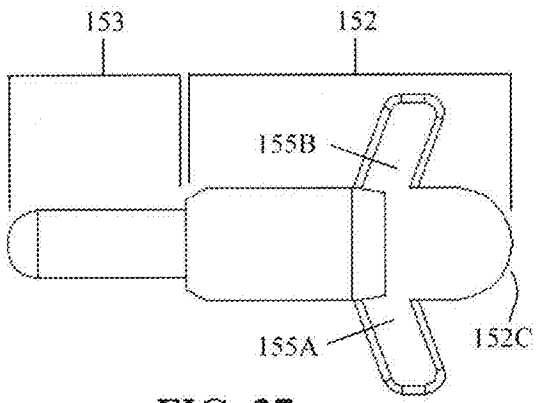
FIG. 37 is a front view of the plate member of FIG. 34.
Figure 39:
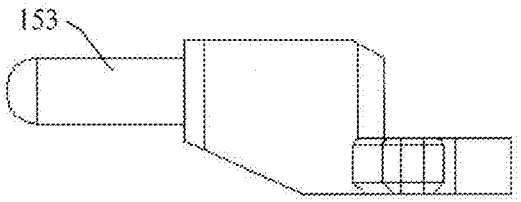
FIG. 39 is a bottom view of the plate member of FIG. 37.
Figure 40:
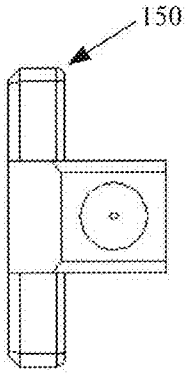
FIG. 40 is an end view of the plate member of FIG. 37.
Figure 34:
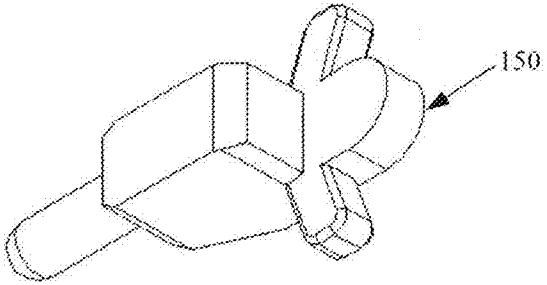
FIG. 34 is a first perspective view of the plate member used for the sash lock assembly of FIG. 1.
Figure 35:
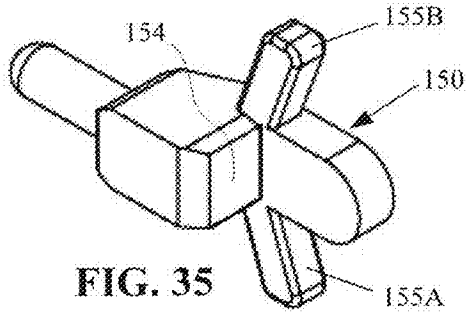
FIG. 35 is a second perspective view of the plate member used for the sash lock assembly of FIG. 1.
Figure 36:
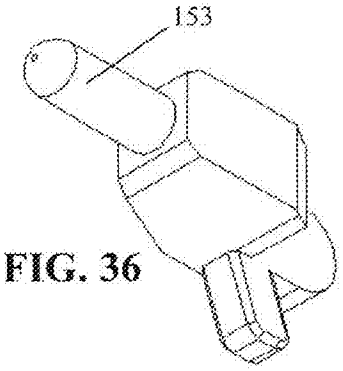
FIG. 36 is a third perspective view of the plate member used for the sash lock assembly of FIG. 1.

Perspective views of the lever arm 170 are shown in FIGS. 22-25, while corresponding orthogonal views are shown in FIGS. 26-28. Interaction between the sash lock assembly 101, once installed upon the meeting rail of the sliding sash window, and the latch assembly 201, may be through the lever arm 170 that may be pivotally mounted within the cavity of the housing 10. The lever arm 170 may include a hub 173, with a mounting hole 174 therein. Extending laterally away from the axis of the hub 173 may be an arm 175, which may have a sculpted surface 175S (a follower surface), and which may include an apex 175T. The sculpted surface 175S may be selectively driven by rotation of the driving plate 180, as discussed hereinafter. The arm 175 may transition into a post 176 that may be generally orthogonal to the arm 175, and may be generally parallel to the axis of the hub 173. The post 176 may have an elongated cross-sectional shape (e.g., oval, elliptical, rectangular, etc.). A protrusion 177 may protrude from the post 176.

The driving plate 180 is illustrated in FIGS. 29-33, and may be configured to be secured to the rectangular shaped protrusion 144 at the end of the shaft 143 of the shaft/handle member 140, in any suitable manner (e.g., using one or more of a plurality of mechanical fastener types, adhesive, etc.). In one embodiment, the driving plate may be formed as a flat plate with a rectangular shaped recess that may be sized to be received upon the rectangular shaped protrusion 144 at the end of the shaft 143. A hole (not shown) may be formed in the driving plate 180 for receiving a mechanical fastener (e.g., a rivet, a screw, etc.) therethrough, and into the hole 144H of the shaft/handle member 140, for securing the driving plate to the shaft/handle member. Alternatively, the driving plate 180 may be formed with a through opening 184 for mounting to the rectangular shaped protrusion 144 at the end of the shaft 143 of the shaft/handle member 140.

Figure 72:
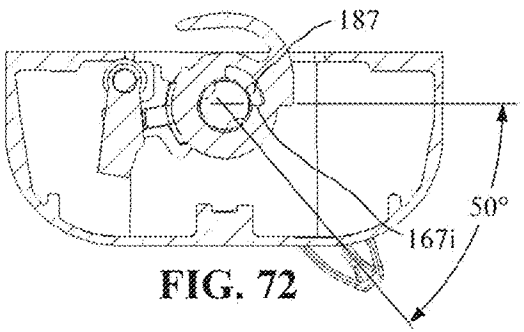
FIG. 72 is a cross-sectional view through the sash lock assembly of FIG. 63, taken at a third depth, being shown with the shaft/handle member at fifty degrees of rotation, for the cam to remain in the extended position, but where the plate member has been disengaged from the cam, and showing the protrusion of the driving plate positioned at a second end of the annular recess in the cam, being positioned to begin driving the cam with further rotation of the shaft/handle member.
Figure 73:
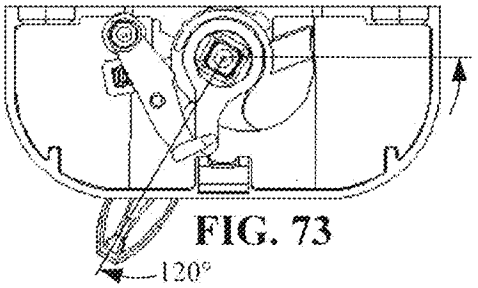
FIG. 73 is a bottom view of the sash lock assembly of FIG. 63, but is shown with the shaft/handle member having been rotated to be at 120 degrees of rotation, for the cam to have been driven by the shaft/handle member to retract into the housing.
Figure 74:
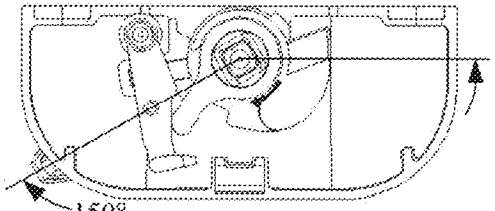
FIG. 74 is the bottom view of the sash lock assembly as shown in FIG. 73, but is shown with the shaft/handle member further rotated to be at 150 degrees of rotation, for the driving plate to have been driven to contact and drive the lever arm, to correspondingly actuate the latch member to position the latch in a cocked position.

The driving plate 180 may also be formed with a protrusion 187 that may have a first side 187*i* and a second side 187*ii* that are respectively configured to alternately engage each of the first end 167*i* and the second end 167*ii* of the arcuate recess 167 of the cam 160, to be able to drive the cam in each of a first direction and a second direction, between an unlocked (retracted) cam position and a locked (extended) cam position (see FIG. 71, FIG. 72, and FIG. 73). The driving plate 180 may also be formed with a first cam surface 181 and a second cam surface 182, each of which may be used to drive rotation of the arm 175 through contact with its sculpted follower surface 175S, as discussed hereinafter.

Figure 41:
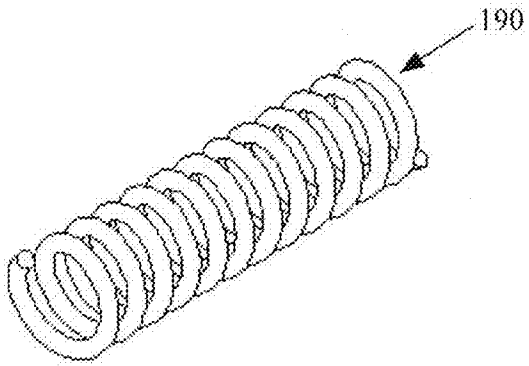
FIG. 41 is a perspective view of the compression spring used for the sash lock assembly of FIG. 1.
Figure 42:
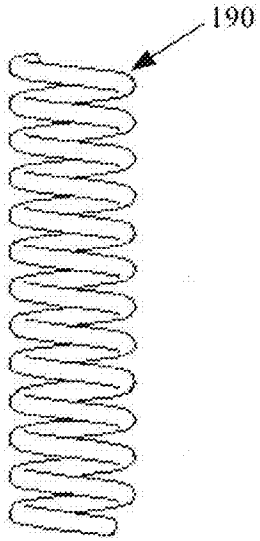
FIG. 42 is a top view of the compression spring of FIG. 41.
Figure 43:
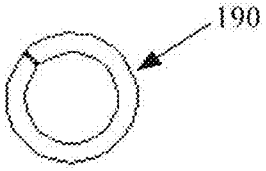
FIG. 43 is an end view of the compression spring of FIG. 42.

The plate member 150 illustrated in FIGS. 34-40, may be formed with a first portion 152 (FIG. 37) that may be configured to be slidably received within the recess 122 of the housing 110. A first end of the first portion 152 of the plate member may be formed into a curved surface 152C. The curved surface 152C may be shaped to correspond to the shape of the first and second curved recesses 141/142 of the shaft/handle member 140. The plate member 150 may also be formed with a second portion 153 that may be configured to extend from the second end of the first portion of the plate member, and may be configured to slidably receive the helical compression spring 190 (FIG. 41) thereon, which may be used to bias the curved surface 152C of the plate member 150 into contact with the shaft 140 (see e.g., FIG. 71A). The plate member 150 may also be formed with a protruding portion 154 that may be shaped to be received within each of the first shaped opening 161 of the cam 160, and the larger second opening 162 of the cam. (Note that the second portion 153 may extend from the protruding portion 154). The plate member 150 may also be formed with a first shaped protrusion 155A and a second shaped protrusion 155B that may be correspondingly received within recess 122 of the housing 110, which may further serve hi guiding the movement of the plate member towards the shaft/handle member 140, in addition to, or as an alternative to, the first portion 152 that is received within the correspondingly shaped portion of recess 122. The first shaped protrusion 155A and the second shaped protrusion 155B may also co-act with a corresponding wall feature on recess 122 of the housing 110 to serve as a stop to limit the biased movement of the plate member towards the shaft/handle member 140.

Figure 44:
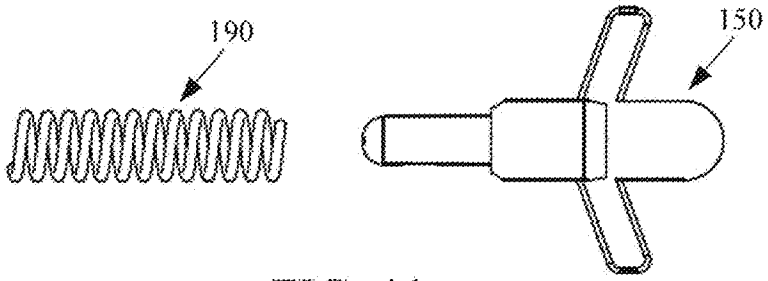
FIG. 44 is a view illustrating the compression spring of FIG. 42 just prior to being received upon a post of the plate member of FIG. 37.
Figure 45:
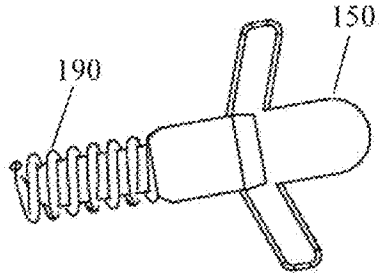
FIG. 45 is a view illustrating the compression spring of FIG. 42 just after being received upon a post of the plate member of FIG. 37.
Figure 46:
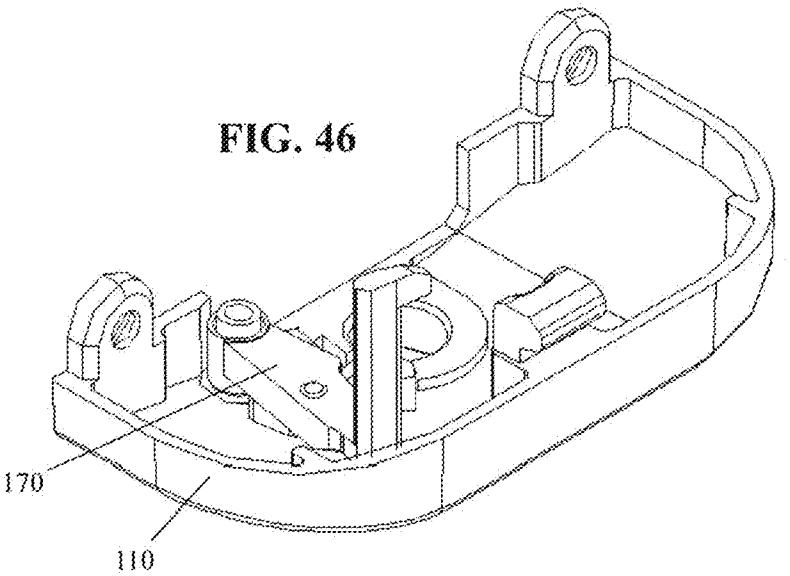
FIG. 46 illustrates a bottom perspective view of the sash lock housing shown after receiving the assembled compression spring and plate member of FIG. 45 therein, and after the lever arm of FIG. 22 is pivotally mounted thereto.
Figure 47:
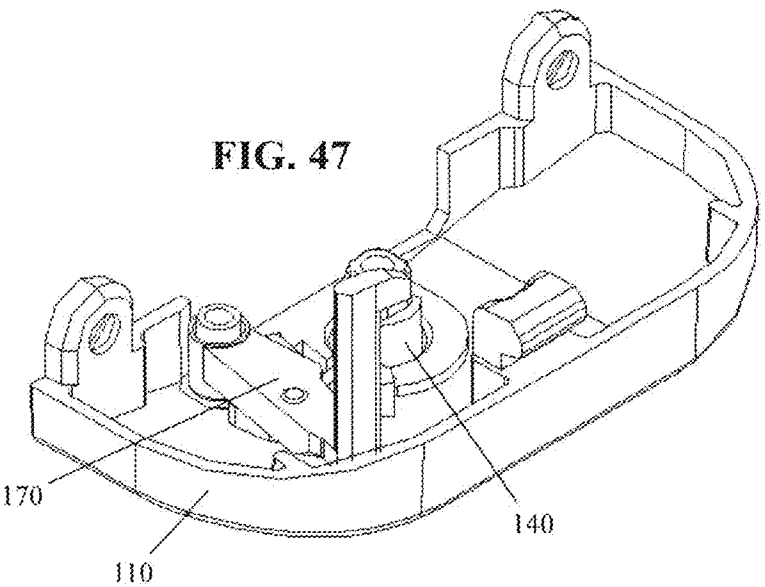
FIG. 47 is the bottom perspective view of FIG. 46, shown after the shaft/handle member of FIG. 8 is pivotally received in an orifice of the housing.
Figure 48:
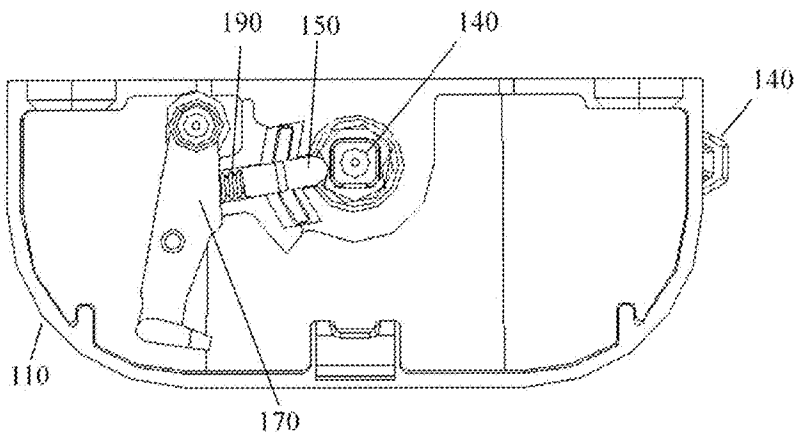
FIG. 48 is a bottom view of the arrangement shown in FIG. 47.
Figure 50:
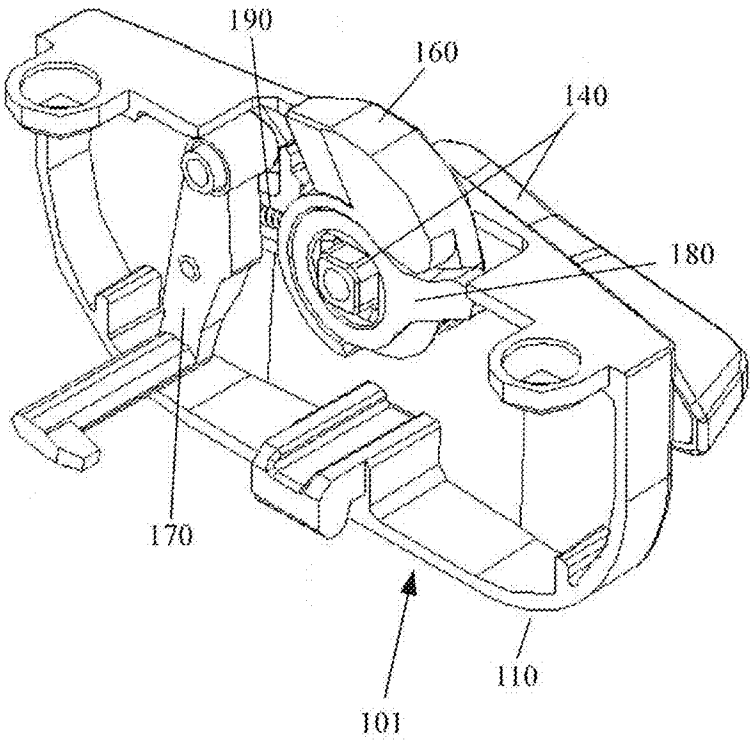
FIG. 50 is the bottom perspective view of FIG. 49, but shown after the driving plate of FIG. 29 is mounted to the shaft/handle member, to form the sash lock assembly of FIG. 1.
Figure 49:
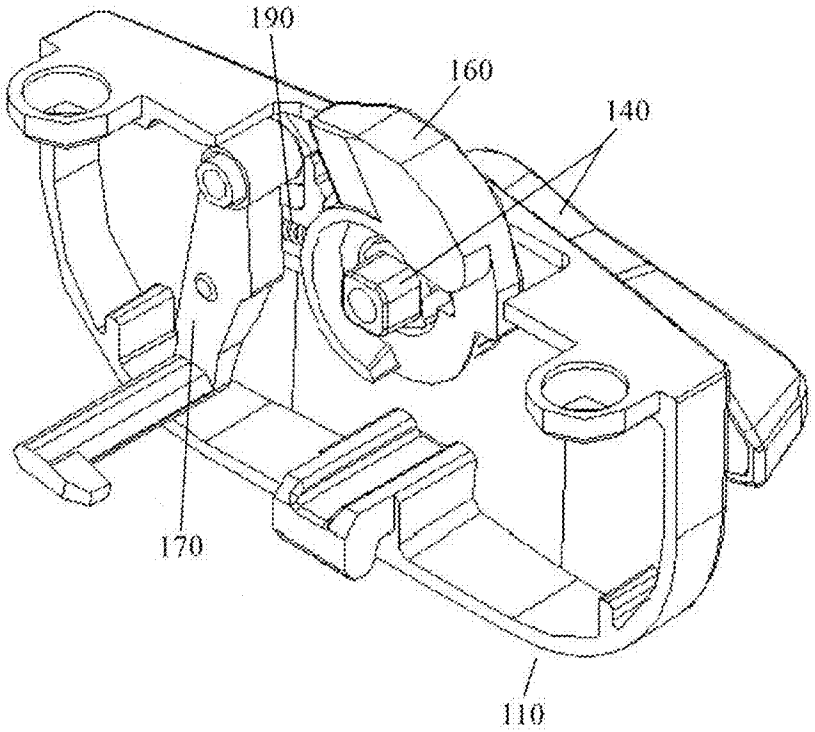
FIG. 49 is the arrangement of FIG. 47, but shown after the cam of FIG. 15 is pivotally mounted to the shaft/handle member.
Figure 51:
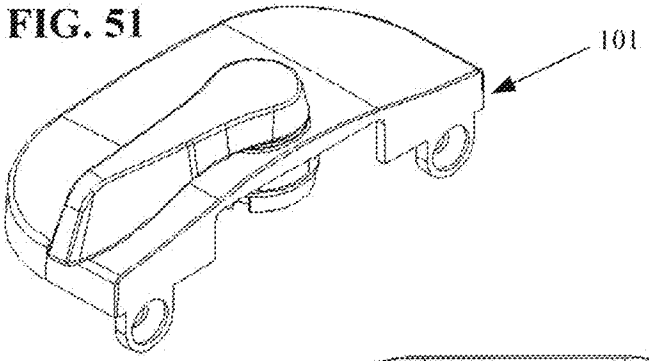
FIG. 51 is a first perspective view of the sash lock assembly of FIG. 1, shown with the cam in a retracted position.
Figure 52:
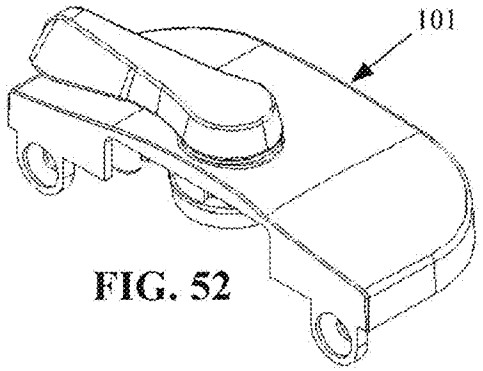
FIG. 52 is a second perspective view of the sash lock assembly, as shown in FIG. 51.
Figure 54:
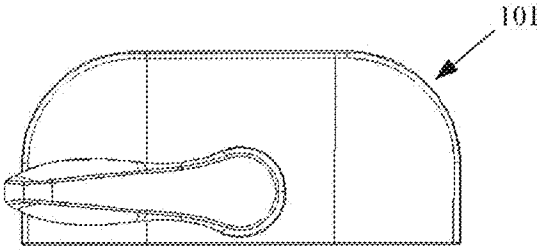
FIG. 54 is a top view of the sash lock assembly shown in FIG. 51.
Figure 53:
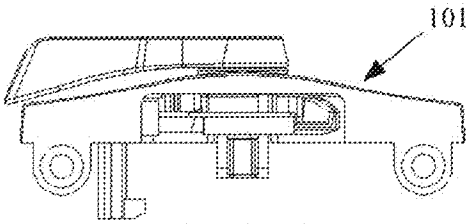
FIG. 53 is a front view of the sash lock assembly shown in FIG. 51.
Figure 56:
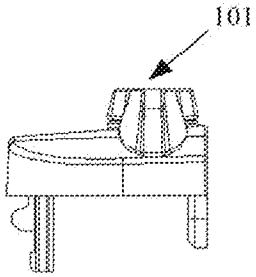
FIG. 56 is a first side view of the sash lock assembly shown in FIG. 51.

Assembly of the component parts of the sash lock 101 is shown sequentially within FIGS. 46-50. In FIGS. 46-48, the assembled spring 190 on the second portion 153 of plate member 150 (see FIGS. 44-45) is inserted into the recess 122 of the housing 110, and then the hole 174 of the hub 173 of the lever arm 170 is pivotally received upon the post 123 of the housing 110, and may be pivotally secured thereat using a rivet, a screw, or any other suitable means. Next the cylindrical shaft 143 of the shaft/handle member 140 may be received into the hole 120 of housing 110, and may be clocked as shown in FIG. 48, which may result in the curved surface 152C of the plate member 150 being received within the recess 141 of the shaft/handle member 140. As shown within FIG. 49, the cam 160 may then be pivotally mounted to the shaft/handle member 140, with the hole 164 of the cam being received upon the shaft 143 of the shaft/handle member. Next, as shown in FIG. 50, the driving plate 180 may then be fixedly mounted to the shaft/handle member 140, with the rectangular shaped opening 184 of the driving plate being received upon the rectangular shaped protrusion 144 of a shaft/handle member. The driving plate 180 may be fixedly secured thereto using any attachment means known in the art, including, but no limited to, adhesive, mechanical fasteners, etc.

Being so assembled, the cam 160 is configured to be rotated, through rotation of the shaft/handle member 140, in a first direction out of the housing opening 144 into an extended position for the walls 165/166 to engage the keeper to lock, the sash window(s) in the locked cam position, which extended cam position may be seen in FIGS. 61-70.

With the cam 160 in the locked (extended) position, the compression spring 190 biases the plate member 150 for its curved surface 153C to be aligned and engaged with the first recess 141 of the shaft 143 of the shaft/handle member 140 (FIG. 71A), and for protrusion 154 of the plate member 150 to be to be received within the first shaped opening 161 of the cam 160 (FIG. 71B).

With the cam 160 in the locked (extended) position, upon rotation of the shaft in the second direction (see arrows in FIG. 71A), in order to begin refraction of the cam 160 within the housing cavity to unlock the sash window(s), the first transition surface 141Ti of the shaft 143 of the shaft/handle member 140 contacts the curved surface 153C of the plate member 153 and acts as a cam surface to oppose the spring bias and drive the plate member to slide within the housing recess 122. This simultaneously causes the protrusion 154 of the plate member 150 to be withdrawn from the first shaped opening 161 of the cam 160 (FIG. 71B), for the cam 160 to then be unlatched. Prior to being unlatched, the cam could not be forced to retract by being jimmied from the exterior by a person seeking to gain unauthorized entry through the locked window. Also, the initial independent rotation of the shaft/handle member 140 for approximately 50 degrees similarly operates to prevent a forced entry by a person that may attempt to actuate the handle from the outside using a special tool (e.g., a slim jim).

Once the shaft/handle member 140 has been rotated the requisite amount (e.g., 50 degrees—see FIG. 72), the first side 187*i* of the protrusion 187 of the driving plate 180 may contact the first end 167*i* of the arcuate recess 167 in the cam 160, and may begin to drive the cam to co-rotate with further rotation of the shaft/handle member 140. The co-rotation may continue (e.g., to the 120 or 140 degree position—see FIG. 73) for the cam 160 to be retracted within the housing cavity, to unlock the sash window(s), with respect to the keeper.

Figure 63:
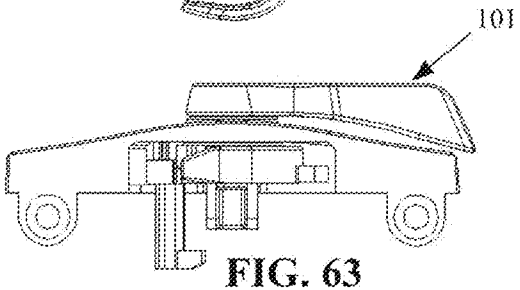
FIG. 63 is a front view of the sash lock assembly shown in FIG. 61.

When the shaft/handle member 140 has been rotated to be at the 150 degree position, the curved surface 153C of the plate member 153 may become aligned with, and be biased to be received within, the beginning of the second (oversized) recess 142 of the shaft 143 of the shaft/handle member 140. Upon being biased into such contact, the protrusion 154 of the plate member may extend to be received within a portion of the large second opening 162 of the cam 160 (FIG. 63). Such contact from the biasing of the plate member 153 may provide a tactile indication to the user of the shaft/handle member position, and an indication of the latch member being in a cocked ("trigger") position, which is discussed hereinafter. The cam is then "latched/" but only in the sense that it is limited to a range of rotational movement (i.e., it is not completely inhibited from any rotational movement), because of the larger size of the second shaped opening 162 of the cam (compare opening 161 and opening 162 of the cam 160 in FIG. 20).

With the cam 160 in the unlocked (retracted) position, upon counter-rotation of the shaft/handle member 140 in the first direction, in order to extend the cam out from the housing cavity to lock the sash window with respect to the keeper, the transition surface 142Ti of the shaft 143 of the shaft/handle member 140 may contact the curved surface 153C of the plate member 153, and may again act as a cam surface to oppose the spring bias and drive the plate member to slide within the housing recess 122. This may cause the protrusion 154 of the plate member 150 to be withdrawn from the second shaped opening 162 of the cam 160.

Figure 57:
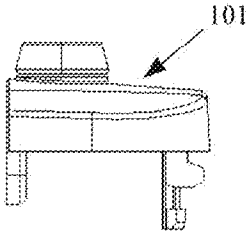
FIG. 57 is a second side view of the sash lock assembly shown in FIG. 51.
Figure 58:
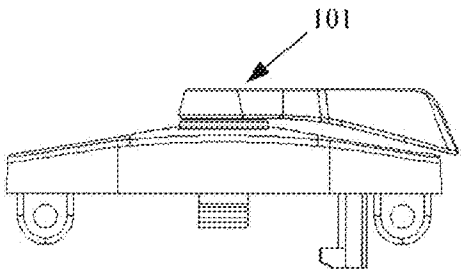
FIG. 58 is a rear view of the sash lock assembly of shown in FIG. 51.
Figure 55:
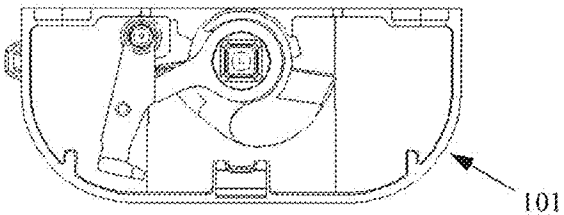
FIG. 55 is a bottom view of the sash lock assembly shown in FIG. 51.
Figure 60:
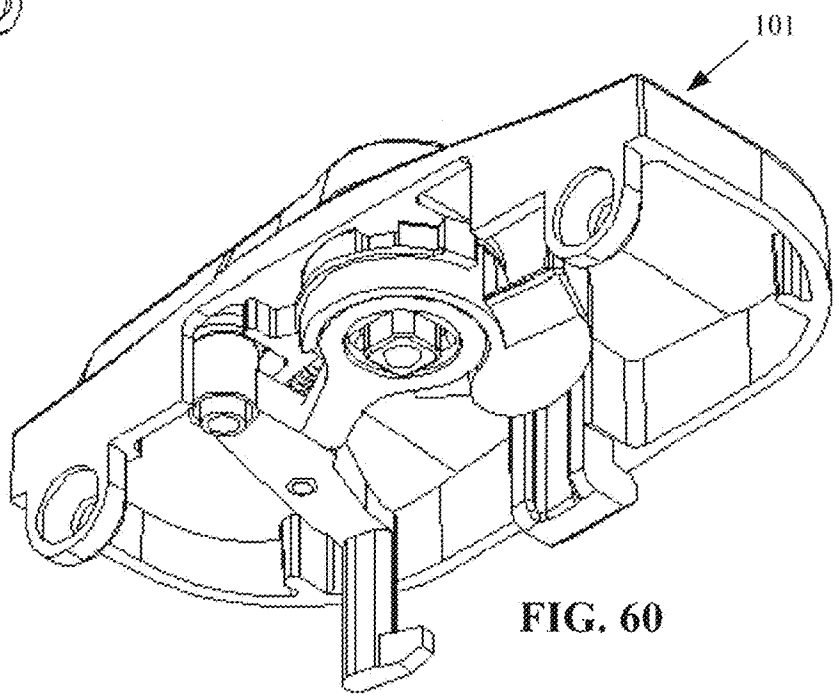
FIG. 60 is a fourth perspective view of the sash lock assembly as shown in FIG. 51.
Figure 59:
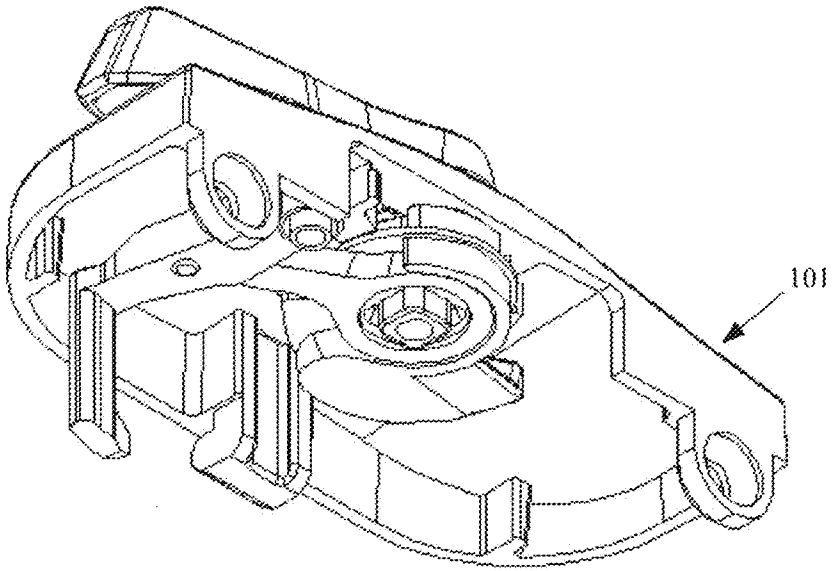
FIG. 59 is a third perspective view of the sash lock assembly as shown in FIG. 51.
Figure 62:
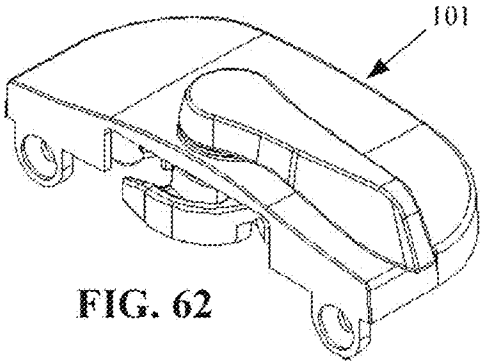
FIG. 62 is a second perspective view of the sash lock assembly as shown in FIG. 61.
Figure 68:
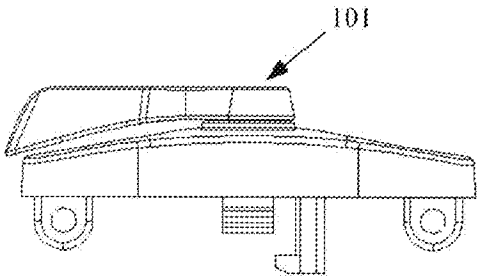
FIG. 68 is a rear view of the sash lock assembly of shown in FIG. 61.
Figure 67:
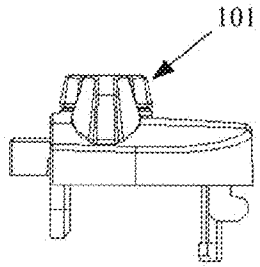
FIG. 67 is a second side view of the sash lock assembly shown in FIG. 61.
Figure 64:
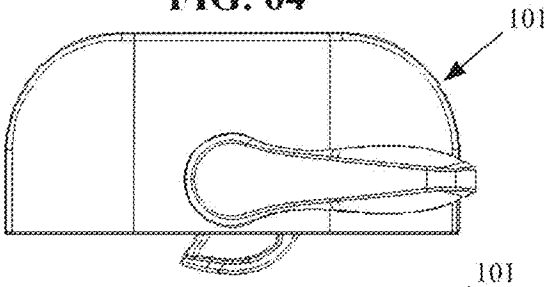
FIG. 64 is a top view of the sash lock assembly shown in FIG. 61.

Once the shaft/handle member 140 has been further counter-rotated sufficiently in the first direction, the second side 187*ii* of the protrusion 187 of the driving plate 180 may contact the second end 167*ii* of the arcuate recess 167 in the cam 160, and may again drive the cam to co-rotate. The co-rotation may continue until the cam 160 has been extended out from the housing cavity for the walls 165/166 of the cam 160 to again engage the keeper and lock the sash window(s), which may limit rotation of the cam. Alternatively, the co-rotation may be limited by the protrusion 168 on the cam 160 contacting the corresponding housing stop feature (see FIG. 71C). When the shaft/handle member 140 has driven the cam 160 into the extended position, the curved surface 153C of the plate member 153 may once again become aligned with, and be biased to be received within the first recess 141 of the shaft 143 of the shaft/handle member 140, as seen in FIG. 71A. Upon being biased into such contact, the protrusion 154 of the plate member may simultaneously extend to again be received within the first shaped opening 161 of the cam 160 (FIG. 57), for the cam to again be latched, and prevent a forced entry.

Figure 79:
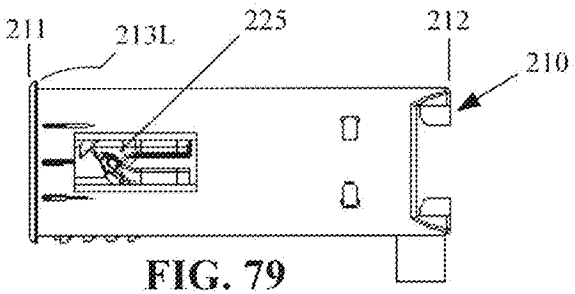
FIG. 79 is a first side view of the latch housing of FIG. 78.
Figure 81:
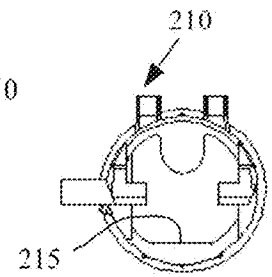
FIG. 81 is a first end view of the latch housing of FIG. 78.
Figure 78:
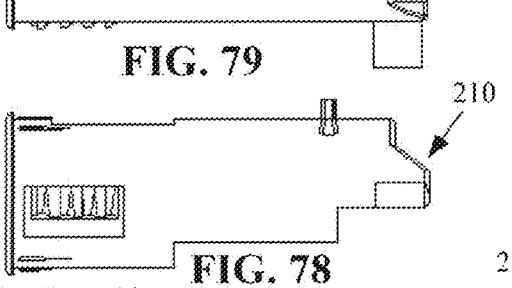
FIG. 78 is a top view of the latch housing of FIG. 76.
Figure 82:
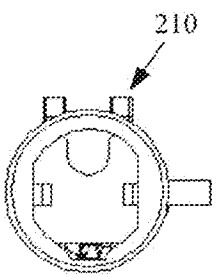
FIG. 82 is a second end view of the latch housing of FIG. 78.
Figure 83:
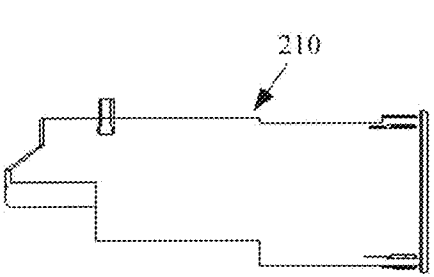
FIG. 83 is a bottom view of the latch housing of FIG. 78.

The latch assembly 201 may include a latch housing 210, shown in FIGS. 77A to 83, which may have a simple exterior surface (e.g., generally cylindrical), the complement of which may be easily formed (e.g., bored) into the sliding sash window frame, to permit ease of its installation therein. However, the housing 210 is not limited to the shape illustrated within those figures, and could take on many different appropriate shapes, including an elongated rectangular shape. However, at least a portion of the housing 210 may be desirably shaped to have a cylindrical outer surface 213, which may span from a first end 211 to second end 212 (FIG. 79). At the first end 211 of the housing 210, the cylindrical outer surface 213 may transition into a protruding lip 213C. A portion of the cylindrical outer surface 213 may also have a series of successive teeth (e.g., 214A, 214B, 214C, 214D, etc.) formed thereon, that may be used for securing of the housing within the hole that is bored/formed in the window rail. The housing 210 may be hollowed out to form an interior surface 215. Protruding inward from the interior surface 215 may be one stop 216A or a pair of stops (e.g., 216A and 216B). A wall 218 may protrude inward to obstruct a portion of the hollowed out interior between the first end 211 and the second end 212. The housing 210 may also include a contoured track 225 formed on a portion of the interior surface 215, as shown within FIG. 79 and the enlarged view of FIG. 141A. The track 225 of housing 210 may act as a cam surface, which is discussed further hereinafter. The housing 210 being so formed may slidably receive a latch member 250 therein.

Figure 84:
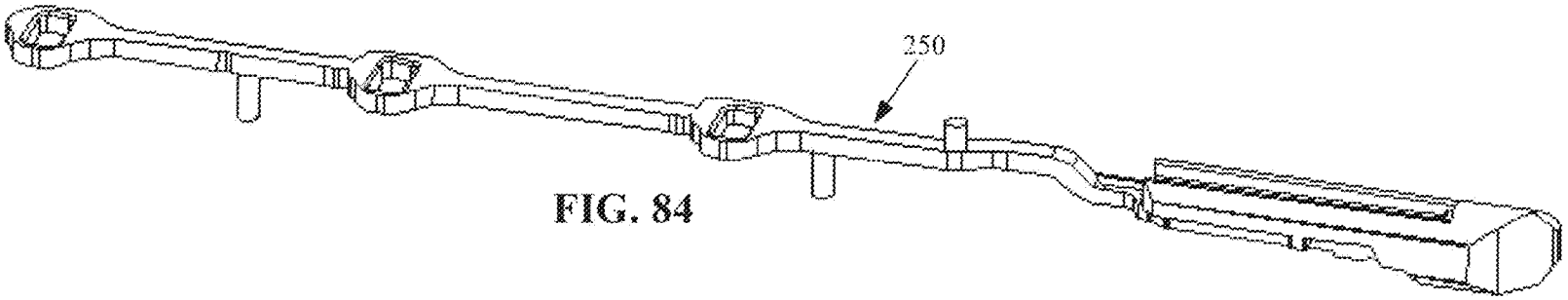
FIG. 84 is a first perspective view of a latch member used in the latch assembly of FIG. 1.
Figure 85:
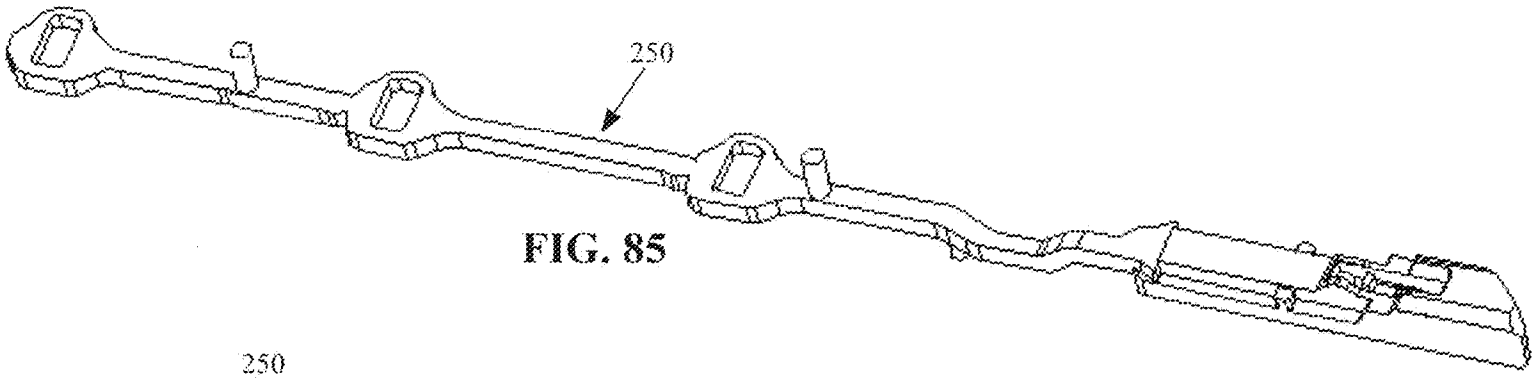
FIG. 85 is a second perspective view of the latch member used in the latch assembly of FIG. 1.
Figure 86:
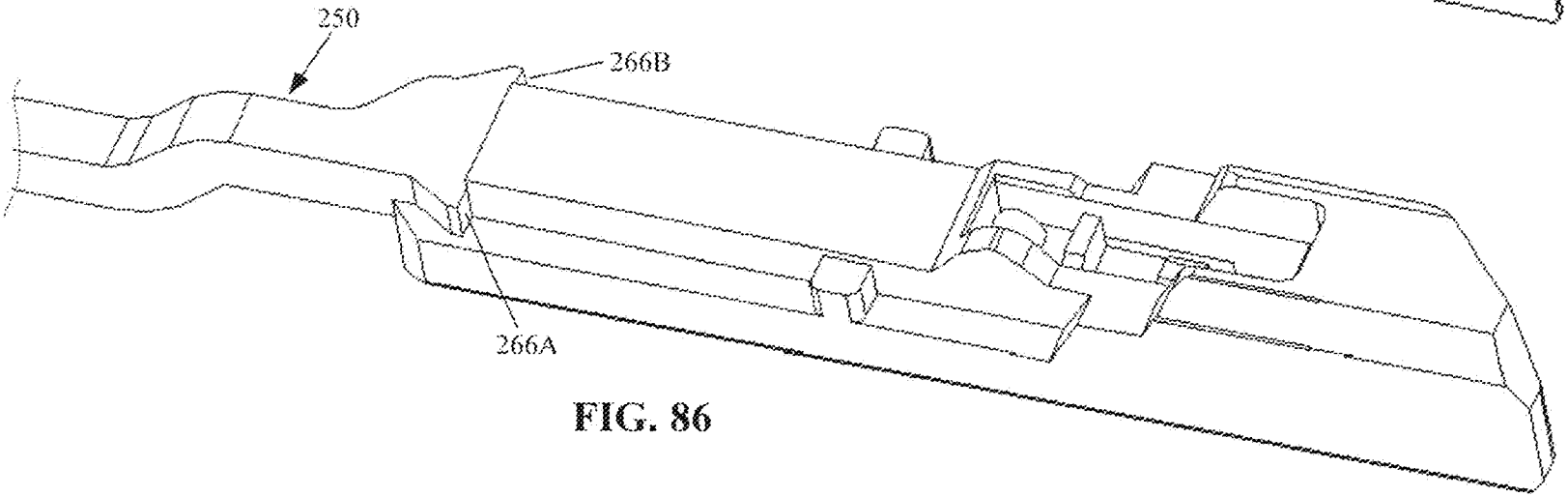
FIG. 86 is an enlarged detail view of one end of the latch member of FIG. 85.

Perspective views of the latch member 250 are shown in FIGS. 84-86, while corresponding orthogonal views are shown in FIGS. 87-91. The latch member 250 may extend from first end 251 to second end 252, and may include a tongue 253 that may begin at the first end of the latch member and extend only part way to its second end. The tongue 253 may have a generally flat engagement surface 254E that may engage the track of the master window frame to prevent outward tilting of the sliding sash window, and it may also have an angled surface 254A that tapers toward the engagement surface 254E to create an apex. The angled surface 254A may be used, upon contact with the master window frame, to oppose biasing of the latch member and assist in driving the latch member into a retracted position within the latch housing 210, until the tongue enters the track of the master window frame, and is biased back into its extended position to have the engagement surface 254E re-engage the track for the window to be slidable with respect to the track of the master window frame. The tongue 253 may also have one stop 266A protruding therefrom (FIG. 86) or a pair of stops (e.g., 266A and 266B). Extending away from the tongue 253 may be an elongated beam 255 that may be flexible.

Figure 88:
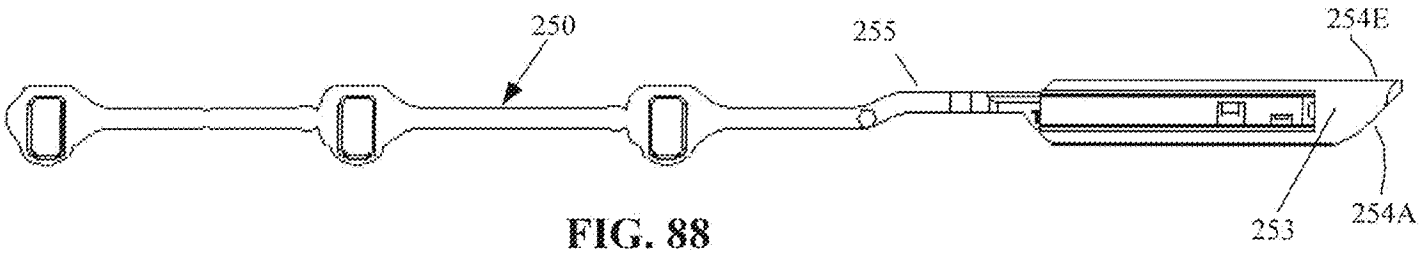
FIG. 88 is a top view of the latch member of FIG. 87.
Figure 87:
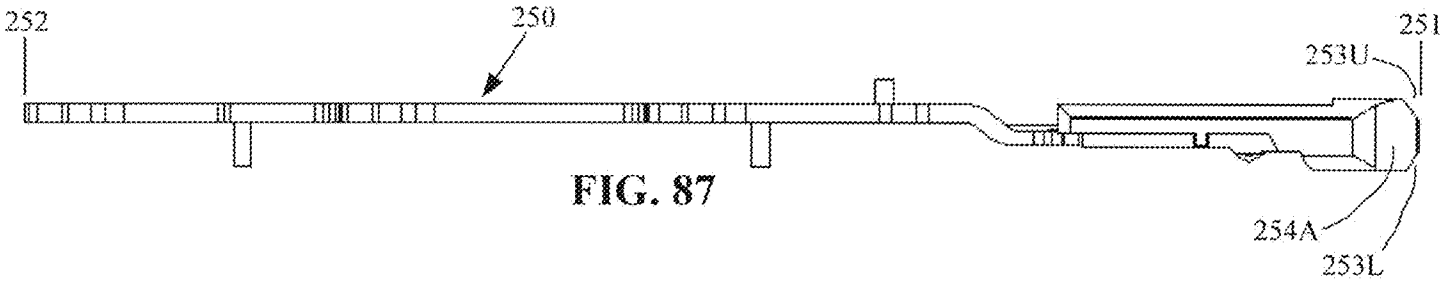
FIG. 87 is a first side view of the latch member of FIG. 84.
Figure 89:
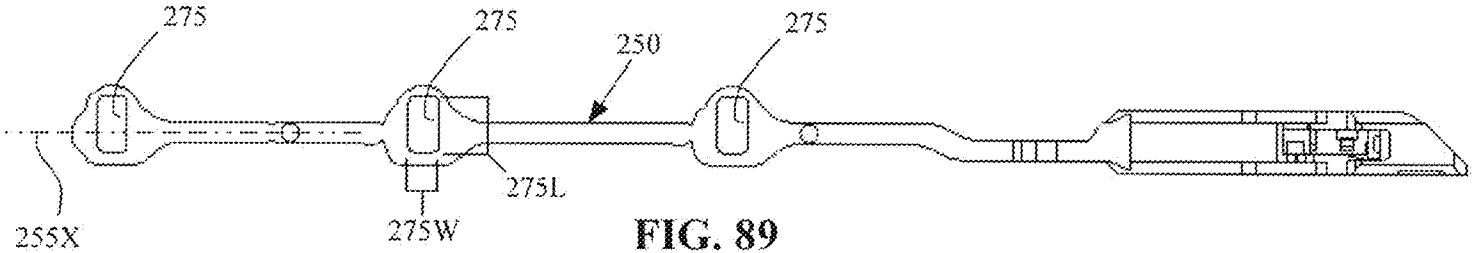
FIG. 89 is a bottom view of the latch member of FIG. 87.
Figure 90:
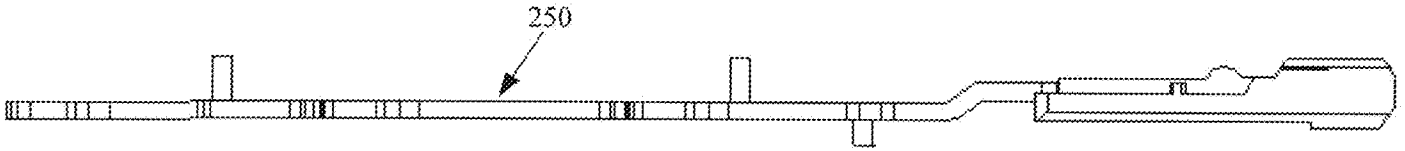
FIG. 90 is a second side view of the latch member of FIG. 87.
Figure 91:
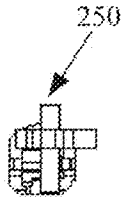
FIG. 91 is an end view of the latch member of FIG. 87.

The generally slender beam 255 may transition and widen at one or more locations to form peripheral walls about one or more openings (e.g., openings 275A, 275B, and 275C), the size of which may depend upon the size of the elongated cross-sectional shape used for the post 176 of the lever arm 170 of the lock assembly 101, to provide for engagement of the post with the latch, assembly. The opening(s) 275A/275B/275C may each be formed into an elongated shape, which may, for example, be generally rectangular-shaped, as shown in FIGS. 88 and 89. The elongated opening may be oriented so that the longer direction of the opening is substantially perpendicular to an axis 255X of the beam 255. Each of the rectangular-shaped openings 275A/275B/275C may have a length 275L that may extend substantially normal to the axial direction 255X of the beam, and a width 275W that may extend substantially parallel to the axial direction of the beam. The internal corners of the rectangular openings 275A/275B/275C may each be radiused.

Figure 92:
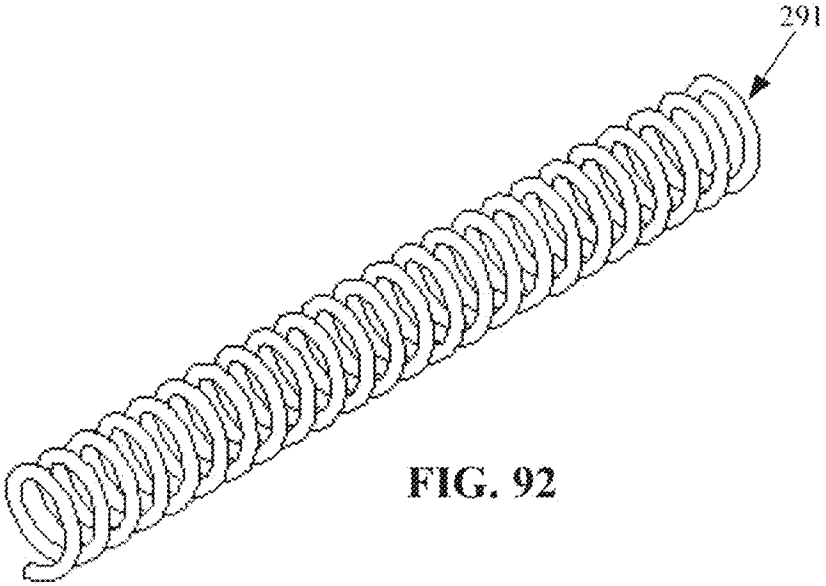
FIG. 92 is a perspective view of a spring used in the latch assembly of FIG. 1.
Figure 93:
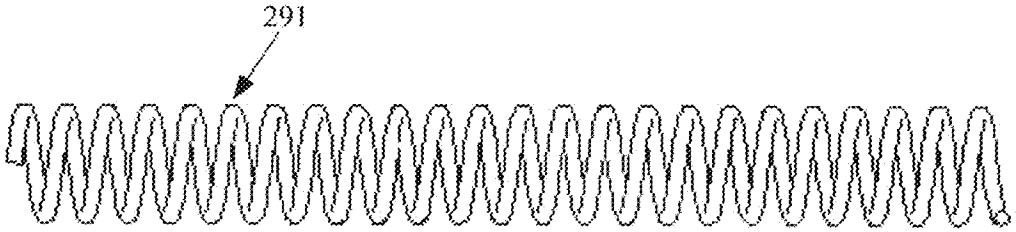
FIG. 93 is a side view of the spring of FIG. 92.
Figure 94:
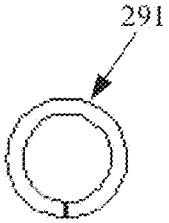
FIG. 94 is an end view of the spring of FIG. 93.
Figure 95:
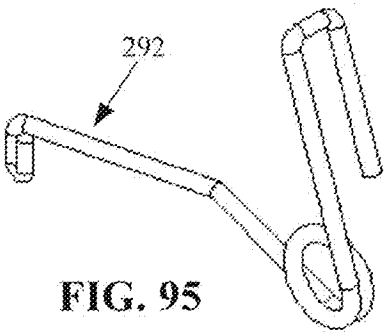
FIG. 95 is a perspective view of a flexible follower member of the latch assembly of FIG. 1.
Figure 101:
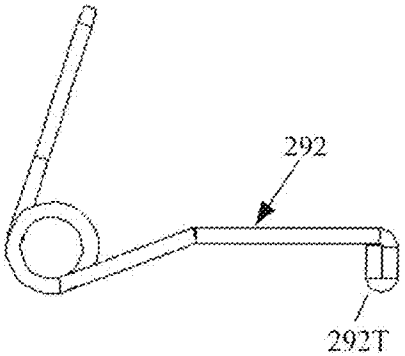
FIG. 101 is a rear view of the flexible follower member of FIG. 95.
Figure 100:
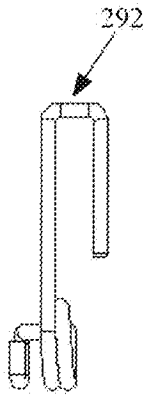
FIG. 100 is a second end view of the flexible follower member of FIG. 95.
Figure 97:
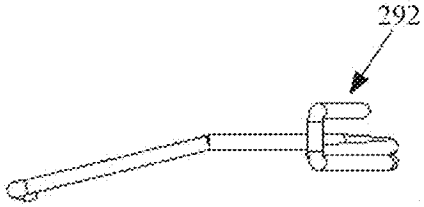
FIG. 97 is a first side view of the flexible follower member of FIG. 95.
Figure 96:
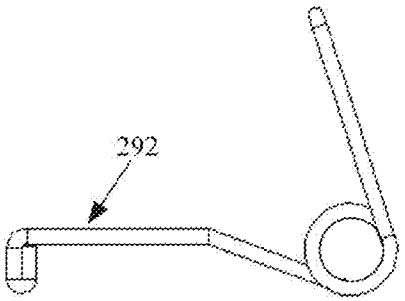
FIG. 96 is a front view of the flexible follower member of FIG. 95.
Figure 98:
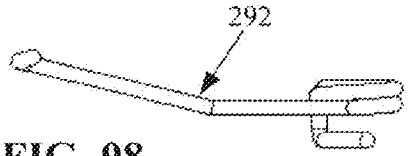
FIG. 98 is a second side view of the flexible follower member of FIG. 95.
Figure 99:
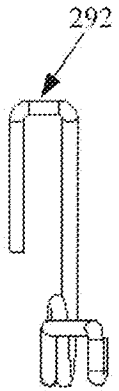
FIG. 99 is a first end view of the flexible follower member of FIG. 95.

Biasing of the slidable latch member 250 relative to the housing 210 may be through the use of a suitably arranged tension spring, or a compression spring. To simplify the presentation, the figures herein only depict an embodiment where a compression spring 291 is utilized. Spring 291 is shown within FIGS. 92-94.

The latch member 250 is may also have a flexible follower member formed integrally therewith or secured thereto. In one embodiment, a separate flexible follower member 292 may be formed as a torsion spring, as shown within FIGS. 95-101. In one embodiment, the latch member 250 may also include a post 256 and flange 257 (FIG. 103) that are configured to secure the flexible follower member 292 thereto to form a latch sub-assembly, which, along with the helical spring 291, may be received within the housing 216 to form the latch assembly 201. Other methods of securing the flexible follower member to the latch member 250 may alternatively be used (i.e., by being cantilevered therefrom, or by being bonded thereto).

Figure 76:
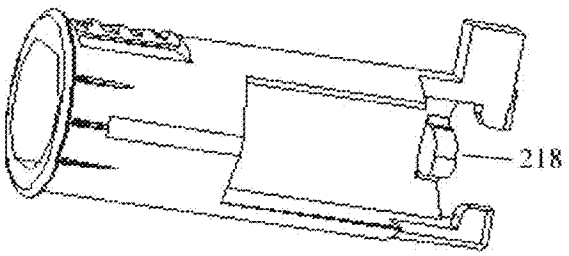
FIG. 76 is a first perspective view of a housing used to house the component parts of the latch assembly of FIG. 1.
Figure 77A:
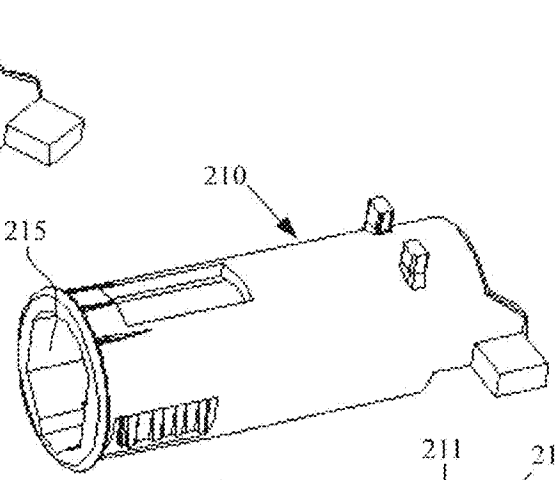
FIG. 77A is a second perspective view of the housing used to house the component parts of the latch assembly of FIG. 1.
Figure 77B:
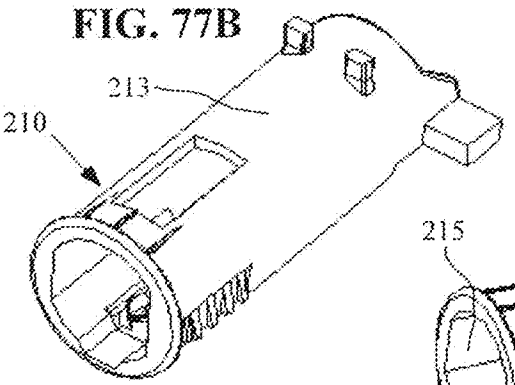
FIG. 77B is a third perspective view of the housing used to house the component parts of the latch assembly of FIG. 1.
Figure 80:
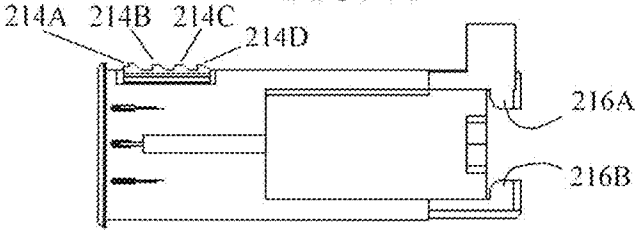
FIG. 80 is a second side view of the latch housing of FIG. 78.
Figure 79A:
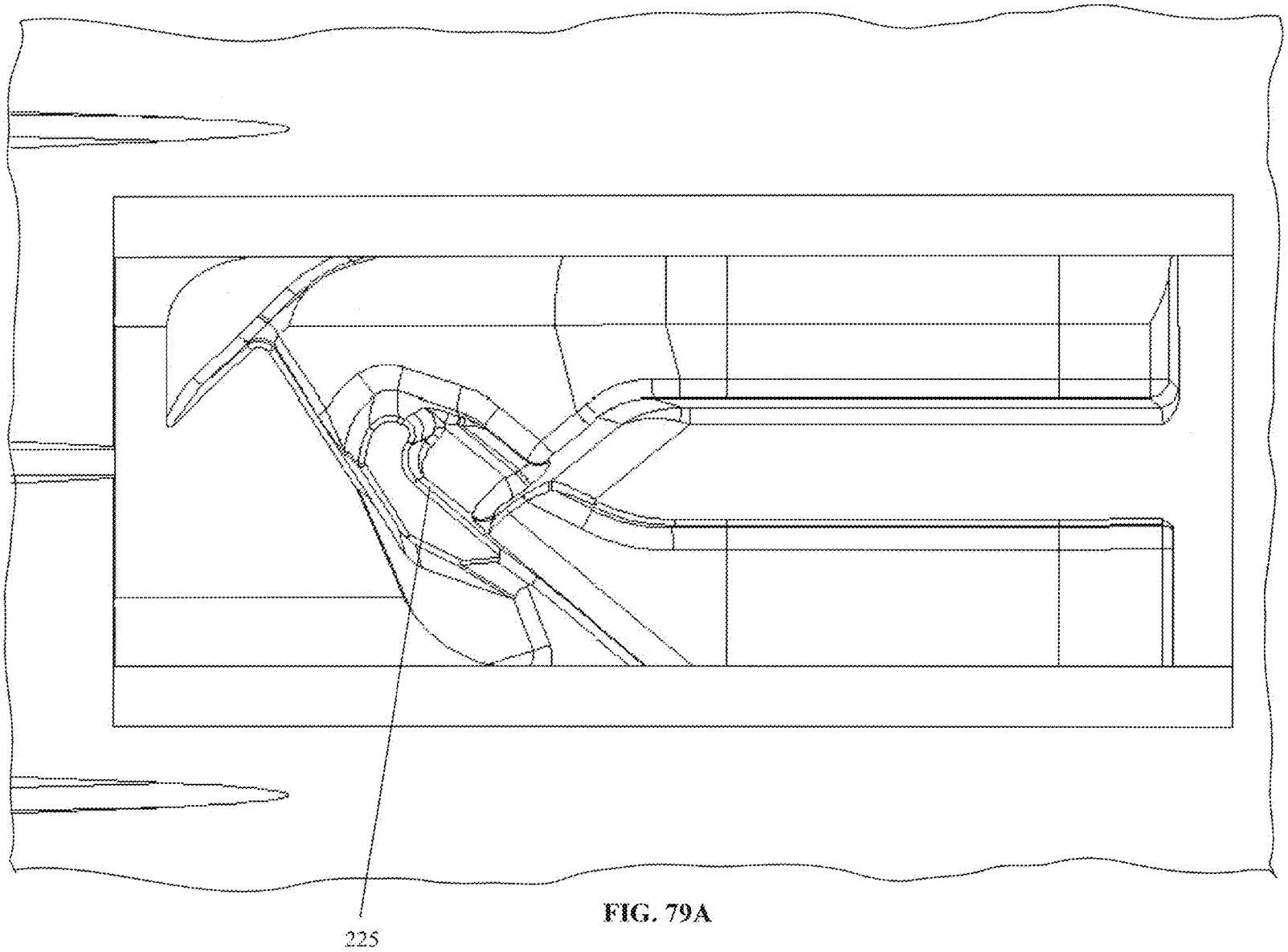
FIG. 79A is a detail view of an exposed interior portion of the latch housing, as shown in FIG. 79, and shows an enlarged depiction of the contoured track formed therein.
Figure 102:
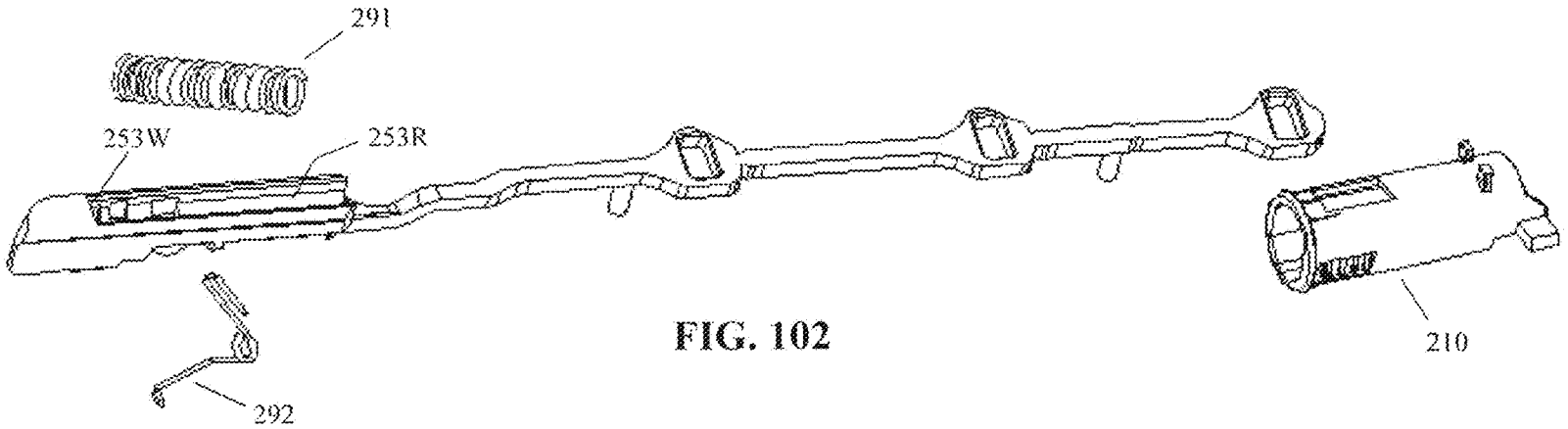
FIG. 102 is an exploded view of the component parts of the latch assembly of FIG. 1, which includes the latch member of FIG. 84, the latch housing of FIG. 76, the spring of FIG. 92, and the flexible follower member of FIG. 95.
Figure 113:
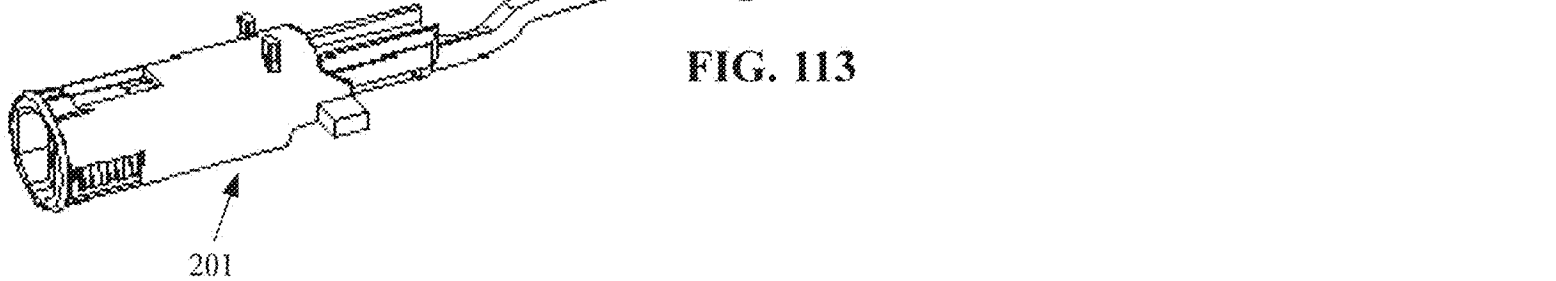
FIG. 113 is a fourth perspective view of the latch assembly of FIG. 1, shown with the latch member in the retracted position.

Assembly of the helical compression spring 291 and the latch member 250 may be understood, in part, from the exploded view of FIG. 102. The helical spring 291 may be nested in a recess 253R proximate to the first end 251 of the latch member 250. One end of the spring may act upon the wall 253W of the tongue 253, while the other end of the compression spring may act upon a wall of the housing 210 (e.g., wall 218 shown in FIG. 76), to bias the tongue to protrude out from the latch housing, as shown in FIGS. 105-112. The extent that biasing by spring 291 may cause the tongue 253 to protrude out from the housing 210 may be limited by the stops 266A and 266B on the tongue (FIG. 86) contacting the stops 216A and 216B on the latch housing (FIG. 80). Actuation of the latch member 250 relative to the housing 210 may cause some, or all of the tongue to retract within the interior of the housing, as seen in FIG. 113.

Figure 104:
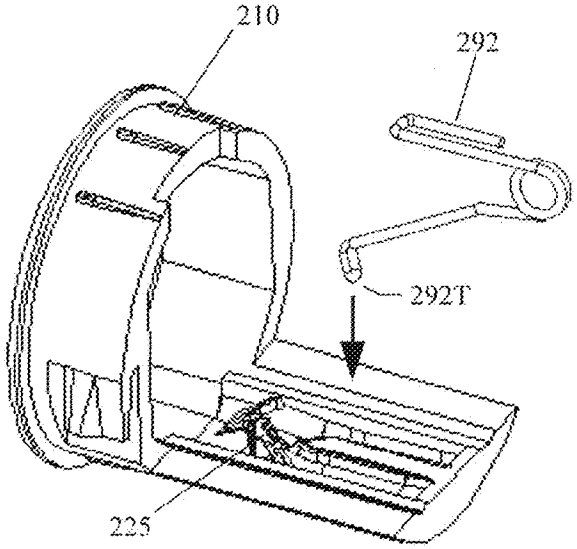
FIG. 104 is an exploded view illustrating a tip portion of the flexible follower member of FIG. 95 that is configured to engage the contoured track of the latch housing shown in detail in FIG. 79A, within the latch assembly of FIG. 1, which contoured track may act as a cam surface with respect to the flexible follower member.
Figure 103:
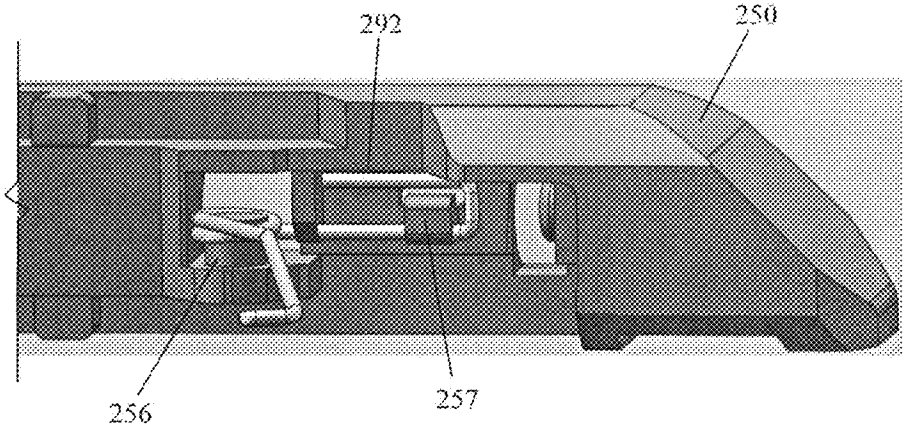
FIG. 103 is a perspective view showing the flexible follower member of FIG. 95, after being installed into the end of the latch member of FIG. 86.
Figure 105:
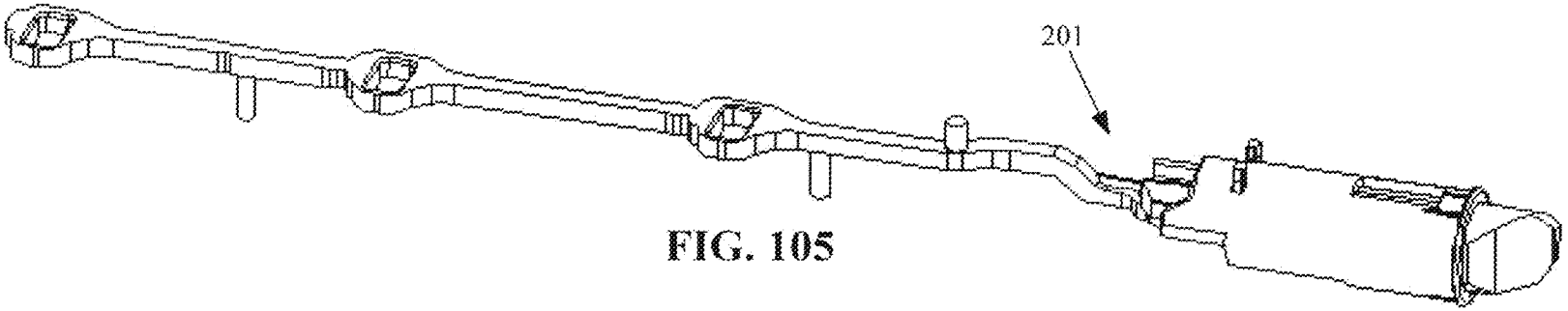
FIG. 105 is a perspective showing the latch member, the helical spring, the flexible follower member, and the latch housing after being assembled together to form the latch assembly of FIG. 1, with the latch member shown biased into its extended position.
Figure 106:
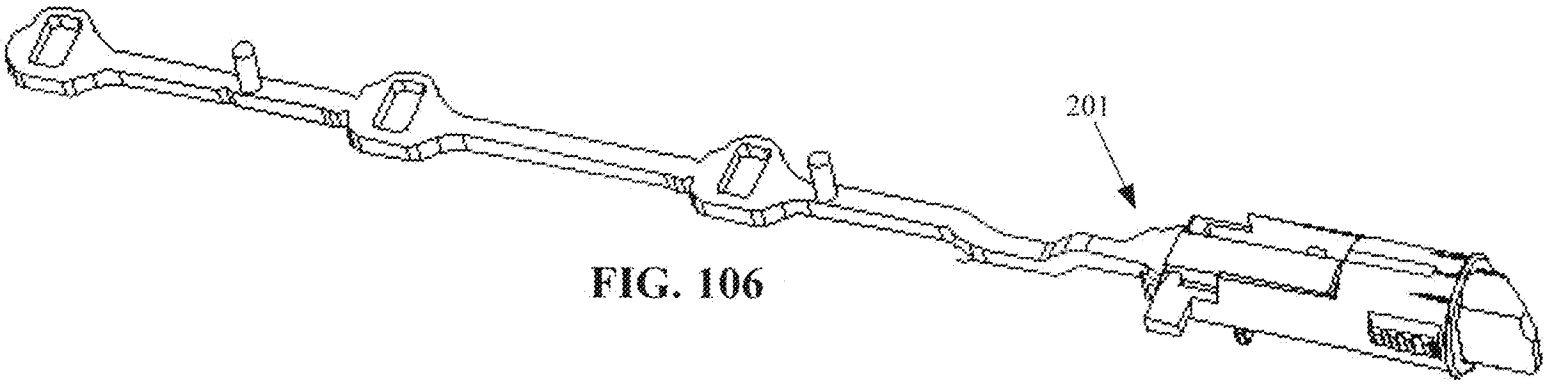
FIG. 106 is a second perspective view of the latch assembly of FIG. 1.
Figure 108:
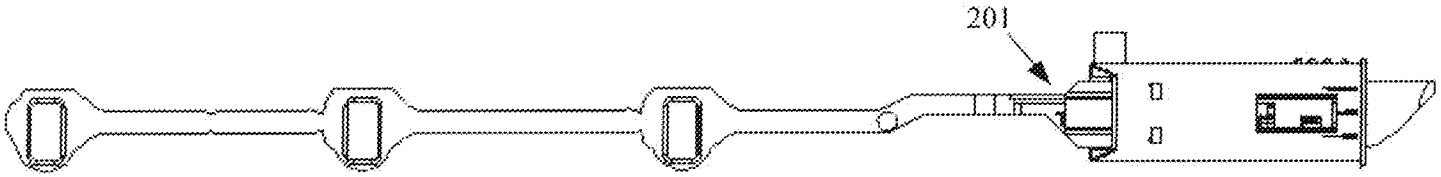
FIG. 108 is a top view of the latch assembly of FIG. 107.
Figure 107:
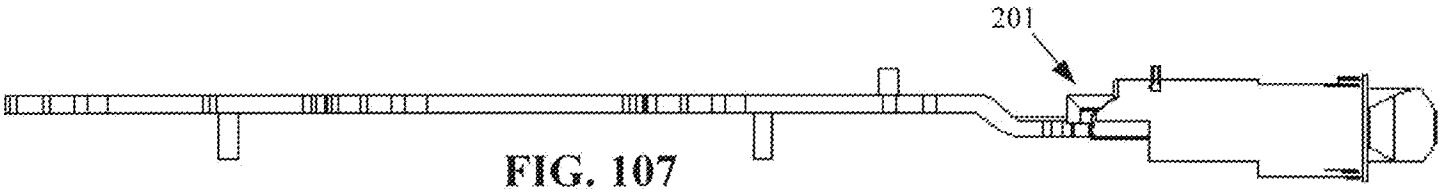
FIG. 107 is a first side view of the latch assembly of FIG. 105.
Figure 109:
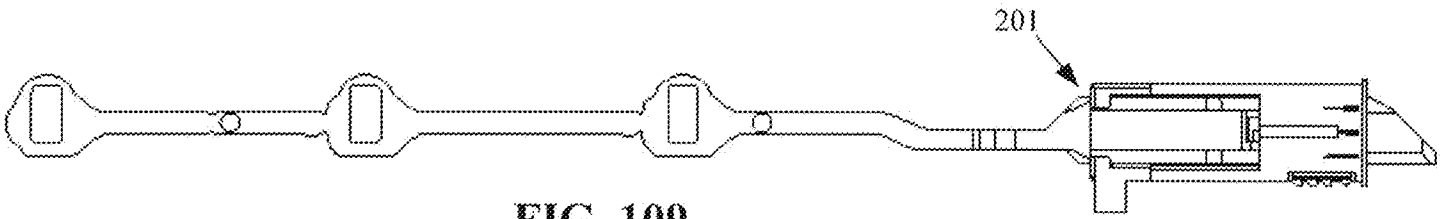
FIG. 109 is a bottom view of the latch assembly of FIG. 107.
Figure 110:
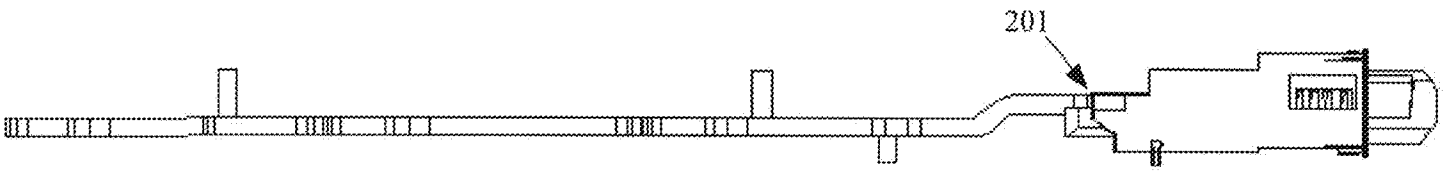
FIG. 110 is a second side view of the latch assembly shown in FIG. 107.
Figure 111:
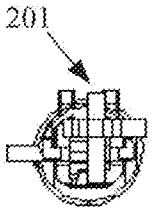
FIG. 111 is an end view of the latch member of FIG. 107.
Figure 112:
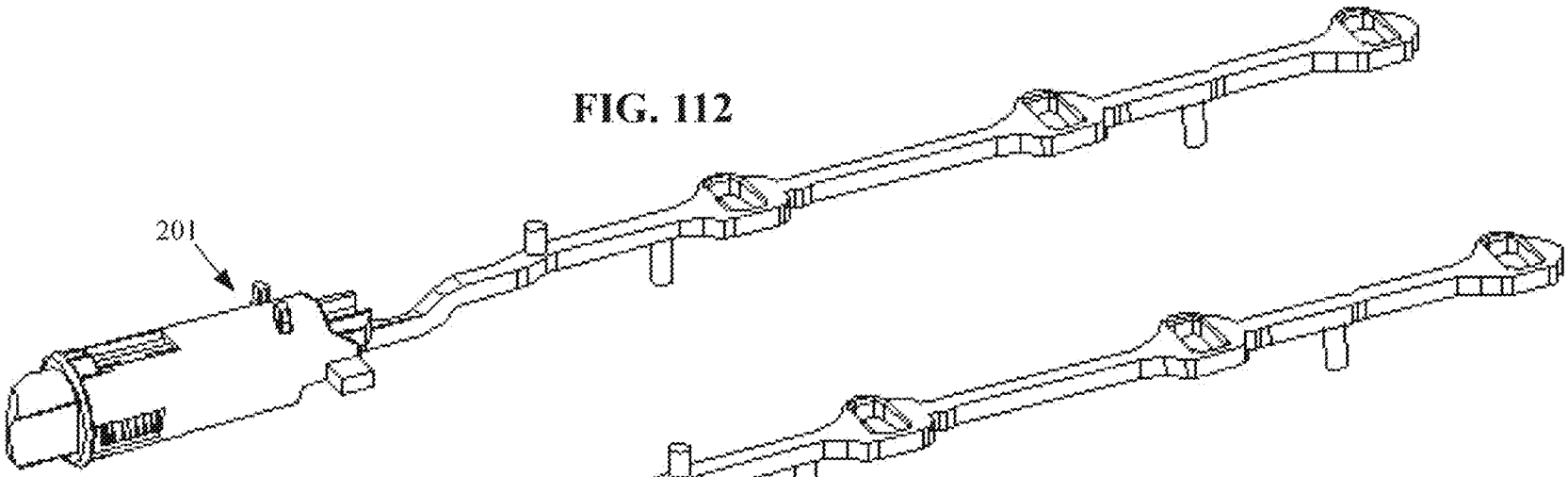
FIG. 112 is a third perspective view of the latch assembly of FIG. 1, shown with the latch member in the extended position.

When the latch sub-assembly shown in FIG. 103 and the compression spring 291 are installed within the latch housing 210, the flexible follower member 292 (see FIG. 104) may be positioned to selectively contact the track 225 within the latch housing 210. The latch assembly 201 is thus configured so that the tongue portion of the latch member may occupy the extended position (FIG. 112), or the retracted position (FIG. 113), or, when limited by selective contact of a tip portion of the flexible follower member 292 with a particular nest region of the track 225, as discussed hereinafter (see FIGS. 114-114G), it may occupy a partially extended position (compare FIG. 133 with FIG. 125). This cycling of the flexible follower member 292 with the particular nest region of the track 225 may be the same or similar to (e.g., it may have slightly different angular values from) that which is taught within Applicant's co-pending application Ser. No. 15/397,968, all disclosures of which are incorporated herein by reference.

A suitable stepped stop member 301 may be mounted to the master window frame, for use in combination with the latch, assembly 201 and the sash lock 101. One possible embodiment of stop member 301 is defined in FIGS. 115-121, and may include a first ("lower") step/protrusion 330L, and a second ("upper") step/protrusion 330U. (Note that instead of the dual protrusion stop member 301, two separate stop members may be used, each of which may be separately mounted to the master window frame, or alternatively, only a single stepped stop member may be used).

To accommodate installation of the latch assembly 201, the sash window frame 400, as illustrated in FIG. 122, may have an opening 410 on one side of the window frame. The sliding sash window 400 may have a horizontal meeting rail 401, a first vertical stile 402 extending downward therefrom, and a second stile (not shown) and a bottom rail (not shown), which may form a frame to support a glazing therein. The end of the latch assembly 201 may be received through the opening 410 in the frame of the sash window 400, to be as seen in FIG. 123 and FIG. 125.

To accommodate installation of the sash lock assembly 101, the top of the meeting rail 401 may have an elongated opening 412 formed therein (FIG. 122), adjacent to which may be a second opening 413. The elongated opening 412 may be shaped and positioned to suitably provide clearance for the post 176 of the lever arm 170 to be inserted therein during installation of the sash lock on the meeting rail, and to provide clearance for its movement experienced when the shaft/handle member 140 is pivoted, e.g., between the zero degree position (FIG. 71C) and the 180 degree position (FIG. 75). The elongated opening 412 may also accommodate securing of the leg 117 of the housing 110 of the sash lock 101 thereto. The second opening 413 may be formed to accommodate the protrusions 115/116 of the housing 110 of the sash lock 101, and the securing of fasteners through the holes 115H/116H in those protrusions.

The suitable opening (e.g., 275A, 275B, or 275C) on the latch member 250 of the latch assembly 201 may be coordinated with and properly positioned for alignment below the top opening 412 in the meeting rail 401 of the window frame 400 (see FIG. 123). For the frame of the sash window 400 shown in FIG. 122, the elongated opening 412 in the meeting rail 401 may be positioned a particular distance away from the end of the window frame, which may accommodate alignment with opening 275B of the latch assembly 201 shown therein. For a larger window, the elongated opening in the top of the meeting rail may be more appropriately positioned to be a greater distance away from the end of the window frame, and may thus be positioned for alignment with opening 275C of the latch assembly 201. Similarly, for a smaller window, the elongated opening in the top of the meeting rail may be positioned a smaller distance away from the end of the window frame, and may be positioned for alignment with opening 275A of the latch assembly 201.

During installation of the sash lock assembly 101 upon the frame of the sash window 400, the post 176 of the lever firm 170 may be received through the opening 412 in the top of the meeting rail 401. However, because of the elongated cross-sectional shape of the post 176 (see FIG. 23), and because of the protrusion 177 protruding laterally therefrom, for the post to also be received through the elongated opening 275B of the latch member 250 of the latch assembly 201, the sash lock 101 should be positioned substantially transverse to the axial direction 401AX of the meeting rail 401. Such initial positioning may orient the long transverse direction of the post 176 and the protrusion 177 of lever arm 170 to be perpendicular to the axial direction 401AX of the meeting rail 401, so that it may initially be generally in-line with the lengthwise side 275L of the rectangular opening 275B in the latch member 250.

After insertion of the post 76 through the opening 312 in the top of the meeting rail 401 and through the rectangular opening 275B of the latch member 250, the sash lock assembly 101 may then be rotated roughly 90 degrees, and then may be lowered for the bottom surface 121 of the sash lock housing 110 to contact and be flush with the top of the meeting rail. The 90 degree rotation of the sash lock assembly 100 just prior to its mounting of the sash lock to the meeting rail may orient the long transverse direction of the elongated post 176 of lever arm 170 to be generally in-line with the width 275W of the rectangular opening 275A in the latch member 250. The extent of the elongated post 176 of lever arm 170 and the extent of the width 275W of the rectangular opening 275A in the latch member 250 may be coordinated to have a small amount of play therebetween, or to substantially eliminate any play therebetween (i.e., the arrangement may form a friction fit). Thus, driven movement of the post 176 of the lever arm 170 by the driving plate 180 of the sash lock 101 may actuate the latch member 250 of the latch assembly 201, and vice versa, because of the interconnection therebetween. The protrusion 177 may serve to prevent disconnection of the post 176 of the lever arm from the opening 275B in the latch member (i.e., it may prevent the latch member from dropping below the post).

The sash lock assembly 101 and the latch assembly 201 are shown installed with respect to the sliding sash window 400, in FIGS. 123-124.

FIGS. 125 and 126 similarly show the sash lock assembly 101 and the latch assembly 201 installed with respect to the sliding sash window 400, and also show the stop member 301 installed within a track 450T of the master window frame 450—the track within which the tongue of the latch member 201 may move for the sash window 400 to be slidable with respect to the master window frame. Note that where two such window fasteners are used on a sash window (i.e., the left-hand fastener shown on the left side of the sash window in FIG. 131, and the right-hand fastener shown on the right side of the sash window in FIG. 132), the arrangement may provide for locking of the sash window at four locations. The sash fastener(s) is/are shown locked and latched in those figures, preventing the sash window from either sliding or tilting, as the sash lock 101 is shown with the shaft/handle member 140 at zero degrees of rotation (FIG. 129), for the cam 150 to be in the extended lock position. In the extended position, the cam engages the keeper 451 (FIG. 126) to prevent sliding/opening of the sash window 400, and with the shaft/handle member 140 at zero degrees of rotation, the post 176 of the sash lock 101 does not oppose the spring 291 from biasing the latch member 250 into its corresponding extended position, so that at least a portion of tongue 253 is disposed within track 450T to furthermore prevent tilting. The sash window 400 may be redundantly locked and prevented from sliding, as the lower protrusion 330L of the stop 330 may be positioned just above the top of the tongue 253 of the latch member 250, to redundantly block any upward movement of the sash window 400 from its closed window position. The positions of the component pasts of the sash lock 101 may be seen in FIGS. 127-129 for the extended cam position. FIG. 130 shows the position of the tip 292T of the flexible follower member 292 with respect to the track 225 of the latch housing 210, when the cam 150 positioned in the extended lock position (i.e., the tip is at point "A" in FIG. 114F).

Next, operation and effect of the movement of the flexible follower member 292 relative to the latch housing 210 is discussed, prior to a more detailed discussion with respect to movements of the sash window.

Figure 114B:
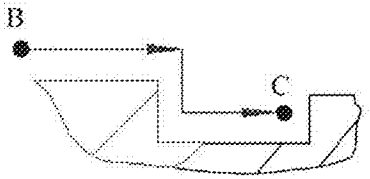
Figure 114A:
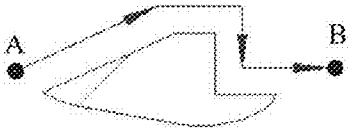
Figure 114G:
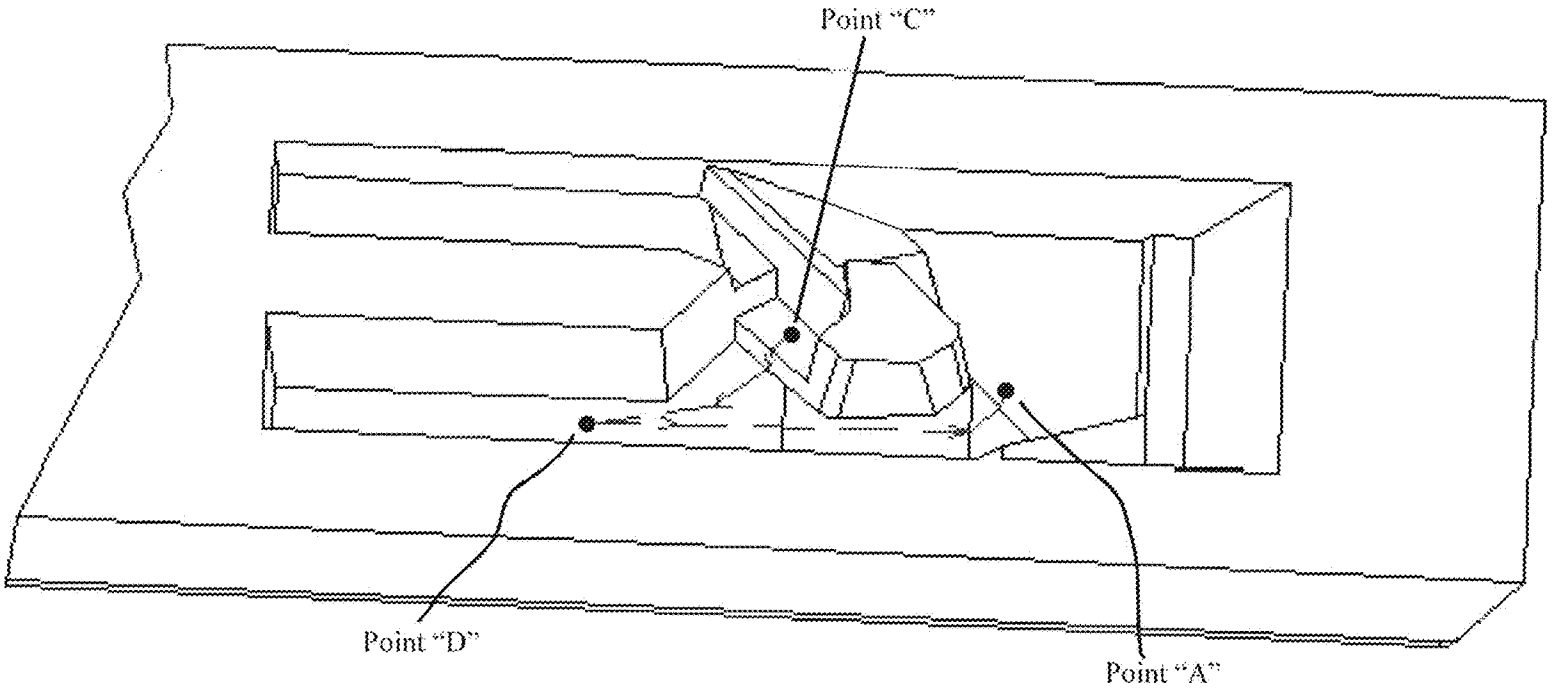
Figure 114E:
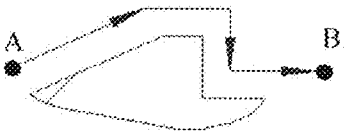
Figure 114D:
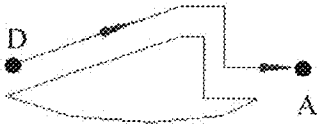

Movement (i.e., cycling) of the latch subassembly (i.e., the latch, member 250 and the flexible follower member 292) relative to the latch, housing 210 may result in the tip 292T of the flexible follower member circumnavigating the track of the latch housing 210 in a unidirectional manner, as shown within FIGS. 114-114G. The discrete positions of the tip 292T of the flexible follower member 292 are represented in those figures as a solid black circle. (Note that in another embodiment, the tip could be more simplified than is shown in FIG. 114, and it may not be formed by a turn in the wire-like member, as the wire-like member may alternatively just terminate in a rounded or hemispherical end).

When the latch member 250 is in the fully extended position (e.g., FIG. 112), the tip 292T of the flexible follower member 292 may occupy the position "A" shown within FIG. 114F. When the outward spring biasing of the latch member 250 is opposed to place it in a retracted position (e.g., FIG. 113), at which the tongue portion need not be fully retracted within the latch housing 210, the tip 292T of the flexible follower member 292 may have moved to occupy the position "B" shown within FIG. 114F. Note that for tilting of the sash window, the tongue portion only needs to be clear of the master window frame when the fastener is installed thereon. Therefore, the retracted position of latch member 250 for cycling of the tilt latch assembly 201 described hereinafter, may, but need not be, different than the retracted position utilized for tilting of the window. The retracted position for cycling of the tilt latch assembly 201 may be slightly less retracted than is used for tilting of the window, so that tilting may not inadvertently occur when the user is merely trying to slide the window open, as the tongue may still remain engaged within the master window track.

Figure 114C:
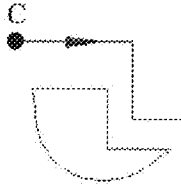

When the opposition to the biasing of the latch member 250 is removed, the latch member is biased outwardly, but its full outward movement may be inhibited at a partially extended position (e.g., FIG. 133), because the tip 292T of the flexible follower member 292 may drop down into a nested position (point "C" shown within FIG. 1114F). It should be apparent from FIG. 114F and FIG. 114G that unidirectional travel of the tip is provided by the wall surfaces of the track shown therein, which walls direct travel of the tip 292T of the flexible follower member 292 so as to prohibit backward movement. The elevation changes and wall surfaces that provide such unidirectional travel are illustrated schematically for one complete circuit within FIGS. 114A-114B and in FIGS. 114C-1114D.

When the outward spring biasing of the latch member 250 is once again opposed to move it at least slightly back towards its retracted position, the tip 292T of the flexible follower member 292 may exit the nested position, but may be directed to move to occupy the position "D" shown within FIG. 114G. When the opposition to the biasing of the latch member 250 is again removed, the latch member may be biased outwardly, and is no longer inhibited from returning to its fully extended position, and tip 292T of the flexible follower member 292 is moved back to the position "A" shown within FIG. 114G, and the tip has completed one full loop around the track. Note that for each of those positions, including Position "B," the extreme distal location of the tip member may be exaggerated within FIG. 114F and other similar figures for the benefit of the reader (compare FIG. 114F with the black circle in FIG. 188C). It may be preferable for the tip 292T of the flexible follower member 292 to immediately drop down into the nested position "C" shown within FIG. 1114F when the shaft handle member 140 reaches 150 degrees of rotation.

For the following discussion with respect to the co-action of the sash lock 101, the latch assembly 201, and the stop member 301, note that the image of the track shown within FIGS. 187C-201C is rotated 180 degrees from its appearance in FIGS. 114F and 114G, so that movement of the tip 292T in the image sequences of FIGS. 187C-201C may correspond to movement of the tongue portion of the latch member 250 as shown within FIGS. 187B-201B.

The co-action between the latch assembly 201 and the stop member 301 may be directed, in part, according the various shaped surfaces for each of the lower protrusion 330L and the upper protrusion 330U of the stop member 301, which may act as a cam surface, with the tongue portion of the latch member being biased into contact therewith to act as a follower. This co-action may cause the tip 292T of the flexible follower member 292 to be cycled through the track to impart specific positioning to the tongue portion of the latch member 250, as the sash window is raised, and/or as it is lowered, as discussed in greater detail hereinafter with respect, to the movement of the sash window.

When, the sash window is closed and the latch member 250 is in the fully extended position (e.g., FIG. 125 and FIG. 187B), the tongue prevents opening/elevating of the sash window because its movement is inhibited by the tongue being positioned immediately below the bottom surface 330Li of the lower protrusion 330L of the stop member 330 (see FIG. 119). As shown in FIG. 125 and FIG. 187B, the shaft/handle member 140 may also be in the locked position (i.e., the zero degrees of rotation shown in FIG. 129), for the cam 160 to engage the keeper 451 installed on the master window frame 450, and thus the window may be redundantly locked (i.e., it may be locked at two places—the cam 160 with respect to keeper 451, and the latch tongue 253 with respect to stop member protrusion 330L). Where two integrated sash lock/tilt latch fasteners of the present invention are used on one window, the window may be locked at four places, which locking positions may be equally spaced with respect to the meeting rail, through use of the appropriate length for the latch member, etc.

When the user desires, to open the sliding sash window, the shaft/handle member 140 may be rotated away from the locked position (i.e., away from the zero degree position) that is shown in FIG. 187A. When the shaft/handle member 140 reaches roughly 50 degrees of rotation (note that other angular displacement may also be used, e.g., 40 degrees, or 60 degrees), the first side 187*i* of the protrusion 187 of the driving plate 180 may have moved (compare its positioning in FIG. 71B to that in FIG. 72) to contact the first end 167*i* of the arcuate recess 167 of the cam 160, so that continued rotation of the shaft/handle member beyond 50 degrees may drive co-rotation of the cam 160.

When the shaft/handle member 140 has been rotated roughly a total of 150 degrees, as shown in FIG. 137 and FIG. 188A (or even slightly beyond), the protrusion 154 of the plate member 150 may be biased to enter the oversized second opening 162 of the cam 160, and the curved surface 152C of the plate member 150 may be received within the recess 142 of the shaft/handle member 140, which may provide tactile indication to the user of the condition of the fastener. (Note that either or both of these features may be used to provide such tactile indication). Since the oversized and radiused second opening 162 of the cam 160 does not "latch" in the sense of preventing any further rotation of the cam, and may merely act as a detent, rotation by the user of the shaft handle member 140 may normally tend to over-travel slightly beyond 150 degrees of rotation, especially if the recess 142 of the shaft/handle member 140 is formed to be fairly shallow, thereby providing modest resistance to such over-travel.

During this rotation of the shaft/handle member 140 to be roughly at 150 degrees of rotation, as it reaches roughly 120 degrees of rotation (see FIG. 73), the first cam surface 181 of the driving plate 180 may initially contact the sculpted follower surface 175S of the arm 175 of lever arm 170, to thereafter drive co-rotation of the arm, with continued rotation of the hsadt/handle/member. As the lever arm 170 is driven to co-rotate, the interconnection of the post 176 of the lever arm with the beam 255 of the latch member 250 (FIG. 1) causes the latch member to retract to be as shown in FIG. 188B, which latch member movement is sufficient for the tip 292T of the flexible follower member 292 to advance on the track 225 of the latch housing 210, over and past the wall shown in FIG. 188C, as the shaft handle member 140 reaches 150 degrees of rotation. Since the tip 292T of the flexible follower member 292 is preloaded into contact with the track 255 of the latch housing 210, once the tip has moved past the wall, it may immediately drop down on its distal side. So upon release of the shaft/handle member 140 by the user (i.e., no further rotation imparted thereto), the driving of the latch beam 255 of latch member 250 through, its interconnection with the post 176 of the lever arm ceases, as the sculpted follower surface 175S of the lever arm 170 is no longer driven by the driving plate 180. The helical spring 291 of the latch assembly 201 is then free to bias the latch member to extend from its retracted position, until such extension, being a small amount, is arrested by the tip 292T of the flexible follower member 292 being received within the nested portion (point "C") of the track, as shown in FIG. 138 and FIG. 189C. The tongue 253 of the latch member 250 is then releasably maintained in the cocked (trigger) position shown in FIG. 133 and FIG. 189B.

The sash window is then unlocked—with respect to the cam 160 and keeper 451, and with respect to the latch member tongue 253 and the lower protrusions 330L of the stop member 301—and may then be opened (e.g., may be elevated). (Note that other angular amounts may be utilized in different embodiments for the sash lock).

As the sash, window is opened/elevated from the closed, window position, as indicated by the upwardly pointing arrow in FIG. 133 and FIG. 189B, the upper surface 253U (FIG. 87) of the tongue 253 (which may be curved or just angled), may contact the shaped surface 330Lii (curved/angled) of the lower protrusion 330L of the stop member 301 (FIG. 119), which contact may drive the latch member 250 to retract. This is represented by the angled arrow shown within FIG. 190B, with the tongue 253 of the latch member 250 shown in FIG. 190B to have retracted slightly. This small driven, amount of retraction of the latch member 250 may be sufficient to trigger release of the latch member, by causing the tip 292T of the flexible follower member 292 to exit from the nest portion of the track (i.e., from point "C"), to move from the position shown in FIG. 189C to the position shown within FIG. 190C. The shaft/handle member 140 may continue to remain at the 150 degree rotation position, as is shown within FIG. 189A and FIG. 190A; however, as seen in FIG. 190A, the sculpted follower surface 175S of the arm 175 has then moved away from contact with the first cam surface 181 of driving plate 180.

Continued opening (e.g., elevating) of the sash window may result in the tongue 253 of the latch member 250 being driven to retract to a distal position, as shown in FIG. 191B, which retraction amount may be based on the extent (i.e., the height) of the apex of the surface 330Lii of the lower protrusion 330 of the stop member 301. During this continued opening of the sash window, the tip 292T of the flexible follower member 292 may continue its movement away from the nest position (away from point "C"), and once the tongue 253 of the latch member 250 reaches the apex, of the surface 330Lii, the tip may reach position "D" (FIG. 191C). The handle still remains in the 150 degree rotation position, as shown within FIG. 191A; however, as seen therein, the sculpted follower surface 175S of the arm 175 has then moved further away (i.e., is further separated) from contact with the first cam surface 181 of driving plate 180.

Continued opening of the sash window may result in the tongue portion of the latch member 250 being driven to extend slightly and to then retract slightly, as the tongue portion successively contacts the surfaces 330Liii, 330Liv, and 330Lv of the lower protrusion 330L, which may be understood from FIGS. 191B, 192B, and 193B. During this continued opening of the window, such contact merely causes the tip 292T of the flexible follower member 292 to oscillate on the same portion of the track, first moving away from and then moving back towards position "D," as seen in FIGS. 191C, 192C, and 193C. (Note that when the sash window is being closed/lowered, such contact with those surfaces 330Liii, 330Liv, and 330Lv is functional with respect to the tip 292T of the flexible follower member 292, as discussed hereinafter with respect to FIGS. 195A-201C). A comparison of FIGS. 191A, 192A, and 193A shows that the handle still remains at the 150 degree rotation position.

As the sash window continues, to be opened even further (i.e., is elevated further), the biased latch member will be start to extend, as shown by the angled arrow in FIG. 193B. Once the sash window is opened sufficiently for the tongue portion of the latch member to be clear of (i.e., be above) the lower protrusion 330L, as seen in FIG. 194B, the latch member is biased to return to its fully extended position. The tip 292T of the flexible follower member 292 is correspondingly moved into position "A" (see FIG. 194C), and has then completed one cycle of movement about the track.

While the latch member is biased back into the fully extended position of FIG. 194B (and FIG. 141), the corresponding movement of the lever arm 170 results in its sculpted follower surface 175S of the arm 175 counter-rotating into contact with the first cam surface 181 of driving plate 180, and drives both the driving plate and shaft/handle member 140 to also counter-rotate. The force of the arm 175 contacting and driving the shaft/handle member 140 may be sufficient to drive the shaft/handle member to counter-rotate from the 150 degree detent position to be at the 120 degree position, as shown in FIG. 194A. Such driven counter-rotation of the lever arm 170 may be limited to the 120 degree position, by the apex 175T of the sculpted surface 175S of the lever arm 170 contacting a portion of the cylindrical hub 163 of the cam 160, as shown in FIG. 144.

In an embodiment where a second, protrusion 330U is utilized, on the stop member 301, further opening of the sash window will be limited by contact of the top of the fully extended tongue portion of the latch member 250 with the lower surface 330Ui of the upper protrusion 330U, as shown by the dashed outline of the tongue in FIG. 194B, and as seen in FIG. 146. The positions of the tip 292T of the flexible follower member 292, the cam 160, the shaft/handle member 140, and lever arm 170 remain unchanged from such movement of the sash window. The second protrusion 330U may thus serve as a window vent stop.

If the user desires to open the window further (i.e., beyond the limited position shown in FIG. 146), the user may rotate the shaft/handle member 140 from the 120 degree position (e.g., FIG. 194A) to again be back in the 150 degree detent position (e.g., FIG. 189A), for the tongue to again be in a cocked trigger position (e.g., FIG. 189B), but now being with respect to the upper protrusion, as seen in FIG. 151.

This movement, just as before, will cause the tip 292T of the flexible follower member 292 to again be positioned back in the nested portion of the track, as shown in FIG. 189C. Further opening of the sash window may then cause similar positions for the tongue portion of the latch member 250, the lever arm 170, and the tip 292T of the flexible follower member 292, as occurred for sash window and tongue movement relative to the lower protrusion 330L (compare FIG. 156 with FIGS. 139 and 192B). Once the tongue 253 of the latch member 250 is positioned beyond (i.e., above) the upper protrusion 330U (FIG. 158), the sash window may be moved, into a fully opened window position.

If the user desires to tilt the sash window out of the master window frame, the shaft/handle member 140, which is shown at 120 degrees in FIG. 161 to correspond to the latch member 250 position in FIG. 158, may then be rotated to the 180 degree position shown in FIGS. 164-166. This may cause the second cam surface 182 of the driving plate 180 (FIG. 32) to contact and drive the sculpted surface 175S of the arm 175 of the lever arm 170 (FIG. 166), to cause the tongue of the latch member to retract sufficiently to be clear of the track of the master window frame, as shown in FIG. 163. The upper end of the sash window is no longer restrained from pivoting away from the master window frame.

Once the user releases the shaft/handle member 140, the spring 291 biases the latch member 250 into the fully extended position shown in FIG. 167, and the shaft/handle member 140 may again be driven to be back at 120 degrees of rotation, as shown in FIG. 170.

If the user decides to close the sash window, as indicated by the downward pointing arrow within FIG. 167 and FIG. 195B, a lower curved/angled surface 253L of the tongue 253 (FIG. 87) will initially contact a corresponding surface 330Uvi of the upper protrusion 330U. Downward moment of the sash window will cause the tongue 253 of the latch member 250 to again be retracted into a distal position, as shown in FIG. 196B, as a result of such contact with the surface 330Uvi. During this downward movement of the window, the tip 292T of the flexible follower member 292 may move from its position in FIG. 195C, over the adjacent wall portion of the track 255 to as shown in FIG. 196C.

Once the tongue 253 of the latch member 250 begins to contact the surface 330Uv of the upper protrusion 330U of the stop member 310, the tongue may extend until it contacts the surface 330Uiv, as shown in FIG. 197B. During this extension of the tongue portion of the latch member 250, the tip 292T of the flexible follower member 292 may move from, its position in FIG. 196C to enter the nest portion of the track, as shown in FIG. 197C. Continued downward movement of the sash window will cause the tongue 253 of the latch member 250 to then contact the surface 330Uiii of the upper protrusion 330U (FIG. 198B), which again causes the latch member 250 to begin retracting, and causes the tip 292T of the flexible follower member 292 to exit the nest portion of the track (i.e., to exit, from point "C"), as shown in FIG. 198C.

Continued downward movement of the sash window causes retraction of the tongue portion of the latch member 250 until reaching its distal position, as shown in FIG. 199B, and the tip 292T of the flexible follower member 292 is correspondingly driven to the position "D" shown in FIG. 199C. With continued downward movement of the sash window, the tongue portion of the latch member 250 will begin to extend, as shown in FIG. 200B, and once the sash window has moved downward far enough, the top of the tongue 253 will again be disposed below the bottom stop surface 330Ui of the upper protrusion 330U, which positioning below the protrusion may again permit it to serve as a vent stop. The tip 292T of the flexible follower member 292 correspondingly moves from point "D" to point "A," and has then completed one cycle and has returned to the starting point, as shown in FIG. 201C.

It may thus be seen that in order for the tip 292T of the flexible follower member 292 to automatically navigate through the nest portion of the track during the downward movement of the window caused by the user, the surfaces 330Uiii, 330Uiv, and 330Uv are provided on the upper protrusion 330U (and similarly the surfaces 330Liii, 330Liv, and 330Lvi are provided on the lower protrusion 330L). These surfaces are not necessary (i.e., functional) in the same manner for opening of the window, as they are during closing of the sash window (i.e., the nest portion is utilized to provide the cocked "trigger" position of the latch member during opening of the window, but not during closing of the window). These surfaces therefore serve to guide the tip 292T and automatically release it from the nest portion of the track at Point "C" during continuous closing of the window. Therefore, these surfaces on each protrusion of the stop member generally match/correspond to the key wall portion of the track 225 of the latch housing 210 (e.g., a peak, a valley, and another peak).

Note that the cam 160 and shaft/handle member 140 combination remain at the 120 degree position throughout the downward movement of the sash window and the corresponding movements of the tongue 253 of the latch member 250, as seen within FIGS. 196A-201A.

The upper protrusion 330U again serves as a vent stop (FIG. 173 and FIG. 201B). However, the sash window could be opened beyond the vent stop position, in the same manner as was previously described hereinabove (i.e., by manually turning the shaft/handle member 140 back to the 150 degree detent position and by elevating the window).

If the user instead desires to continue lowering the sash window (e.g., from the position in FIG. 173 or FIG. 178 into the closed window position shown within FIG. 125), the movements (retraction/extension) of the tongue 253 of the latch member 250 with respect to the lower protrusion 330L, and the cycling of the tip 292T of the flexible follower member 292 with respect to the track 255, would be the same was just described with respect to such movements relating to the upper protrusion 330U, as shown within FIGS. 195A-201C.

Once the sash window reaches the closed window position, the tongue 253 of the latch member 250 is again positioned as shown within FIG. 183 and FIG. 187B (i.e., just below the surface 330Li of the lower protrusion 330L of the stop member 301), and the sash window is thereby automatically locked.

Additionally, the shaft/handle member 140 may be counter-rotated from its 120 degree position shown in FIG. 184, back to return to the zero degree rotation position, of FIGS. 186 and 187A, to again reengage the cam 160 with the keeper 451, and redundantly lock the sash window.

While illustrative implementations of one or more embodiments of the present invention are provided hereinabove, those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A window fastener, for use with respect to a frame of a sash window configured to at least slide with respect to a master window frame, said window fastener comprising:

a sash lock;

a latch assembly, said latch assembly configured to at least occupy a latched position and an unlatched position;

a stop member, said stop member configured to be mounted to the master window frame, and comprising: a base; a first protrusion formed with a shape; and a second protrusion also formed with said shape, being formed on said base at a distance away from said first protrusion;

wherein said sash lock is configured to engage a keeper in a locked position, to lock the sash window in a closed window position, said sash lock further configured to occupy an unlocked position to permit the sash window to slide;

wherein when the sash window is in the closed window position, said latch assembly is further configured to cooperate with said first protrusion, for said latch assembly to lock the sash window in the closed window position, by contact of a first portion of said latch assembly with a first portion of said shape of said first protrusion:

wherein said sash lock and said latch assembly are further configured for said sash lock to actuate said latch assembly into a cocked position being between said latched and unlatched positions, when said sash lock is in said unlocked position, to permit the sash window to slide away from the closed window position;

wherein when said latch assembly is in said cocked position and the sash window is slid away from the closed window position, contact of a second portion of said latch assembly with a second portion of said shape of said first protrusion triggers said latch assembly to reposition into said latched position, for said latch assembly to limit opening of the sash window to a limited open window position, by contact of said first portion of said latch assembly with said first portion of said shape of said second protrusion, the limited open window position being between the closed window position and a full open window position;

wherein when the sash window is in the limited open window position and said sash lock is actuated to again place said latch assembly into said cocked position, the sash window is permitted to slide beyond the limited open window position; and wherein when the sash window is slid toward the closed window position, contact of a third portion of said latch assembly with a third portion of said shape permits said latch member to move past said shape, for the sash window to slide back into the closed window position from either the full open window position or the limited open window position, where said first portion of said latch assembly automatically locks the sash window, with respect to said first portion of said shape of said first protrusion.

2. The window fastener according to claim 1, wherein said sash lock comprises a forced-entry-resistant sash lock.

3. A window fastener, for use with respect to a frame of a sash window configured to at least slide with respect to a master window frame, said window fastener comprising:

a latch assembly, said latch assembly comprising: a latch housing; a latch member mounted in said latch housing to slide between a retracted position and an extended position; and a spring configured to bias said latch member toward said extended position;

a sash lock, said sash lock comprising:

a lock housing, said lock housing comprising: a wall shaped to form an interior surface that defines a cavity; and an orifice interconnected with said cavity;

a shaft, said shaft pivotally mounted to said orifice;

a cam; said cam pivotally mounted to said shaft within said housing cavity, and configured to be selectively rotated when said shaft is rotated;

a lever arm, said lever arm pivotally mounted to said lock housing, and configured to be selectively driven by said cam to drive said latch member to oppose said biasing and slide away from said extended position;

a stop member, said stop member comprising a protrusion;

wherein said cam is configured to engage a keeper in a locked position, to lock the sash window in a closed window position, said cam further configured to occupy an unlocked position to permit the sash window to slide;

wherein said sash lock is configured to cooperate with said latch assembly, and said latch assembly is configured to cooperate with said protrusion of said stop member, wherein said latch member limits opening of the sash window to a limited open window position, by contact of a first portion of said latch member with a first portion of said protrusion, the limited open window position being between the closed window position and a full open window position;

wherein said sash lock and said latch assembly are further configured for said sash lock to actuate said latch member into a cocked position between said extended position and said retracted position, where said latch housing releasably opposes said bias, to permit said latch member to move past said protrusion, for the sash window to slide beyond the limited open window position;

wherein when the sash window is subsequently moved beyond the limited open window position, contact of a second portion of said latch member with a second portion of said protrusion triggers said latch member to exit said cocked position for said bias to be unopposed and said latch member is biased into said extended position; and wherein as the sash window is subsequently slid toward the limited open window position, contact of a third portion of said latch member with a third portion of said protrusion permits said latch member to move past said protrusion, for the sash window to move back between the limited open window position and the closed window position, where said first portion of said latch member automatically limits sliding of the sash window to the limited open window position.

4. The window fastener according to claim 3, wherein said stop member comprises: a second protrusion shaped the same as said first protrusion; said second protrusion being positioned on said stop member to automatically lock the sash window in the closed window position when the sash window is moved into the closed window position, by contact of said first portion of said latch member with a first portion of said second protrusion.

5. The window fastener according to claim 3, wherein said sash lock comprises a forced-entry-resistant sash lock configured to resist forced rotation of said cam away from said locked position from outside of the sash window, when the sash window is in the closed window position, said forced-entry-resistant sash lock comprising:

a first curved recess and a second curved recess formed in said shaft, and clocked about an axis of said shaft at a respective first angle and second angle;

a first shaped opening and a second shaped opening formed in said cam at respective first and second positions, and an arcuate recess;

a driving plate fixedly secured to said shaft, and comprising: a protrusion configured to alternately engage each of a first end and a second end of said arcuate recess to respectively drive said cam in each of a first direction and a second direction, respectively;

a spring;

a plate member, said plate member slidably mounted with respect to said lock housing, and configured to slide between a first position and a second position; wherein said spring is configured to bias said plate member into said second position; said plate member comprising: a first end formed into a curved surface shaped to correspond to each of said first and second curved recesses in said shaft, and a protrusion shaped and positioned to be alternately received within said first shaped opening and said second shaped opening of said cam;

wherein said first end of said plate member in said first position is distal from said shaft, and said shaft is free to rotate;

wherein when said plate member is in said second position, said protrusion of said plate member to be respectively received within each of said first shaped opening and said second shaped opening of said cam, when rotated to be aligned therewith, and said curved surface of said plate member is correspondingly received within said first curved recess and said second curved recess, respectively, when rotated to be aligned therewith, at said locked position and said unlocked position of said cam.

6. The window fastener according to claim 3, further comprising: means for releasably locking said cam with respect to said latch housing when a handle of said sash lock is positioned for said cam to occupy said locked position, for preventing forced entry by forced rotating of said cam from outside of the sash window.

* * * * *